US006040814A

United States Patent [19]

Murakami et al.

[11] Patent Number: 6,040,814

[45] **Date of Patent: *Mar. 21, 2000**

[54] ACTIVE-MATRIX LIQUID CRYSTAL DISPLAY AND METHOD OF DRIVING SAME

[75] Inventors: Hiroshi Murakami; Koji Yoshioka; Keizo Morita; Masafumi Itokazu; Ken-ichi Nakabayashi; Akira Yamamoto; Munehiro Haraguchi, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,685

[22] Filed: May 13, 1996

[30] Foreign Application Priority Data

Sep. 19, 1995 [JP] Japan ..... 7-239773

[51] Int. Cl.[7] ..... G09G 3/36

[52] U.S. Cl. ..... 345/94; 345/96; 345/209

[58] Field of Search ..... 345/94, 90, 92, 345/98, 87, 96, 208, 209

[56] References Cited

U.S. PATENT DOCUMENTS

| | | | |
|---|---|---|---|
| 4,571,585 | 2/1986 | Stein et al. | 345/209 |
| 4,779,085 | 10/1988 | Mizutome et al. | 345/92 |
| 4,803,480 | 2/1989 | Soneda et al. | 345/94 |
| 5,432,527 | 7/1995 | Yanai et al. | 345/92 |
| 5,561,441 | 10/1996 | Hamano | 345/96 |
| 5,657,041 | 8/1997 | Choi | 345/94 |
| 5,659,375 | 8/1997 | Yamashita et al. | 349/38 |
| 5,712,652 | 1/1998 | Sato et al. | 345/90 |
| 5,724,057 | 3/1998 | Kimura et al | 345/96 |
| 5,892,494 | 4/1999 | Kimura et al. | 345/96 |

*Primary Examiner*—Richard A. Hjerpe
*Assistant Examiner*—Ronald Laneau
*Attorney, Agent, or Firm*—Greer, Burns & Crain, Ltd.

[57] ABSTRACT

An active-matrix LCD causes no cross-talk even if the capacitance between a given cell and adjacent data lines is large. The LCD has a liquid crystal panel which has data lines arranged in parallel with one another, scan lines arranged orthogonally to the data lines, and liquid crystal cells arranged at the intersections of the data and scan lines, respectively. Each of the cells has a cell electrode and a switching device that is arranged between and connected to the cell electrode and a corresponding one of the data lines. The conduction of the switching device is controlled in response to a scan pulse applied to a corresponding one of the scan lines. The LCD also has a data driver for applying data signals to the data lines, respectively, so that the data signals are written to corresponding ones of the cells, and a scan driver for applying the scan pulse sequentially to the scan lines. The data driver applies positive and negative signals that are opposite to each other with respect to a reference level, to each of the data lines within the period of the scan pulse, to zero an effective voltage applied to each data line. As a result, a voltage sustained by any cell to which data has been written is not affected by voltages successively applied to a data line to which the cell is connected and a data line to which the cell is capacitively connected.

47 Claims, 53 Drawing Sheets

Fig.4

| COLUMN n<br>VDn | COLUMN n+1<br>VDn+1 | COLUMN n+2<br>VDn+2 |
|---|---|---|
| +V1n | -V1(n+1) | +V1(n+2) |
| +V2n | -V2(n+1) | +V2(n+2) |
| +V3n | -V3(n+1) | +V3(n+2) |
| +V4n | -V4(n+1) | +V4(n+2) |

Fig.16

1. CORRECTING INFLUENCE OF COLUMN n

| CORRECTION TIME | APPLIED VOLTAGE | DEVIATION | SUSTAINED VOLTAGE OF COLUMN n |
|---|---|---|---|
| 0 | $Vn$ | $-\alpha 1 \cdot Vn$ | $Vn-\alpha 1 \cdot Vn$ |
| 1 | $Vn+\alpha 1 \cdot Vn$ | $-\alpha 1 \cdot Vn-\alpha 1^2 \cdot Vn$ | $Vn-\alpha 1^2 \cdot Vn$ |
| 2 | $Vn+\alpha 1 \cdot Vn+\alpha 1^2 \cdot Vn$ | $-\alpha 1 \cdot Vn-\alpha 1^2 \cdot Vn-\alpha 1^3 \cdot Vn$ | $Vn-\alpha 1^3 \cdot Vn$ |
| 3 | $Vn+\alpha 1 \cdot Vn+\alpha 1^2 \cdot Vn+\alpha 1^3 \cdot Vn$ | $-\alpha 1 \cdot Vn-\alpha 1^2 \cdot Vn-\alpha 1^3 \cdot Vn-\alpha 1^4 \cdot Vn$ | $Vn-\alpha 1^4 \cdot Vn$ |

2. CORRECTING INFLUENCE OF COLUMN n-1

| | APPLIED VOLTAGE | | DEVIATION |
|---|---|---|---|
| COLUMN n | $Vn+\alpha 1 Vn+\alpha 1^2 Vn+\dfrac{\alpha 2}{1-\alpha 1} V(n-1)$ | $\rightarrow$ | $-\alpha 1 Vn-\alpha 1^2 Vn-\alpha 1^3 Vn-\dfrac{\alpha 1 \alpha 2}{1-\alpha 1} V(n-1)$ |
| COLUMN n-1 | $V(n-1)$ | $\rightarrow$ | $-\alpha 2 V(n-1)$ $\quad Vn-\alpha 1^3 Vn$ |

Fig.18

| CORRECTION TIME | APPLIED VOLTAGE | SUSTAINED VOLTAGE |
|---|---|---|
| 0 | $V_n \quad (n \geq 2)$ | $V_n - \Delta V_n$<br>$= V_n - \alpha_1 V_n - \alpha_2 V(n-1)$ |
| 1 | $V_n + \Delta V_n$ | $V_n + \Delta V_n - \alpha_1 (V_n + \Delta V_n) - \alpha_2 V(n-1)$<br>$= V_n + \alpha_1 V_n + \alpha_2 V(n-1) - \alpha_1 V_n - \alpha_1 \Delta V_n - \alpha_2 V(n-1)$<br>$= V_n - \alpha_1 V_n$ |
| 2 | $V_n + \Delta V_n + \alpha_1 \Delta V_n$ | $V_n + \Delta V_n + \alpha_1 \Delta V_n - \alpha_1 (V_n + \Delta V_n + \alpha_1 \Delta V_n) - \alpha_2 V(n-1)$<br>$= V_n - \alpha_1^2 \Delta V_n$ |
| 3 | $V_n + \Delta V_n + \alpha_1 \Delta V_n + \alpha_1^2 \Delta V_n$<br>$\vdots$<br>$V_n + (1 + \alpha_1 + \alpha_1^2 + \cdots) \Delta V_n$<br>$\parallel$<br>$V_n + \sum_{m=0}^{m} \alpha_1^n \Delta V_n$ | $\vdots$ |

ACTIVE-MATRIX LIQUID CRYSTAL DISPLAY AND METHOD OF DRIVING SAME

BACKGROUND OF THE INVENTION

1. Field of the Invention

The present invention relates to an active-matrix liquid crystal display (LCD), and particularly, to an active-matrix LCD capable of reducing cross-talk and correctly displaying brightness according to display data.

2. Description of the Related Art

Each cell of an active-matrix LCD is equivalent to a capacitor having an end connected to a common voltage and another end to a TFT. Each cell has a cell electrode that may form parasitic capacitors with adjacent data and scan lines. When a scan pulse is applied to a scan line, TFTs of a row of cells connected to the scan line are turned on to connect cell electrodes of the cells to data lines, respectively. Then, data voltages are applied to the data lines to charge the cells. When the scan pulse disappears, the TFTs are turned off, and the cells sustain the applied voltages until the next scan pulse is applied thereto. A time necessary to write display data to a whole screen is called a frame, and each scan line receives a scan pulse per frame. Namely, each cell is written frame by frame.

A voltage sustained by a given cell controls liquid crystals of the cell. The display quality of the LCD is dependent on whether or not each cell thereof correctly sustains an applied voltage for a period between scan pulses. An off current of the TFT of the cell can fluctuate the sustained voltage. To suppress such a fluctuation, it is usual to provide each cell with an accumulation capacitor. The accumulation capacitor is formed by overlaying the cell electrode on an adjacent scan line or on a dedicated accumulation capacitor electrode. The accumulation capacitor, however, is incapable of completely eliminating the fluctuation because it is caused by various reasons. It is required to provide an LCD driving method or structure capable of correctly sustaining cell voltages.

The scan pulse also fluctuates the voltage sustained by a cell. Since this kind of fluctuation is constant, it can be canceled by adjusting a voltage applied to a counter electrode of each cell or by correcting a data voltage applied to each cell. An object of the present invention is to eliminate a fluctuation in the sustained voltage due to data voltages applied to adjacent data lines of each cell, and therefore, this kind of fluctuation, which is called cross-talk, is mainly explained.

When cross-talk occurs on a given cell due to data voltages applied to other cells that are connected to the data line to which the given cell is connected, it is called vertical cross-talk. When cross-talk occurs on a given cell due to data voltages applied to adjacent data lines of the given cell, it is called horizontal cross-talk. The magnitude of cross-talk is determined by the ratio of the parasitic capacitance of a cell to the total capacitance thereof. The parasitic capacitance is produced between the cell and adjacent data lines. To reduce the cross-talk, the parasitic capacitance must be reduced. For this purpose, a prior art forms a dedicated accumulation capacitor electrode in each cell. This electrode, however, needs a space that reduces an aperture of the cell to lower the brightness. To compensate for the brightness loss, it is necessary to employ strong illumination, which increases power consumption and is disadvantageous for a portable LCD that must be bright at low power consumption. There is a large-aperture LCD that forms each cell electrode over adjacent data lines. This LCD, however, produces large parasitic capacitance between each cell and adjacent data lines, which enlarges cross-talk.

SUMMARY OF THE INVENTION

An object of the present invention is to provide an active-matrix LCD capable of preventing cross-talk even if there is large capacitance between each cell and adjacent data lines, and a large-aperture LCD capable of displaying high-quality, high-brightness images without cross-talk.

In order to accomplish the object, the first aspect of the present invention provides an active-matrix LCD having a liquid crystal panel, a data driver, and a scan driver. The liquid crystal panel has data lines arranged in parallel with one another, scan lines arranged orthogonally to the data lines, and liquid crystal cells formed at intersections of the data and scan lines, respectively. Each of the cells has a cell electrode and a switching device that is connected between the cell electrode and a corresponding one of the data lines and is controlled by a scan pulse applied to a corresponding one of the scan lines. The data driver applies data voltages to the data lines to write the cells. The scan driver applies the scan pulse sequentially to the scan lines. The data driver applies positive and negative signals that are opposite to each other with respect to a reference level to each of the data lines within the period of the scan pulse.

Since the data driver applies positive and negative signals to each of the data lines in a horizontal scan period (1H), an effective voltage applied to each data line is 0 V. As a result, the voltages applied to the data lines never fluctuate the voltages sustained by the cells.

The first aspect of the present invention zeroes an effective voltage applied to each data line. The periods of positive and negative voltages applied to each data line in a horizontal scan period may not be equal to each other if the product of the strength and period of the positive voltage is equal to that of the negative voltage, to zero the voltage applied to each data line. For example, the strength of a voltage whose polarity is opposite to a data voltage to be written may be high to shorten the application period thereof. It is possible to apply positive and negative voltages to each data line several times in a scan period.

An inverted voltage may be applied to each data line in the first half of a scan period and a data voltage to be written in the second half of the same with a scan pulse being generated in the second half of the scan period. Instead, the data voltage and scan pulse may be generated in the first half of the scan period and the inverted voltage in the second half thereof.

Zeroing an effective voltage applied to each data line may prevent a fluctuation in the sustained voltages of the cells due to voltages being successively applied to the data lines. This, however, does not prevent a fluctuation in the sustained voltages of the cells caused at the end of the scan pulse or data voltage. This fluctuation is calculable because a data voltage applied to a given data line is known, and therefore, can be canceled by correcting the voltage applied to the data line.

A second aspect of the present invention provides an LCD that applies a data voltage to each data line in a period shorter than a horizontal scan period. A fixed voltage is applied to each data line for a partial period in each scan period. A scan pulse disappears while a data voltage is being applied to a data line. The fixed voltage may be an average of the maximum and minimum of data voltages applied to the data lines, or may be about an off voltage of the scan pulse.

The fixed voltage applied to each data line for a certain period reduces a fluctuation in a temporal average of data voltages applied to each data line. This makes a correction operation easier. As the period for applying the fixed voltage extends, a temporal average of voltages applied to each data line approaches the fixed voltage, to reduce the influence of data voltages applied to the data line and prevent cross-talk.

The TFT of each cell of the LCD has a minimum current flowing between the drain and source thereof. If the fixed voltage applied to each data line is around the off voltage of the scan pulse, a current flowing through the TFT during the period for applying the fixed voltage will be very small. As a result, each cell may correctly sustain its voltage to correctly display images.

BRIEF DESCRIPTION OF THE DRAWINGS

The present invention will be more clearly understood from the description as set forth below with reference to the accompanying drawings, wherein:

FIG. 4 shows data voltages applied to cells of an LCD that causes cross-talk;

FIG. 16 explains a method of calculating a correction value according to the first embodiment;

FIG. 18 shows a modification of the method of calculating a correction value according to the first embodiment;

DESCRIPTION OF THE PREFERRED EMBODIMENTS

Before proceeding to a detailed description of the preferred embodiments of the present invention, prior art active-matrix LCDs will be described with reference to the accompanying drawings for a clearer understanding of the differences between the prior art and the present invention.

Figure 1:
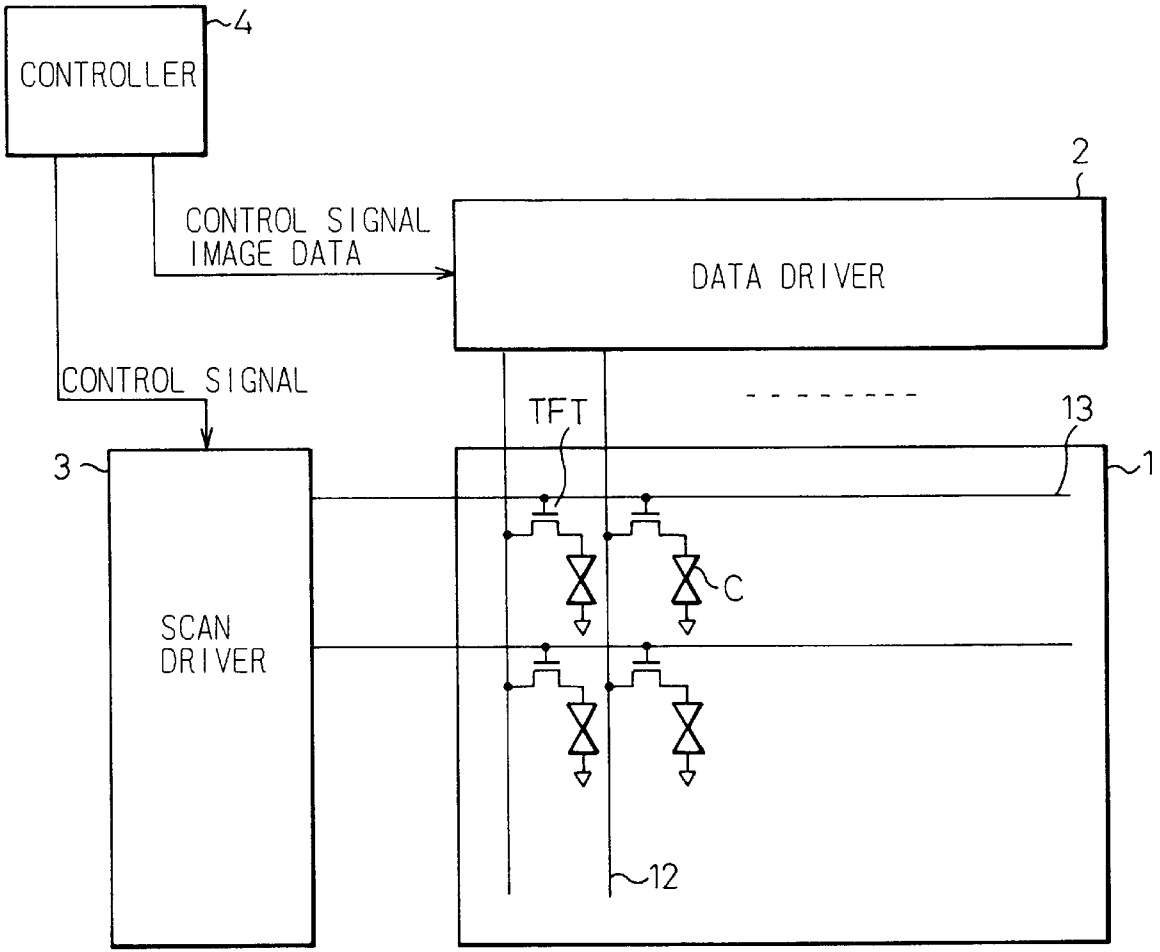
FIG. 1 shows a basic arrangement of an active-matrix LCD.

FIG. 1 shows a basic arrangement of an active-matrix LCD. Like parts are represented with like reference marks through the drawings, to omit repetitive explanation.

The LCD has a liquid crystal panel 1, a data driver 2, a scan driver 3, and a controller 4. The panel 1 consists of two substrates that face each other.

One of the substrates has data lines 12 and scan lines 13 that are orthogonal to the data lines 12. Intersections of the data and scan lines are provided each with a thin film transistor (TFT) and a cell electrode. The other substrate has a counter electrode. Liquid crystals are held between the two substrates. At each of the intersections of the data and scan lines, the cell electrode, counter electrode, and liquid crystals form a cell serving as a pixel, which is electrically equivalent to a capacitor.

Figure 2:
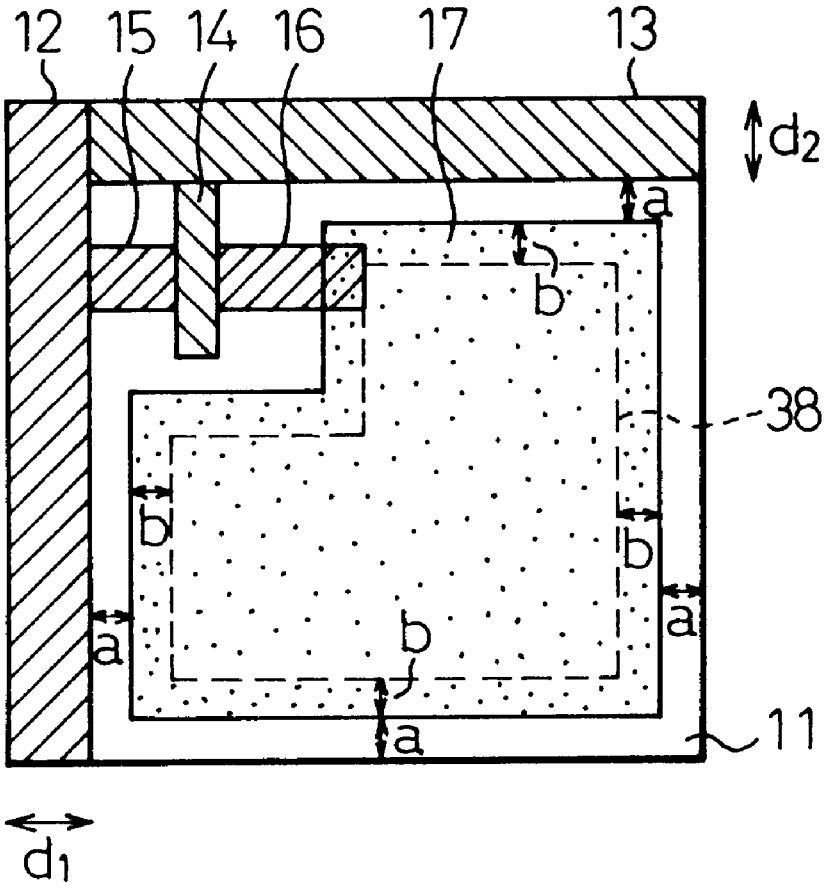
FIG. 2 is a top view showing a cell of an LCD according to prior art.

FIG. 2 is a top view showing the cell.

The cell has a TFT substrate 11 on which the TFT is formed. The data line 12 and scan line 13 are orthogonal to each other on the TFT substrate 11. The data line 12 is connected to a semiconductor layer made of polysilicon or amorphous silicon. The scan line 13 is connected to a gate electrode 14 of the TFT. A source 16 of the TFT is connected to the cell electrode 17. The TFT has a drain 15.

The substrate that faces the TFT substrate has a light shield film such as a black matrix (BM) indicated with a dotted line in FIG. 2. A boundary 38 on the light shield film corresponds to a display aperture.

Figure 3A:
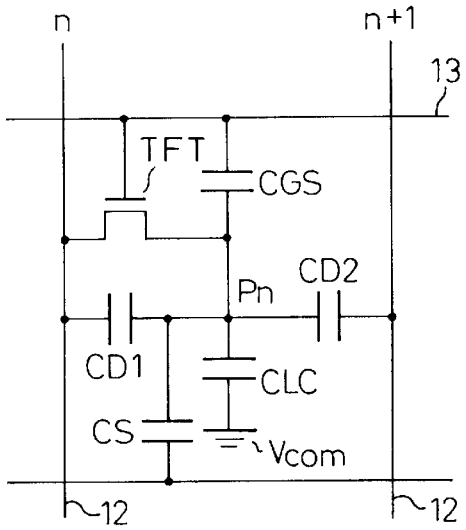
FIG. 3A shows an equivalent circuit of a large-aperture LCD.
Figure 3B:
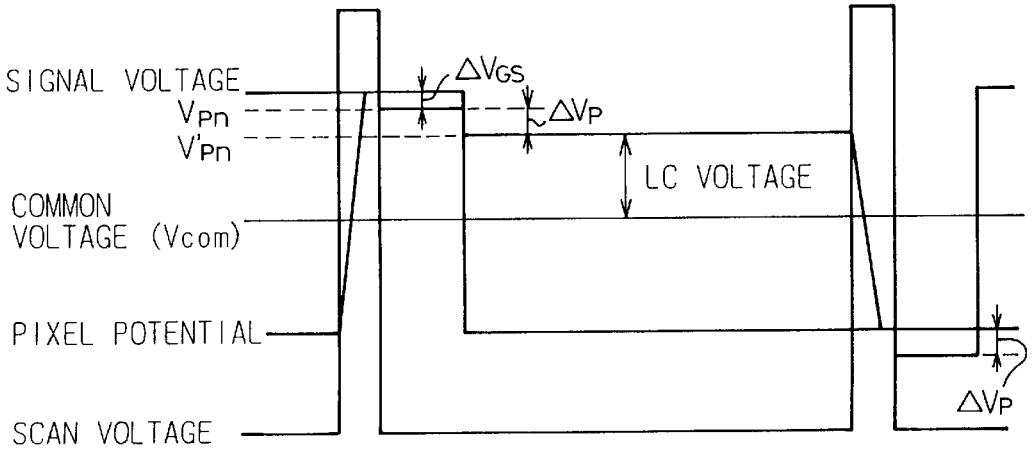
FIG. 3B explains the operation of the LCD of FIG. 3A.

FIG. 3A shows an equivalent circuit of the cell. The equivalent circuit includes the cell as well as parasitic capacitors formed between the cell and adjacent data lines. FIG. 3B shows signal waveforms applied to the data line 12, and scan line 13, and liquid crystals.

In FIG. 3A, the cell is equivalent to a capacitor whose one end is connected to a common voltage Vcom and the other end to the TFT. The capacitor has a capacitance of C1n. The cell electrode 17 is formed between the data lines n and n+1. Parasitic capacitance between the cell electrode 17 and the data line n is C1n1, and that between the cell electrode 17 and the data line n+1 is C1n2. In practice, there is parasitic capacitance between the cell electrode 17 and the scan lines 13. Since the parasitic capacitance with respect to the scan lines 13 is not directly related to the present invention, it will not be discussed.

When the TFT is of an n-channel type, the data driver 2 and scan driver 3 apply the data voltage and scan pulse shown FIG. 3B to the data line 12 and scan line 13, respectively. In response to an instruction signal, the data driver 2 applies data voltages to the data lines, respectively. The scan driver 3 applies the scan pulse sequentially to the scan lines. When the positive scan pulse is applied to a given scan line 13, the TFTs of cells connected to the scan line are turned on to connect the cell electrodes of the cells to the data lines 12, respectively. Then, the cells receive data voltages applied to the data lines 12 and are charged thereby. When the scan pulse disappears to turn off the TFTs, the cells sustain the data voltages until the next scan pulse is applied to the corresponding scan line. The time required to write display data to a full screen of the LCD is called a frame, and every scan line receives a scan pulse frame by frame. Namely, the cells connected to a given scan line are written frame by frame.

A voltage sustained by a cell controls liquid crystals contained in the cell. Accordingly, the display quality of the LCD is determined by whether or not each cell correctly sustains a data voltage for a period between the adjacent scan pulses applied thereto. To suppress a fluctuation in the sustained voltage of a cell due to an off current of the TFT, a prior art forms an accumulation capacitor in parallel with each cell by overlaying the cell electrode 17 on the scan line 13 and a dedicated accumulation capacitor electrode. The accumulation capacitor, however, is incapable of completely eliminating the fluctuation. It is required to provide a driving method or an LCD structure that is capable of stabilizing the sustained voltage of each cell.

In FIG. 3B, the data voltage applied to the cell through the data line 12 fluctuates by ΔVgs at the end of the scan pulse. The data voltage again fluctuates by ΔVp when another data voltage is applied to a cell in the next row through the same data line 12. Since the change in the scan pulse that causes the fluctuation ΔVgs is constant, the fluctuation Δvgs is also constant and can be canceled by adjusting a voltage applied to the counter electrode or by correcting the data voltage accordingly. The present invention mainly aims to solve a fluctuation caused by a data voltage applied to an adjacent data line. This fluctuation is called cross-talk.

FIG. 4 explains cross-talk in the active-matrix LCD and shows signed voltages to be stored in the cells of the LCD. To prevent flickering, the polarities of voltages applied to the cells are alternated column by column, or row by row, or both. The polarity of a voltage applied to a given cell is changed frame by frame. In the following explanation, the polarities of voltages are alternated column by column.

Figure 5A:
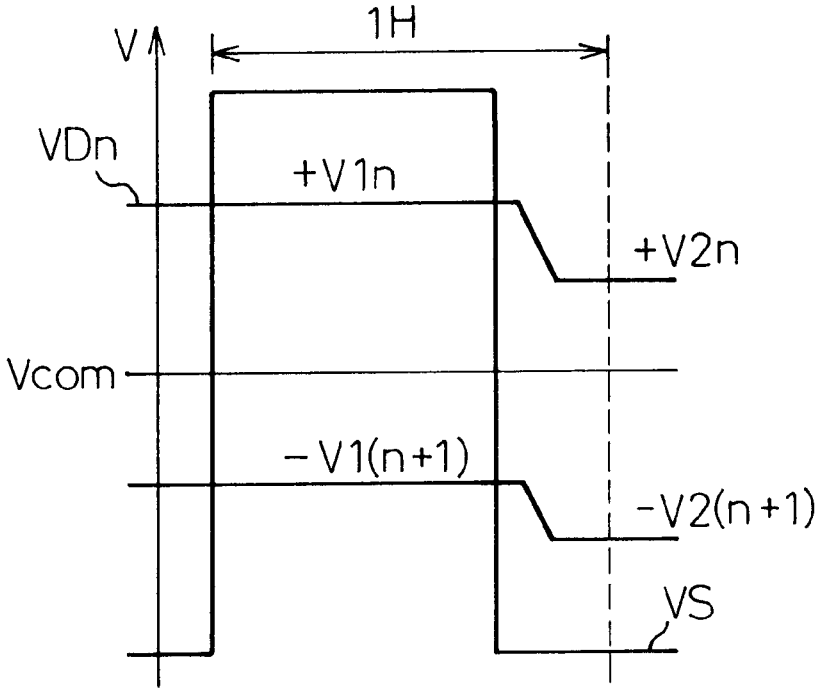
FIGS. 5A and 5B explain an influence of data voltages applied to adjacent cells.
Figure 5B:
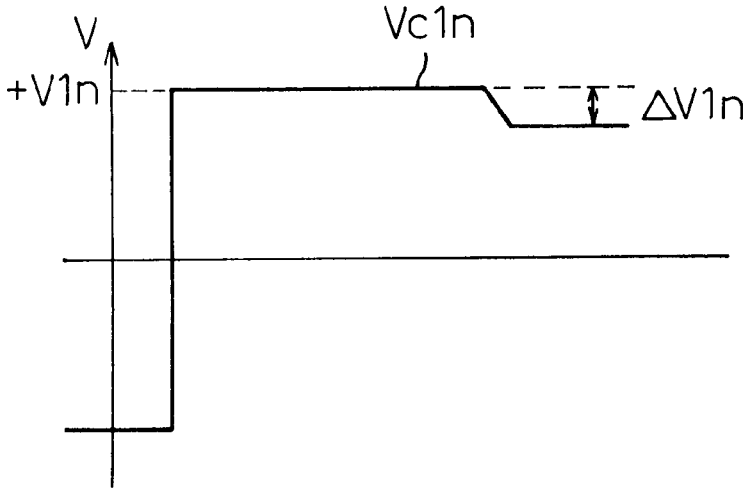

FIG. 5A shows data voltages applied to data lines connected to columns n and n+1 of cells of the LCD, and a scan pulse applied to each row of the cells. FIG. 5B shows a voltage Vcln sustained by the cell in the first row of the column n. In the column n, the absolute value of the voltage applied to the cell in the first row is higher than that applied to a cell in the second row. In the column n+1, the absolute value of a data voltage applied to a cell in the first row is smaller than that applied to a cell in the second row.

In FIG. 5A, the scan pulse is applied to turn on the TFTs of the cells in the first row, and a data voltage of +V1n is applied to the column n to set Vc1n=V1n. When the scan pulse ends, a fluctuation of ΔVgs occurs in the voltage Vc1n. This fluctuation is ignored in this explanation. When a row to be scanned is changed from the first row to the second row, the data voltage applied to the column n is changed from +V1n to +V2n, and that applied to the column n+1 from −V1(n+1) to −V2(n+1). As shown in FIG. 3A, each cell in the column n forms parasitic capacitors with respect to the data lines n and n+1. Accordingly, the sustained voltage Vcln fluctuates by ΔV1n as follows:

$$\Delta V1n = CD1(V2n - V1n)/CT + CD2(-V2(n+1) + V1(n+1))/CT \quad (1)$$

where CT=CLC+CD1+CD2+CGS+CS

The fluctuation ΔV1n is dependent on changes in the data voltages applied to the data lines n and n+1 and the ratio of the parasitic capacitance to the total capacitance of the cell.

Deterioration in the display quality of the LCD due to the fluctuation ΔV1n will be explained.

Figure 6A:
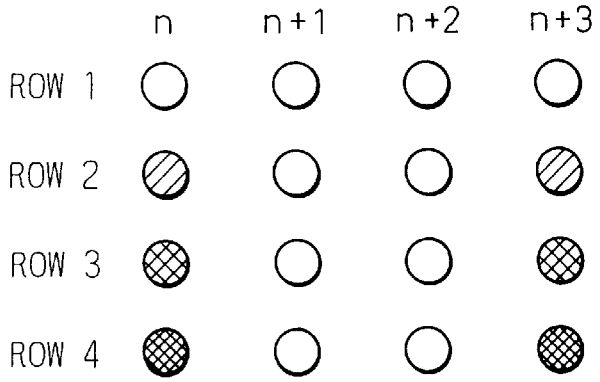
FIGS. 6A and 6B explain an influence of cross-talk on a display pattern.
Figure 6B:
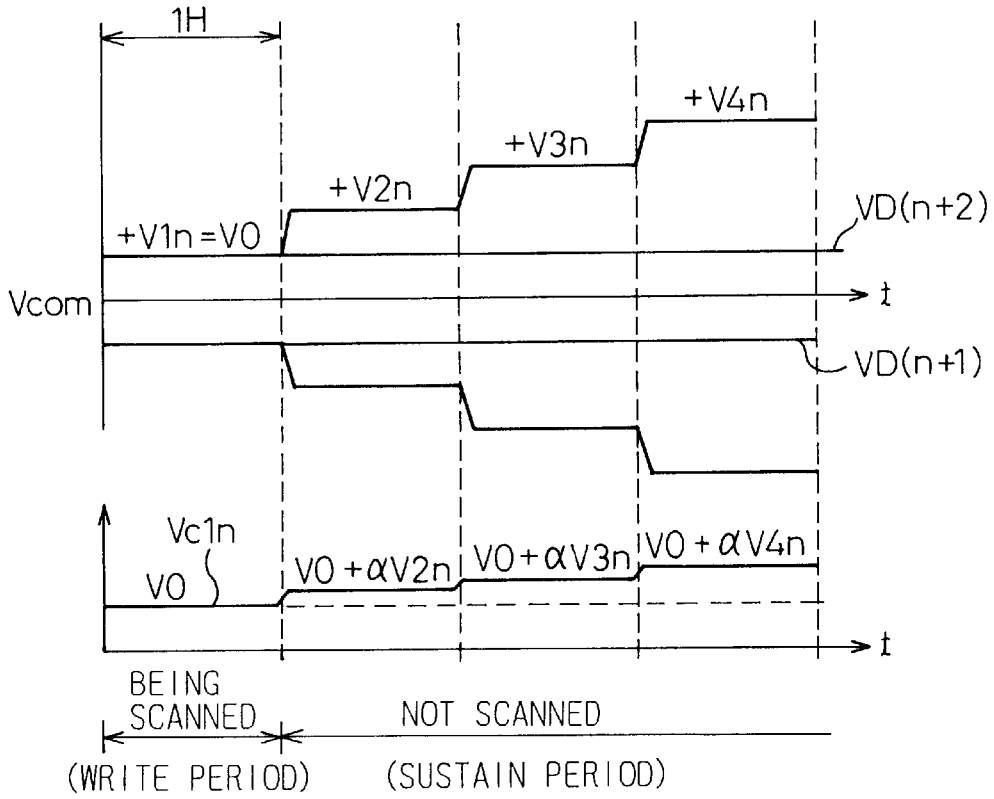

FIG. 6A shows an example of a display pattern achieved by cells of the LCD that normally displays white, and FIG. 6B shows changes in data voltages applied to data lines n, n+1, n+2, and n+3, and changes in the sustained voltage Vc1n of the cell in the first row in the column n. A data voltage written to the cell in the first row in the column n is V0.

In FIG. 6B, data voltages applied to the data line n increase from V0step by step, and the absolute values of data voltages applied to the data lines n+1 and n+2 are unchanged. Data voltages applied to the data line n+3 are opposite to those applied to the data line n. The sustained voltage Vc1n is V0 when the first row is scanned. Since the data voltages applied to the data line n+1 are unchanged, the second term of the expression 1 is zero. The data voltages applied to the data line n change, and therefore, the coefficient of the first term of the expression 1 is $\alpha 1$ and the sustained voltage Vc1n is changed by the data voltages applied to the column n multiplied by $\alpha 1$ as shown in FIG. 6B. At this time, a cell in the first row in the column n+1 receives a data voltage of −V0 having the same strength but the opposite polarity to the voltage V0 stored in the cell in the first row in the column n. Since the same data voltages are applied to the data lines n+1 and n+2, a sustained voltage Vc1(n+1) of the cell in the first row in the column n+1 is unchanged from the written voltage of −V0. Although the data voltages of the same absolute value have been written, the sustained voltage Vc1n changes and the sustained voltage Vc1(n+1) does not change. Namely, the sustained voltage Vc1n of the cell in the first row in the column n changes due to the changing data voltages written to the consecutive cells in the same column, to cause vertical cross-talk.

In FIG. 6A, the same data voltage of V0 is written to the cells in the columns n+1 and n+2. The sustained voltage of each cell in the column n+1 is unchanged because there is no change in the data voltages applied to the data lines n+1 and n+2. On the other hand, the sustained voltage of each cell in the column n+2 changes because the data voltages applied to the data line n+3 change. For each cell in the column n+2, the first term of the expression 1 is zero, and the coefficient of the second term thereof is $\alpha 2$. Since the data voltages applied to the data line n+3 change, the sustained voltage Vc1(n+3 ) fluctuates by the data voltages multiplied by $\alpha 2$, to cause horizontal cross-talk.

As indicated with the expression 1, the size of cross-talk on a cell is dependent on the ratio of parasitic capacitance produced between the cell and adjacent data lines to the total capacitance of the cell. The cross-talk will decrease if the parasitic capacitance is reduced. To increase the capacitance of each cell to reduce cross-talk, the prior art provides each cell with a dedicated accumulation capacitor electrode. The accumulation capacitor electrode, however, needs space and reduces the aperture of the cell and deteriorates the brightness thereof. Then, strong illumination is needed which increases the power consumption.

Portable equipment must have an LCD of low power consumption and high brightness. An effective solution for this is to improve the aperture ratio of each cell of the LCD. The active-matrix LCD of FIG. 2 employs a light shield film. An area surrounded by the boundary 38 of the light shield film is a display aperture. The cell electrode 17 is formed on one of the substrates, and the light shield film on the other substrate. Accordingly, the two substrates must be correctly positioned to align the cell electrode and light shield film with each other. According to the present photolithography technique, a positioning margin "a" shown in FIG. 2 must be 3 to 5 $\mu$m. A positioning margin "b" necessary for aligning the substrates to each other must be 7 $\mu$m. A high-density LCD involves fine cell pitches to increase the ratio of the margins to the cell pitches, to reduce the aperture ratio of each cell.

Figure 7A:
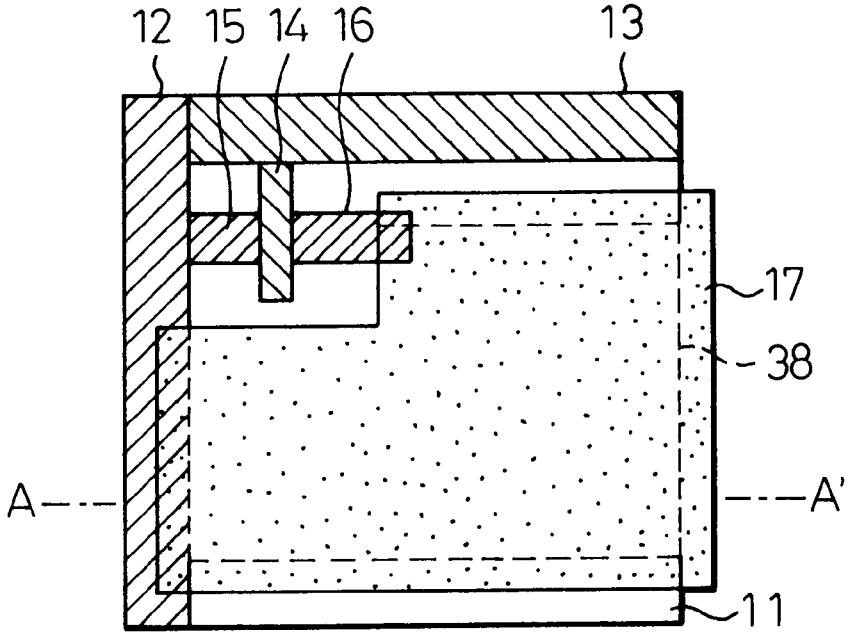
FIG. 7A is a top view showing a cell of a large-aperture LCD according to prior art.
Figure 7B:
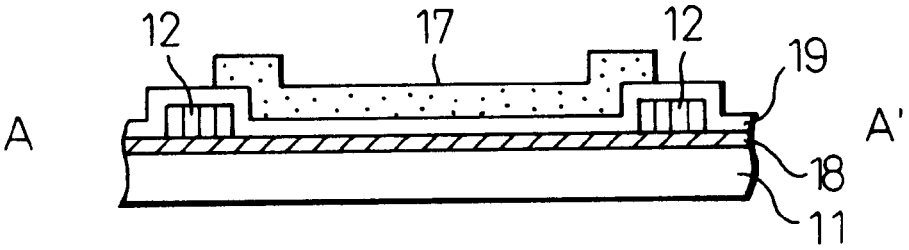
FIG. 7B is a sectional view taken along a line A–A'of FIG. 7A.

To solve this problem, a large-aperture LCD of FIGS. 7A and 7B has been proposed in prior art. FIG. 7A is a top view and FIG. 7B is a sectional view taken along a line A–A' of FIG. 7A.

A cell electrode 17 overlaps a data line 12, which is used as a light shield film. A light shield film formed on an opposite substrate defines only the vertical width thereof. This arrangement greatly improves the aperture ratio of each cell and realizes high brightness.

This structure, however, produces large parasitic capacitance between each cell and adjacent data lines because the cell electrode 17 overlaps the adjacent data lines 12, to thereby worsen cross-talk.

In order to solve these problems, the present invention provides an active-matrix LCD that causes no cross-talk even if there is a large parasitic capacitance between each cell electrode and adjacent data lines. In particular, the present invention provides a large-aperture LCD that causes no cross-talk and provides high display quality and high brightness.

Figure 8:
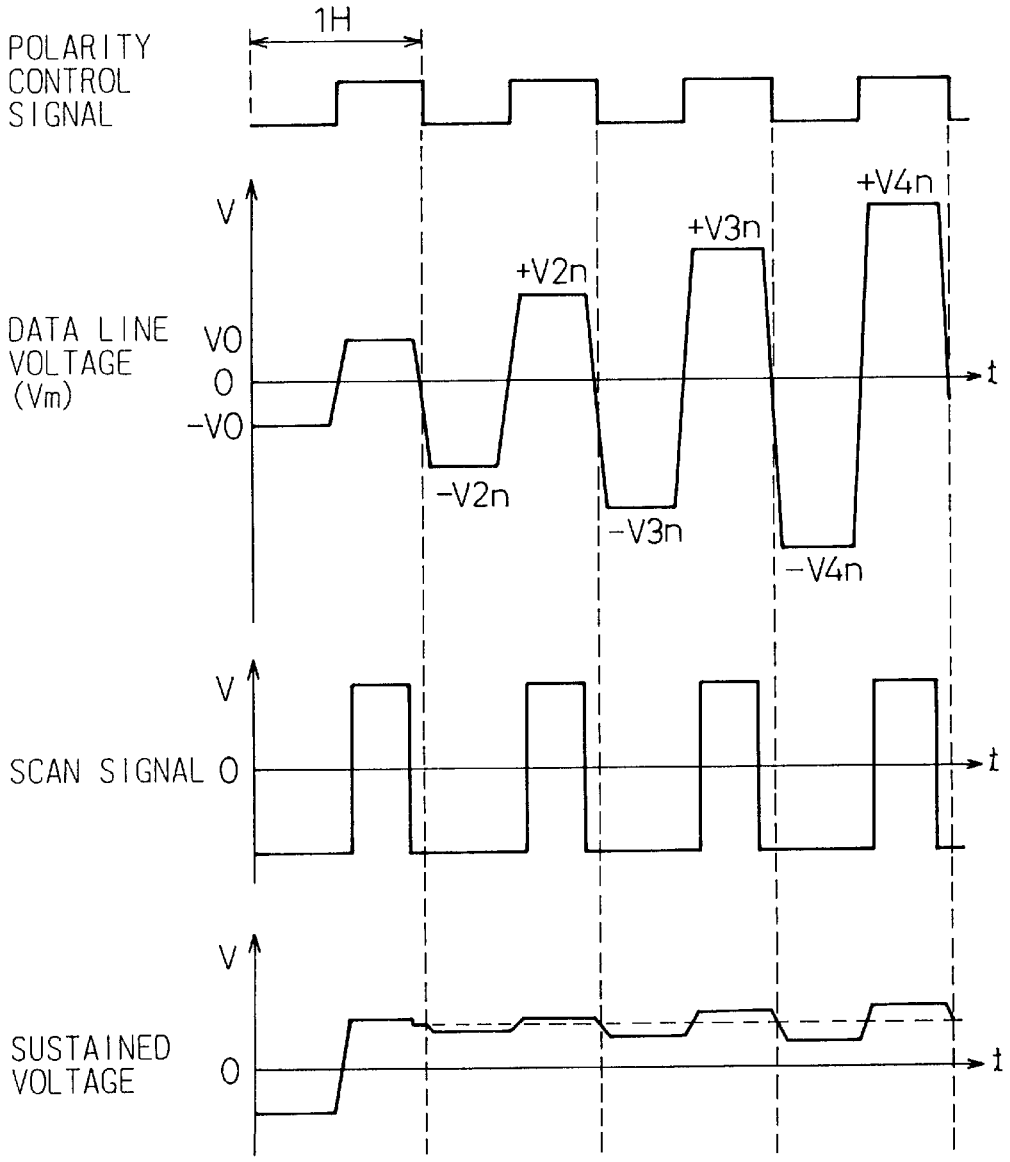
FIG. 8 explains the first aspect of the present invention.

FIG. 8 explains the principle of an LCD according to the first aspect of the present invention.

A data driver of the LCD applies positive and negative signals to each data line within the period of a scan pulse, i.e., a horizontal scan period (1H) in response to a polarity control signal. Namely, the data driver applies a data voltage to be written and a voltage having the same strength as, but an opposite polarity to, the data voltage to each data line within a horizontal scan period. Here, the common potential of a counter electrode is fixed at 0 V. The common potential may be alternated. In this case, positive and negative voltages of the same strength are applied to the counter electrode. For the sake of simplicity, the present invention fixes the common potential at 0 V and applies positive and negative voltages to each data line within a horizontal scan period. In FIG. 8, a positive voltage applied to a given data line is a write voltage and, in synchronization with the write voltage, a scan pulse is provided. The write voltage is maintained as a sustained voltage as shown in the same figure. The sustained voltage changes in response to data voltages, applied to the data line in question, every horizontal scan period. Since a voltage having the same strength as, but an opposite polarity to, the data voltage is applied to the data line in each horizontal scan period, the sustained voltage fluctuates around the voltage written first. Inverting data voltages applied to a given data line every horizontal scan period zeroes an effective voltage applied to the data line. As a result, the sustained voltage of any cell connected to the data line will be unaffected by the voltages applied to the data line, or by voltages applied to an adjacent data line that is capacitively connected to the cell.

It is not always necessary to equalize the period of the positive voltage to that of the negative voltage. An effective voltage on a given data line will be zeroed if the product of the strength and period of the positive voltage is equal to that of the negative voltage. For example, the period of the voltage of opposite polarity may be short if the voltage is high. The polarities of voltages applied to each data line may be alternated several times within a horizontal scan period.

In FIG. 8, a voltage of opposite polarity is applied to the data line in the first half of a horizontal scan period, and the data voltage is applied thereto in the second half of the scan period. Accordingly, the data voltage at the end of the scan pulse is written to and sustained by the cell. It is possible to apply the data voltage to the data line in the first half of the scan period, and the voltage of inverted polarity in the second half thereof. In this case, the scan pulse is provided in the first half of the scan period.

Zeroing an effective voltage applied to each data line eliminates a fluctuation in the sustained voltage of each cell due to voltages successively applied to adjacent data lines that are capacitively connected to the cell. This, however, does not solve the problem of a fluctuation in the sustained voltage of each cell caused when the scan pulse ends, or the problem of the difference between a data voltage and a sustained voltage caused when the data voltage ends.

Figure 9A:
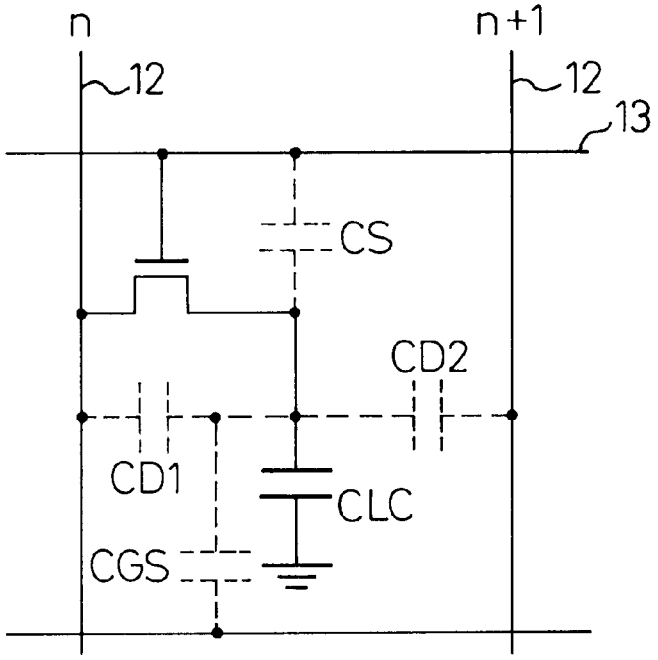
FIGS. 9A and 9B explain a correction according to the present invention.
Figure 9B:
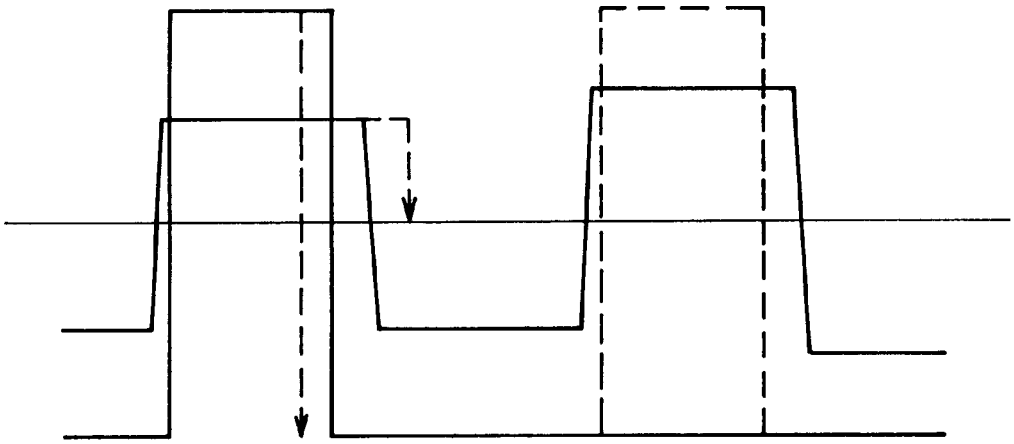

FIGS. 9A and 9B explain the principle of a correction according to the first aspect of the present invention, in which FIG. 9A shows parasitic capacitors formed between a cell and adjacent data and scan lines, and FIG. 9B explains the correction. This correction considers only the parasitic capacitors formed between a given cell and adjacent data and scan lines. There are other parasitic capacitors formed between the cell and other data and scan lines, and they also must be considered if they are not ignorable. For the sake of simplicity, this embodiment considers only the parasitic capacitors formed between a given cell and adjacent data and scan lines.

The expression 1 mentioned above calculates the difference between an applied voltage and a sustained voltage. A fluctuation in the sustained voltage due to the termination of a scan pulse is constant because the maximum and minimum voltages of the scan pulse are unchanged. Accordingly, the fluctuation due to the scan pulse can be canceled by adjusting the potential of a counter electrode, and therefore, such a fluctuation is ignored in the following explanation. A fluctuation in the sustained voltage of a given cell due to changing data voltages applied to adjacent data lines that are capacitively connected to the cell is represented with the first and second terms of the expression 1. According to the first aspect of the present invention, an effective voltage applied to each data line is 0 V, and therefore, V2n and V2(n+1) in the expression 1 are each 0 V. Accordingly, a data voltage applied to each data line changes to 0 V as shown in FIG. 9B, and a fluctuation due to this change must be considered. In this case, the expression 1 is written as follows:

$$\Delta Vn = CD1 \times (-Vn)/CT + CD2V'(n+1)/CT \quad (2)$$
$$= \alpha 1 Vn + \alpha 2 V'(n+1)$$

where ΔVs is constant and the applied voltages Vn and V(n+1) are known when they are applied to corresponding data lines. Accordingly, the fluctuation is calculated according to these values, and the data voltages are corrected for the fluctuation before they are applied to the data lines. As a result, each cell may sustain a required data voltage.

When each cell in a column n is capacitively connected to a data line n−1 and when each cell in the first column is capacitively connected to the first data line, a correction of a data voltage applied to the data line n−1 may affect a voltage applied to a data line n.

Since each cell in the first column is capacitively connected only to the first data line, a correction on a data voltage to the first data line is calculated at first, and a correction on a data voltage to the second data line or to any of the following data lines is calculated according to a correction on a data voltage to the preceding data line. Such a correction is repeated until corrected voltages applied to all data lines in a horizontal scan period are obtained. If each cell in the column n is capacitively connected to a data line n+1, correction voltages are successively calculated in reverse order.

The coefficient of each term of the expression 2 is known in advance according to the characteristics of each cell of the LCD. When a voltage applied to a data line is corrected by ΔVn calculated according to the expression 2, the first term of the same will change accordingly. To precisely calculate the correction value, the calculation of the expression 2 must be repeated until it converges.

This, however, takes a long time. To solve this problem, the fluctuation ΔVn may directly be calculated as follows when each cell in a column n is capacitively connected to a data line n−1:

$$\Delta Vn = \alpha 1(Vn + \Delta Vn) + \alpha 2V'(n-1)$$
$$(1-\alpha 1)\Delta Vn = \alpha 1 Vn + \alpha 2 V'(n-1)$$
$$\Delta Vn = \alpha 1 \times Vn/(1-\alpha 1) + \alpha 2 \times V'(n-1)/(1-\alpha 1) \quad (3)$$

Then, a corrected voltage is calculated as follows:

$$Vn' = Vn + \Delta Vn \quad (4)$$
$$= Vn/(1-\alpha 1) + \alpha 2 \times V'(n-1)/(1-\alpha 1)$$
$$= \alpha Vn + \beta V'(n-1)$$

Figure 10:
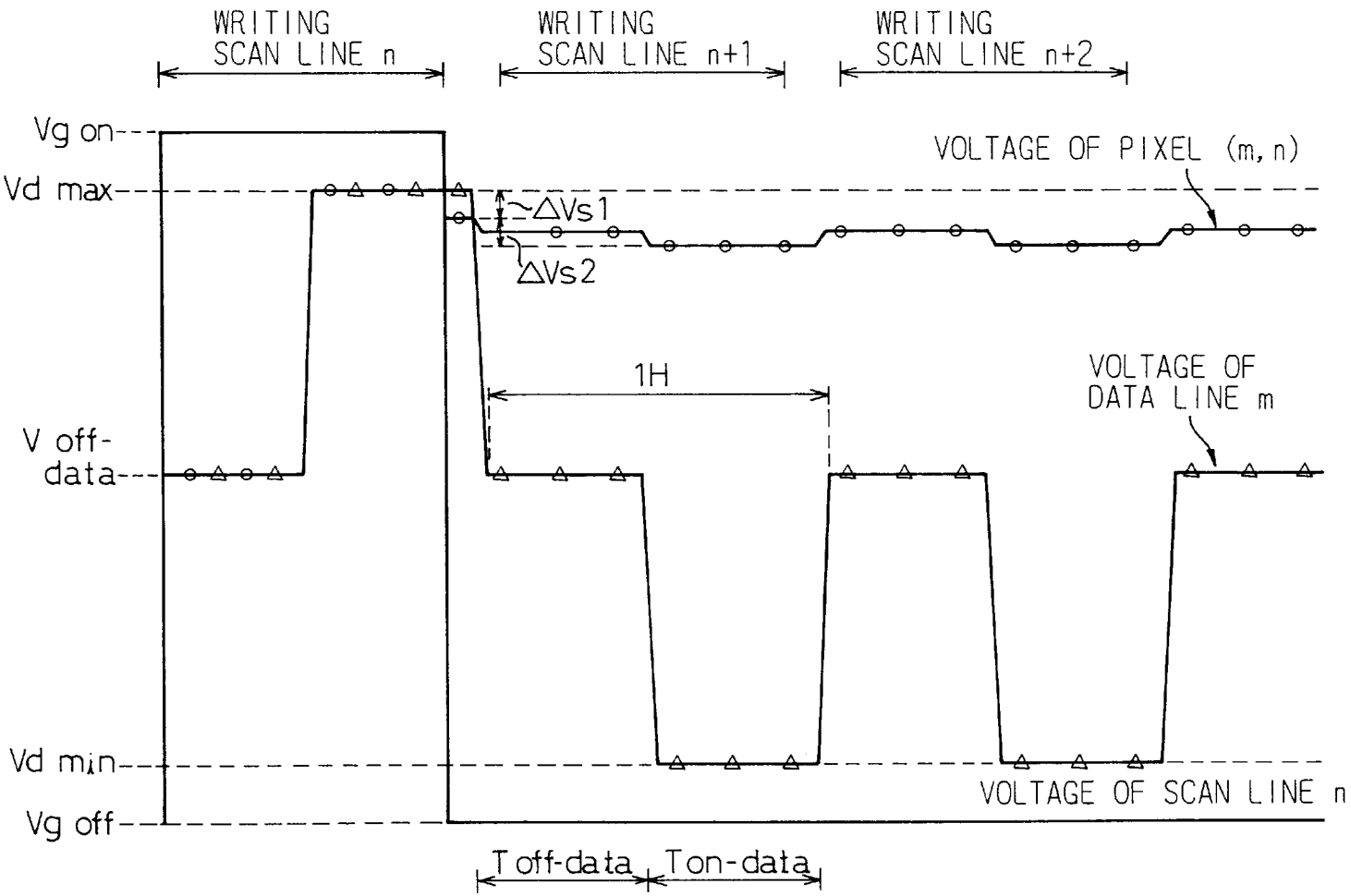
FIG. 10 explains the second aspect of the present invention.
Figure 11:
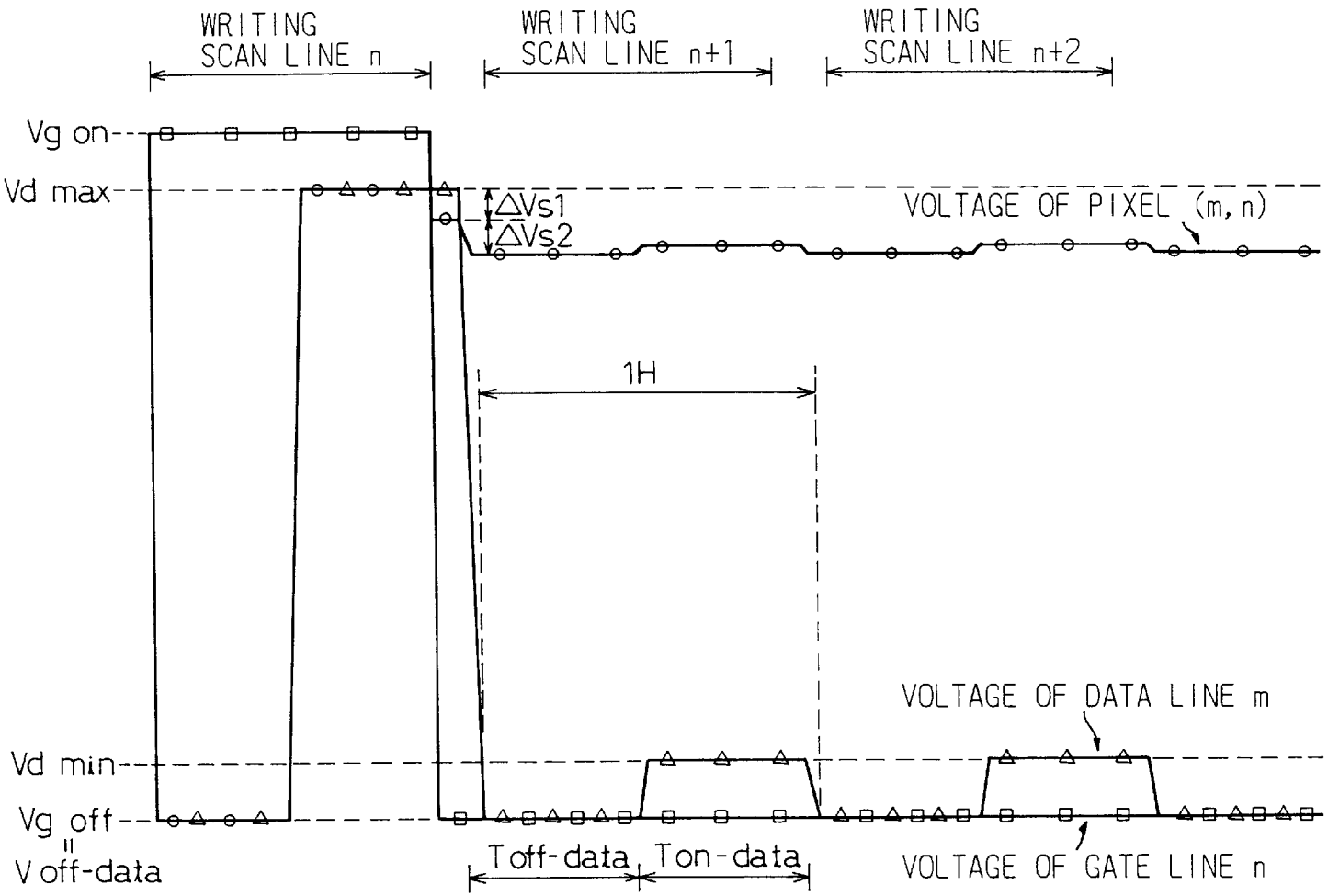
FIG. 11 explains the second aspect of the present invention.

FIGS. 10 and 11 show the operations of an LCD according to the second aspect of the present invention.

A period Ton-data for applying a data voltage to a data line is shorter than a horizontal scan period (1H). Each horizontal scan period includes a Toff-data period in which a fixed voltage is applied to each data line. A scan pulse applied to each scan line ends in the period Ton-data. The fixed voltage applied to each data line during the Toff-data may be an average of the maximum and minimum voltages applied to the data line as shown in FIG. 10, or about an off potential of the scan pulse as shown in FIG. 11.

The period Toff-data in which the fixed voltage is applied to each data line reduces fluctuation in a temporal average of voltages applied to each data line, to make a correction on a data voltage to the data line easier. As the period Toff-data increases, a temporal average of voltages applied to each data line approaches the voltage applied thereto in the period Toff-data. This suppresses a fluctuation in the sustained voltage of each cell connected to a given data line due to a variety of data voltages applied to the data line.

Figure 12A:
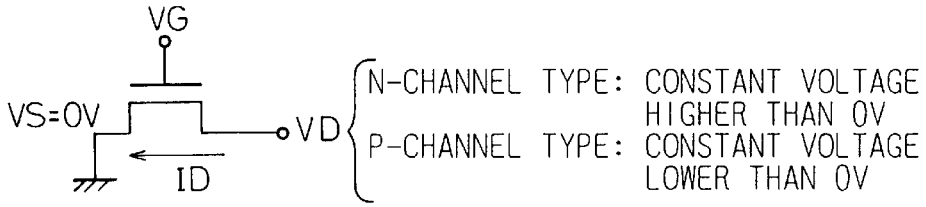
FIG. 12A shows conditions to measure the voltage-current characteristics of a TFT.
Figure 12B:
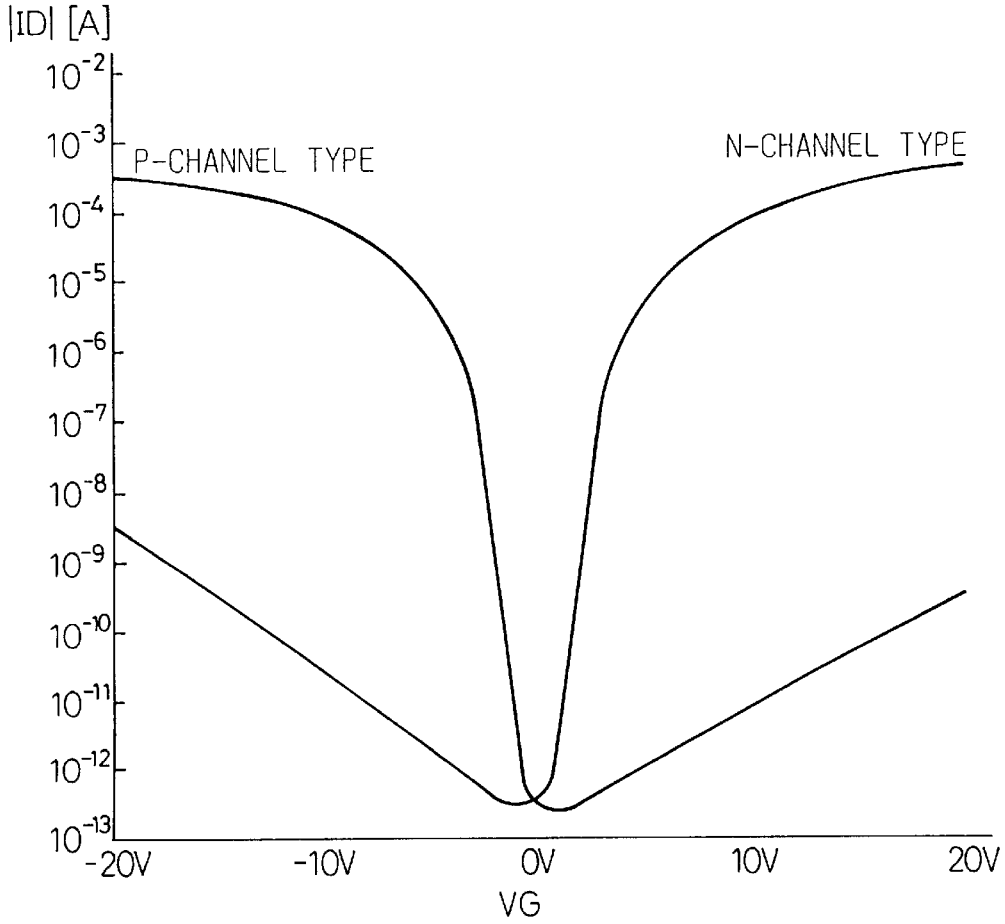
FIG. 12B shows the voltage-current characteristics of the TFT.

FIG. 12A shows the conditions of a gate voltage VG applied to the TFT of a cell of the LCD and a current ID passing through the TFT, and FIG. 12B shows the VG-ID characteristics of the TFT.

When the TFT is of an n-channel type, the source voltage is 0 V, the drain voltage is constant and higher than 0 V, and the gate voltage VG is changed to measure the VG-ID characteristics. When the TFT is of a p-channel type, the source voltage is 0 V, the drain voltage is constant and higher than 0 V, and the gate voltage VG is changed to measure the VG-ID characteristics. In any case, the current flowing between the drain and the source has a minimum, which is about 0 V in FIG. 12B. In the case of the n-channel TFT, the voltage of a scan pulse is sufficiently lower than a cell voltage when the TFT is turned off as shown in FIG. 3B. In this case, the gate voltage to the TFT is very low to pass a large current whichever voltage to the data line or a cell voltage serves as a source voltage, to thereby fluctuate a voltage sustained by the cell that incorporates the TFT.

When the fixed voltage applied to a data line during the period Toff-data is close to the off potential of the scan pulse as shown in FIG. 11, a current passing through the TFT during the period Toff-data is very low. This suppresses a fluctuation in the voltage sustained by the cell and improves the display accuracy of the cell.

Figure 13:
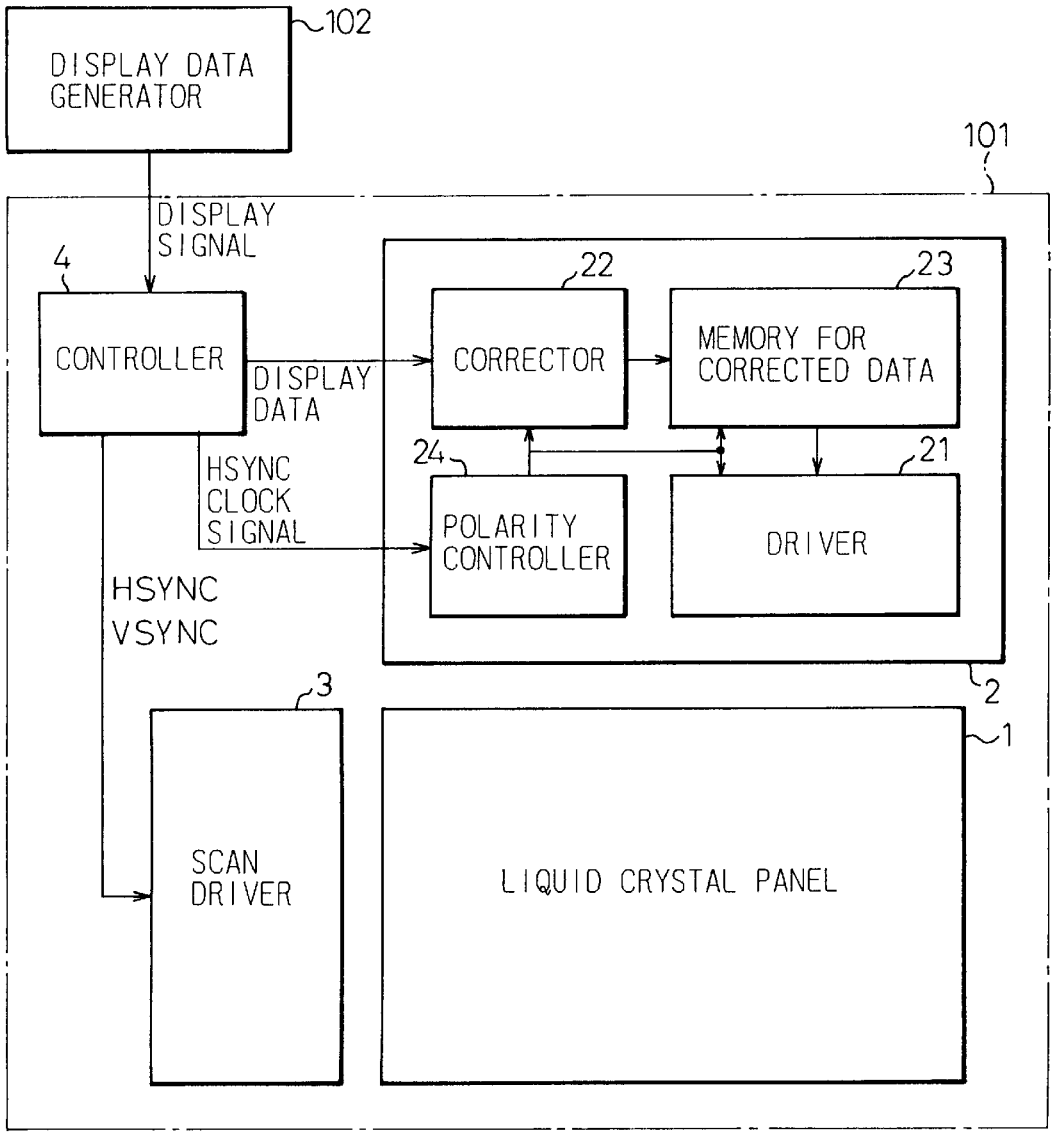
FIG. 13 shows an LCD according to the first embodiment of the present invention.

FIG. 13 shows an active-matrix LCD according to the first embodiment of the present invention.

The LCD 101 is connected to a display data generator 102, which may be a personal computer or a television receiver. The LCD has a liquid crystal panel 1, a data driver 2 for applying a data signal to each data line of the panel 2, a scan driver 3 for applying a scan pulse successively to scan lines of the panel 1, and a controller 4 for receiving a display signal from the data generator 102, extracting display data out of the received signal, and generating a vertical synchronous signal VSYNC, a horizontal synchronous signal HSYNC, and a clock signal. The data driver 2 has a driver 21, a correction value calculator 22 for calculating a correction value according to display data provided by the controller 4, a memory 23 for storing a row of corrected data calculated by the calculator 22, and a polarity controller 24 for controlling the polarity of a data signal to be written to each liquid crystal cell of the panel 1 and inverting the same within a horizontal scan period according to the signal HSYNC and clock signal provided by the controller 4.

Figure 14:
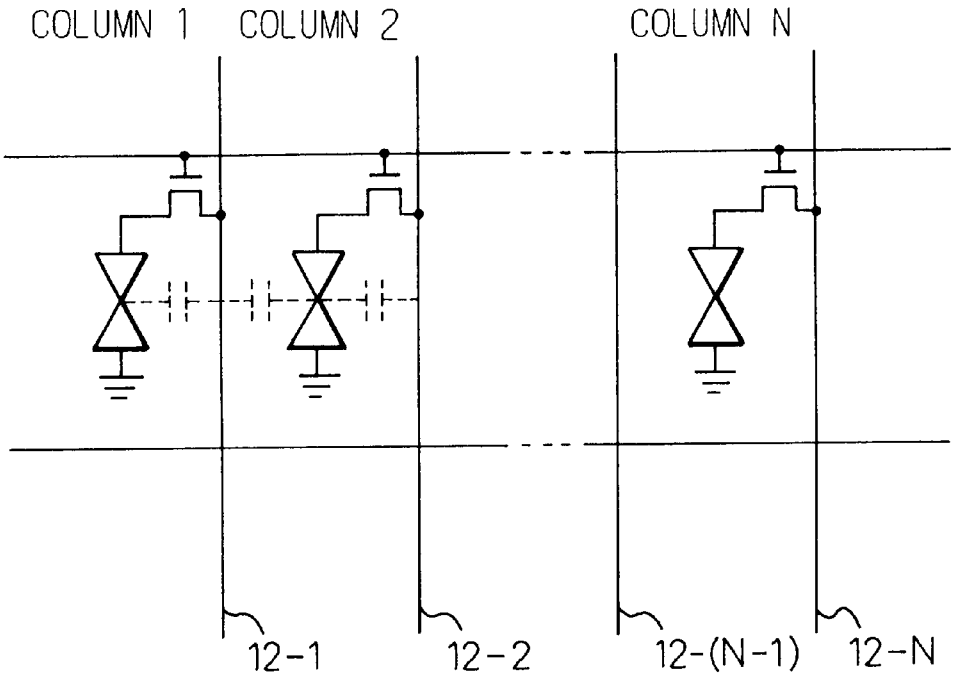
FIG. 14 shows the cells of the LCD of the first embodiment.

FIG. 14 shows liquid crystal cells of the panel 1 of the LCD of the first embodiment. The panel 1 has N data lines 12 connected to N columns of the cells. The cells in the first column are arranged on the left side of the first data line. Parasitic capacitance between each cell in the first column and the first data line is large, and that between the cell and the other data lines is ignorable. Each cell in a column n ($2<=n<=N$) has large parasitic capacitance between the cell and the data lines n−1 and n, and ignorable parasitic capacitance between the cell and the other lines. Accordingly, the present invention corrects a fluctuation in a sustained voltage of a given cell with respect to voltages applied to the adjacent data lines of the cell.

Figure 15:
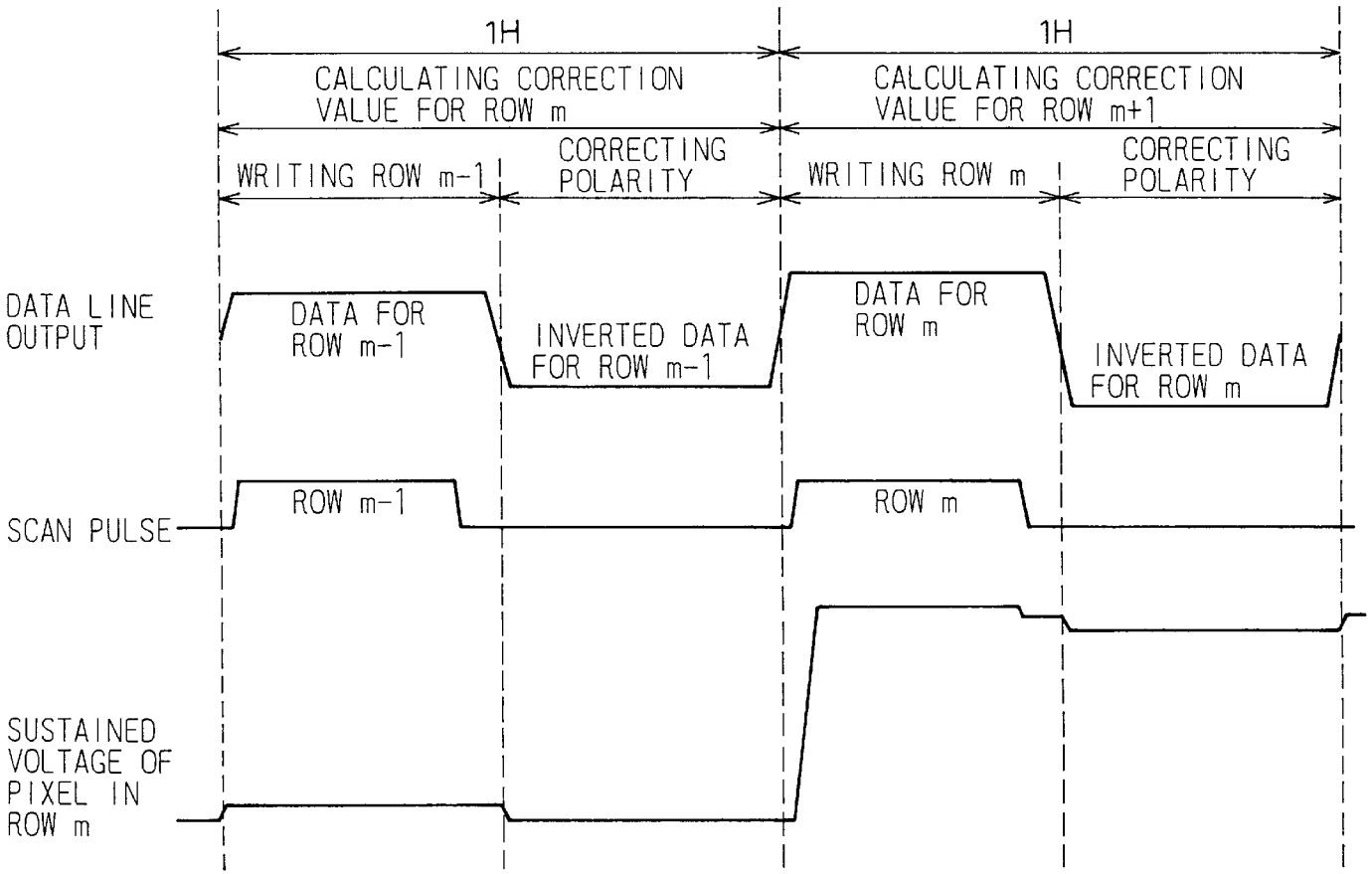
FIG. 15 shows the operation of the LCD of the first embodiment.

FIG. 15 is a time chart showing the operation of the LCD of the first embodiment. Each horizontal scan period (1H) is divided into first and second halves. The data driver 2 provides each data line with a data voltage to be written in the first half of the period, and an inverted data voltage in the second half thereof. The scan driver 3 provides a scan pulse in the first half of the period. The data voltage supplied by the data driver 2 to a given data line is a corrected one as explained with reference to FIG. 9B. The correction value calculator 22 calculates correction values of data voltages to be written to cells in the next row and provides the memory 23 with corrected data voltages. The memory 23 successively stores the corrected data voltages for the next row. Once the corrected data voltages for the next row are stored in the memory 23, they are transferred to an internal latch circuit, and when the next horizontal scan period starts, they are supplied to the driver 21. In the second half of the scan period, the corrected data voltages for the row stored in the latch circuit are inverted and supplied to the driver 21. In parallel with this operation, the memory 23 successively stores corrected data voltages for the next row provided by the correction value calculator 22. The pair voltages provided by the data driver 2 in the first and second halves of a horizontal scan period have the same strength and opposite polarities, and therefore, an effective voltage applied to each data line in the scan period is zero as explained with reference to FIG. 8.

FIG. 15 also shows changes in a voltage sustained by a cell in a row m. A voltage sustained by a given cell must be inverted frame by frame according to the signal VSYNC. Accordingly, the cell in the row m receives a write data voltage whose polarity is opposite to that of the preceding sustained voltage. The sustained voltage fluctuates according to a voltage applied to the adjacent data line. Since an effective voltage applied to any data line is zero, there will be no fluctuation in any sustained voltage in each frame.

The correction value calculator 22 of the first embodiment will be explained in detail.

The difference between a data voltage written to a cell through a corresponding data line and a voltage sustained by the cell is calculated according to the expression 2. If the data voltage is corrected for the calculated difference, it will cause another difference. Accordingly, the correction must be repeated until it converges.

FIG. 16 explains a method of calculating a correction value according to the first embodiment.

A voltage V(n−1) is applied to a data line n−1, and a voltage Vn is applied to a data line n. The difference between the data voltage and a sustained voltage of a cell in a column n to which the data line n is connected is calculated according to the expression 2. When the voltage Vn is applied to the data line n, the cell may have the difference $\Delta Vn$ ($=\alpha 1Vn+\alpha 2V(n+1)$) according to the expression 2. A correction is made to let the cell sustain the voltage Vn. A correction value is calculated for the influence of the voltage Vn itself, and then, for the influence of the voltage V(n−1) on the voltage Vn. If the voltage V(n−1) has no influence on the voltage Vn, the applied voltage Vn causes a deviation of $-\alpha 1Vn$, and therefore, the sustained voltage will be $Vn-\alpha 1Vn$. To correct the deviation, the applied voltage may be corrected to $Vn+\alpha 1Vn$, which will cause a deviation of $-\alpha 1Vn-\alpha 1^2Vn$. If this correction is repeated m times, the difference between the sustained voltage and the voltage Vn will be $\alpha 1^{m+1}Vn$. Since $\alpha 1$ is smaller than 1, the difference becomes ignorable after the correction is repeated a suitable number of times. Once the difference becomes ignorable, the correction for the influence of the voltage Vn itself is terminated, and the influence of the voltage V(n−1) is corrected. To achieve this, $\alpha 2V(n-1)/(1-\alpha 1)$ is added to the value for correcting the influence of the voltage Vn itself. The operation for correcting the influence of the voltage Vn itself is repeated m times, and then the influence of the voltage V(n−1) is corrected. As a result, the difference between the required voltage Vn and the actual sustained voltage is $\alpha 1^{m+1}Vn$.

Figure 17:
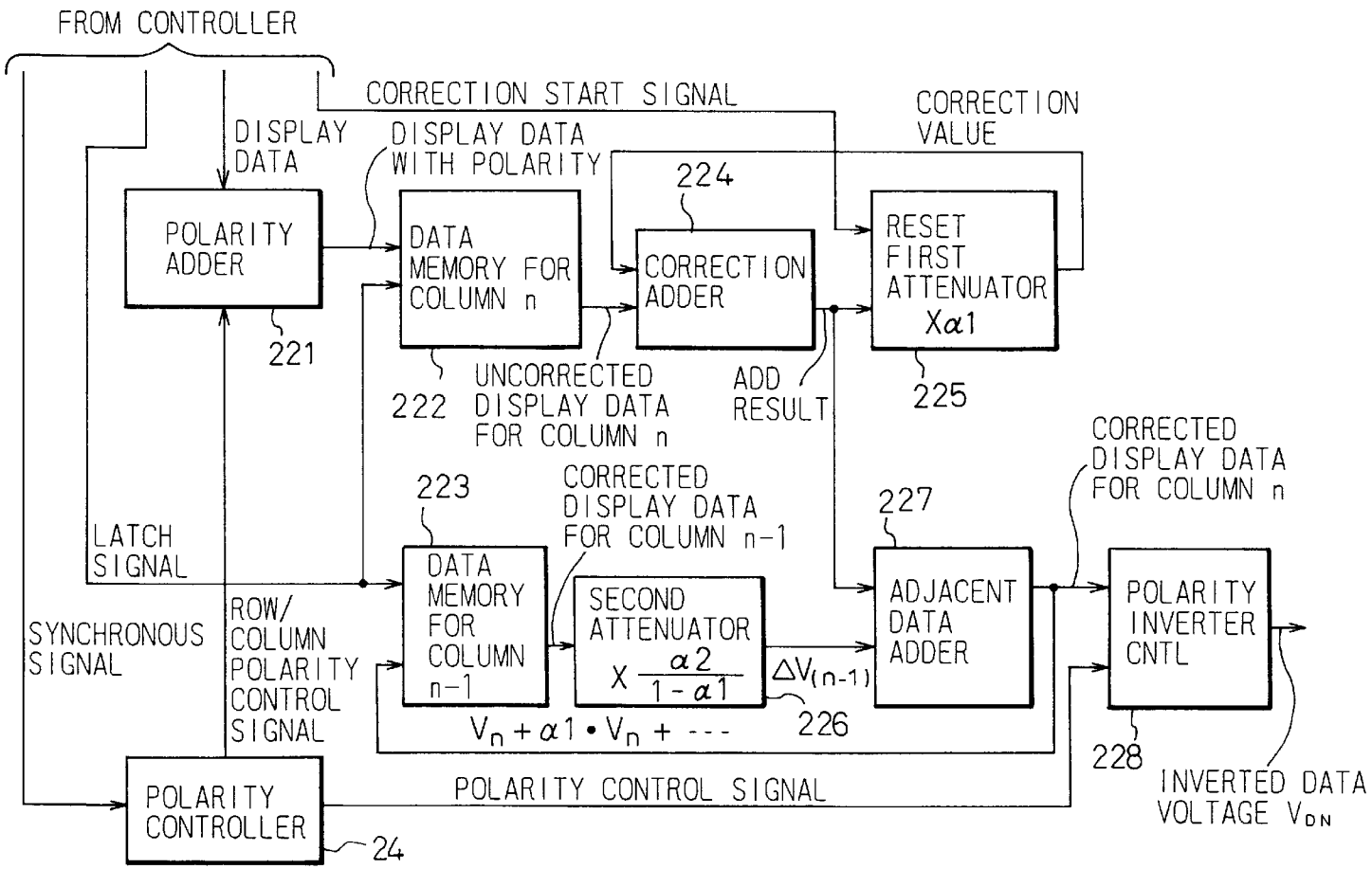
FIG. 17 shows a correction value calculator according to the first embodiment.

FIG. 17 is a block diagram showing the correction value calculator 22.

A polarity adder 221 receives display data from the controller 4 and adds a polarity to the display data according to a signal from the polarity controller 24. A memory 222 latches and stores, for the column n, the output of the polarity adder 221 according to a latch signal that is synchronous with the output timing of the display data from the controller 4. A memory 223 stores, for the column n−1, corrected data of the column n in response to the latch signal. A correction value adder 224 adds a correction value to the output of the memory 222, to provide a corrected voltage based on the correction of the influence of the voltage Vn itself. A first attenuator 225 multiplies the output of the correction value adder 224 by $\alpha 1$, to provide a correction value for the influence of the voltage Vn itself. A second attenuator 226 multiplies the output of the memory 223 by $\alpha 2/(1-\alpha 1)$ and provides a correction value for the voltage V(n−1). An adjacent display data adder 227 adds the output of the second attenuator 226 to the output of the correction value adder 224. A polarity inverter 228 inverts, when required, the polarity of the final corrected data in response to a polarity control signal.

A loop composed of the correction value adder 224 and first attenuator 225 calculates correction data for correcting the influence of the voltage Vn itself. As the number of repetitions of the loop increases, the error becomes smaller. The number of repetitions of the loop is determined in consideration of the operation time.

If a voltage applied to each data line is an analog signal, the correction value calculator of FIG. 17 is easily fabricated with the use of operational amplifiers, etc., and the repetitions of the loop are finished in a short time. Namely, accurate correction values are obtained with a simple circuit.

The memory 223 holds corrected data that is used as a data voltage V(n−1) applied to the data line n−1 in front of the data line n. Each cell in the first column is capacitively connected to only the first data line, and therefore, a corrected data voltage applied to the first data line is calculated after zeroing data stored in the memory 223. For correcting a data voltage applied to any one of the other data lines, the corrected data voltage stored in the memory 223 and that stored in the memory 222 are used.

FIG. 18 explains another method of calculating a correction value according to the first embodiment. This method collectively calculates a correction value instead of separately calculating the influence of Vn and that of V(n−1). The difference ΔVn due to the voltage Vn applied to the data line n is calculated according to the expression 2. After the correction of the difference ΔVn is repeated m times, it will be $\alpha 1^m \Delta V$. If the number m is proper, the resultant difference will be ignorable. The voltage applied to the data line n at this time is as shown in the figure.

Figure 19:
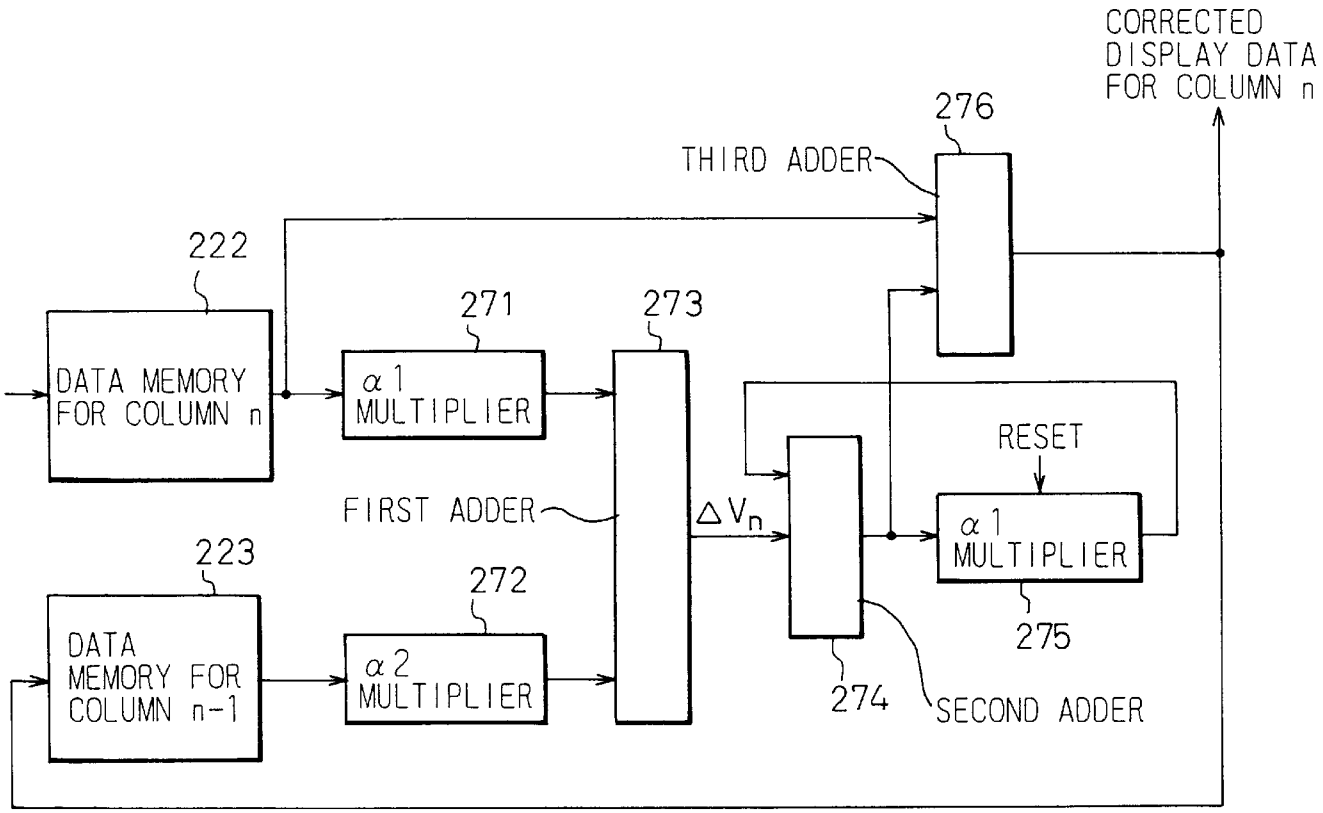
FIG. 19 shows a modification of the correction value calculator according to the first embodiment.

FIG. 19 shows a circuit for realizing the method of FIG. 18. A loop consisting of a second adder 274 and an α1 multiplier 275 is repeated to provide a corrected data voltage.

According to the first embodiment, a period for providing a data voltage and a period for providing an inverted voltage are equal to each other in a horizontal scan period, and the absolute value of the inverted voltage is equal to that of the data voltage, to provide an effective voltage of 0 V. It is possible to provide an effective voltage of 0 V in a different way. This will be explained with reference to the second embodiment of the present invention.

Figure 20:
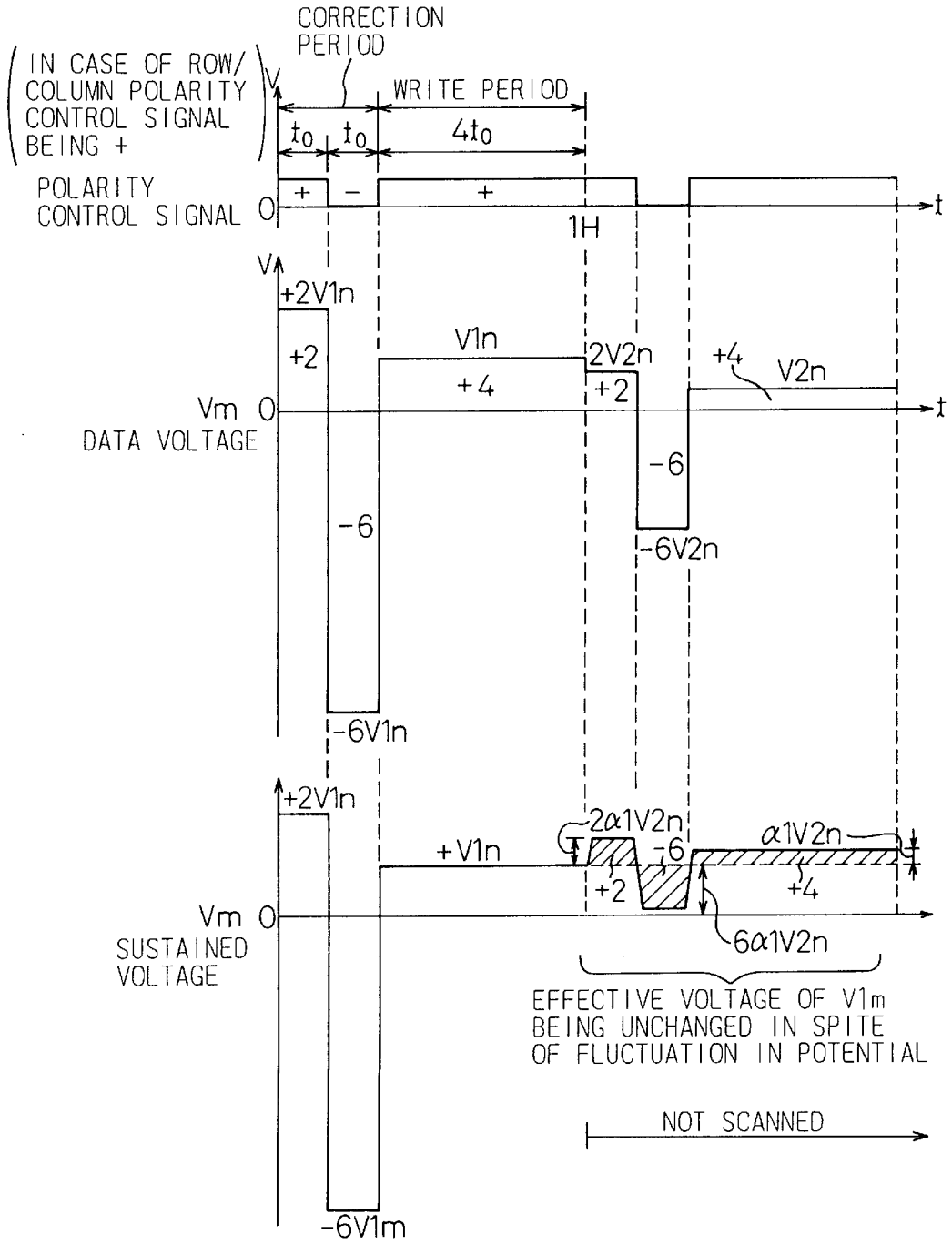
FIG. 20 shows the data voltage waveform according to a second embodiment of the present invention.

FIG. 20 shows the waveform of a data voltage applied to a data line of an LCD according to the second embodiment of the present invention. The LCD of the second embodiment has the same structure as that of the first embodiment. Only the waveform of a data voltage of the second embodiment differs from that of the first embodiment.

In FIG. 20, a write period 4t0 is two times as long as a correction period 2t0. The correction period is divided into positive and negative periods. A data voltage of V1n is applied to the data line in the write period 4t0, a voltage of 2V1n to the same data line in the positive correction period, and a voltage of −6V1n to the same in the negative correction period. As a result, an effective voltage applied to the data line in a horizontal scan period is 0 V. In this way, the second embodiment properly sets voltages and their application periods in the correction period, to zero an effective voltage applied to any data line within a horizontal scan period. The data voltage V1n applied in the write period is a corrected one.

The second embodiment correctly sustains a voltage written to a cell for a non-scan period without display disturbance due to data voltages applied to the other cells. Since the second embodiment extends the write period, it relaxes requirements for the write performance of TFTs. Accordingly, the second embodiment is applicable to an LCD of low performance, to prevent cross-talk.

The second embodiment has, in the correction period, an interval for applying a voltage whose polarity is the same as that of a data voltage. Such an interval is not always necessary. Instead of the interval, a voltage of −4V1n may be applied within the correction period.

Figure 21:
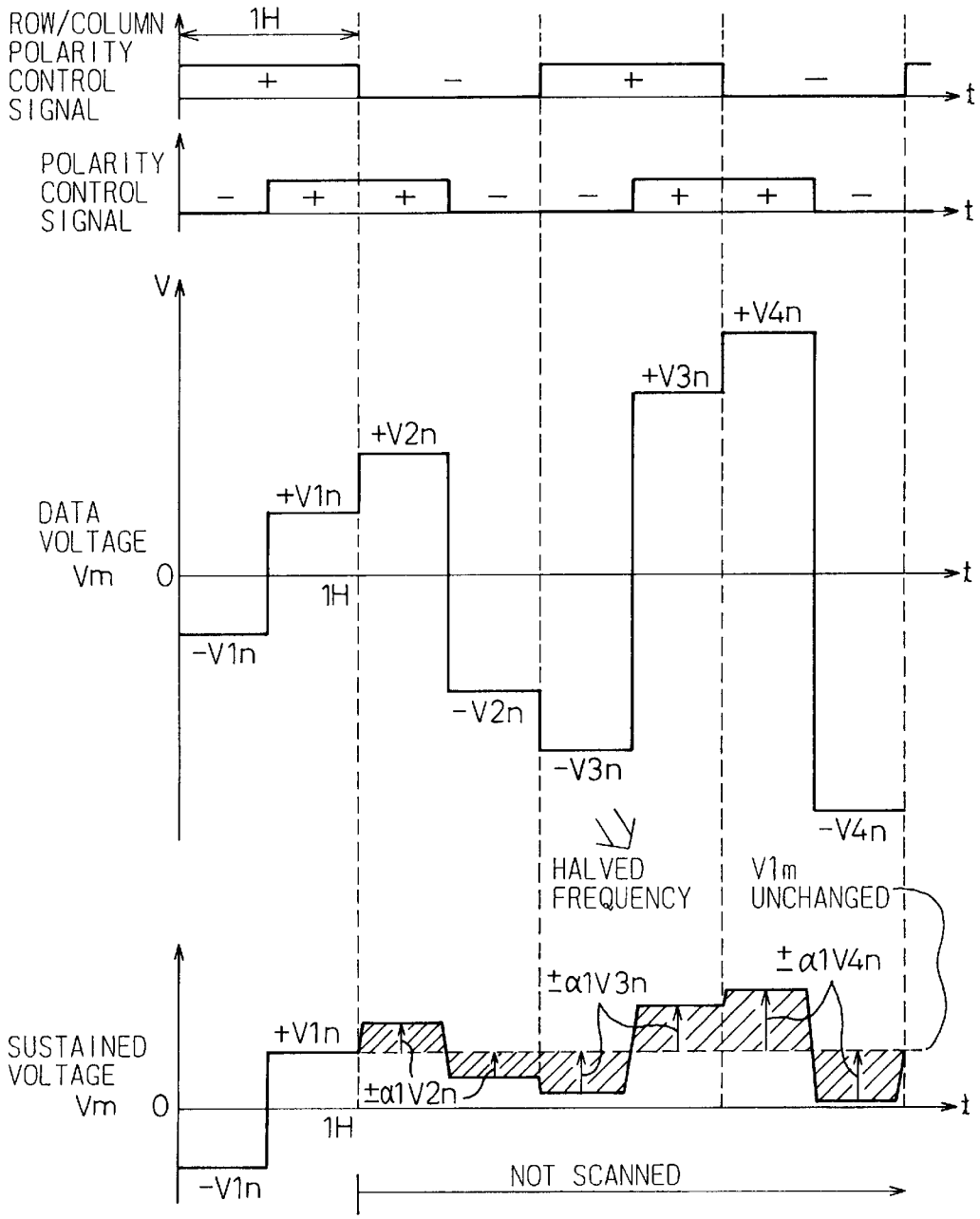
FIG. 21 shows the data voltage waveform according to a third embodiment of the present invention.

FIG. 21 shows the waveform of a data voltage applied to a data line of an LCD according to the third embodiment of the present invention. The structure of the third embodiment is the same as that of the first or second embodiment. Only the waveform of a data voltage of the third embodiment differs from those of the first and second embodiments.

The third embodiment alternates the polarity of each data voltage to be written, row by row, by alternating a row/column polarity control signal that indicates the polarity of every data voltage to be written within each horizontal scan period. A polarity control signal that indicates the polarity of each voltage applied to data lines is also alternated every scan period. The polarity control signal is shifted by a half of the scan period from the row/column polarity control signal. In this embodiment, the first half of each horizontal scan period is a correction period for applying an inverted data voltage, and the second half thereof is a write period for applying a data voltage to be written to a cell. A scan pulse (not shown) is applied in the second half of the period. The absolute values of example data voltages shown in FIG. 21 gradually increase. When a horizontal scan period ends and the next scan period starts, the voltages applied to the data line change from one to another. At this time, the polarity of the voltages is unchanged, and therefore, the period of change in the voltages applied to the data line is substantially equal to two scan periods. Compared with the voltage waveforms of FIGS. 8 and 15 that change every scan period, the frequency of change in voltages applied to a data line of the third embodiment is halved to relax the requirements for the operating performance of the data driver 2 and TFTs. Accordingly, the third embodiment is applicable to an LCD of low performance and low power consumption. Similar to the first embodiment, the third embodiment correctly sustains data in cells, respectively, and prevents cross-talk.

An LCD according to the fourth embodiment of the present invention will be explained. This LCD has the same structure as that of the first embodiment except the correction value calculator 22.

Figure 22:
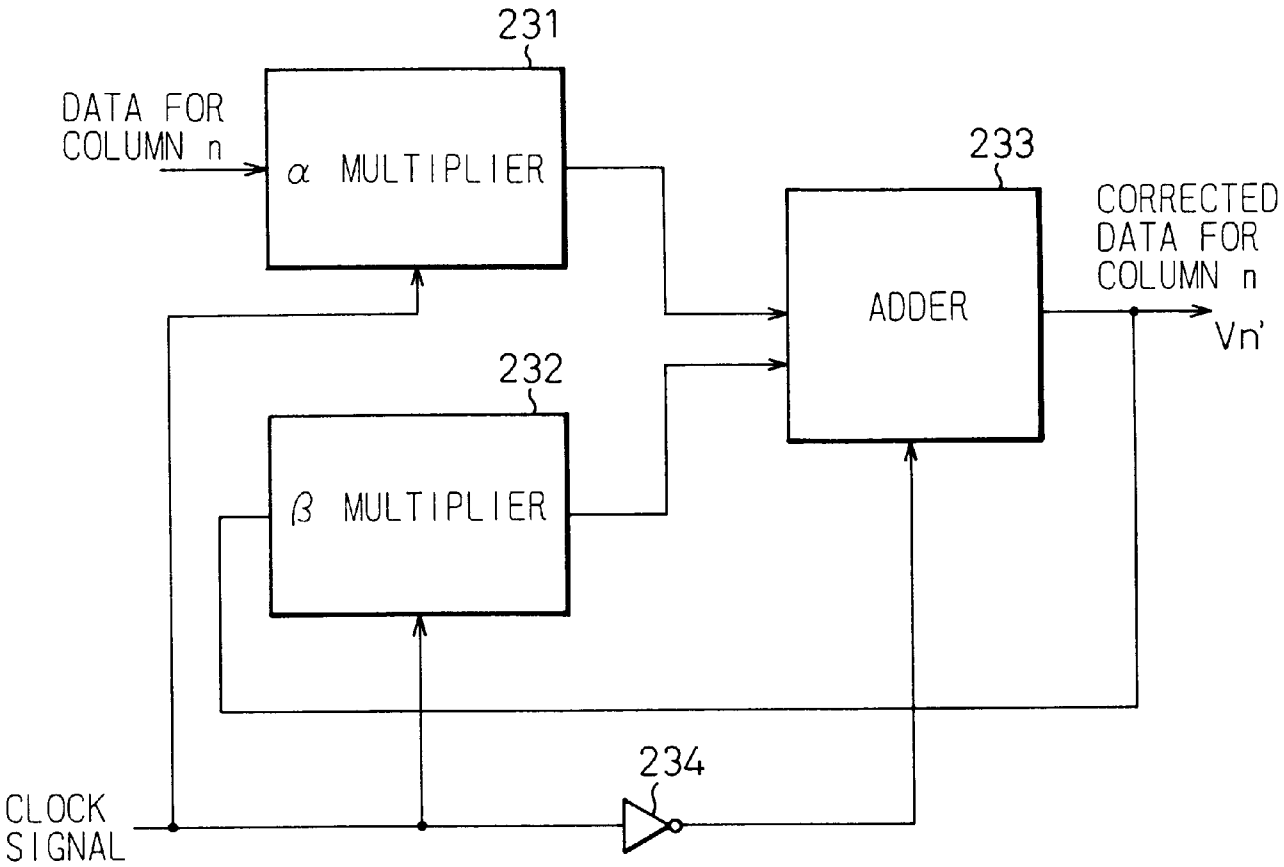
FIG. 22 shows a correction value calculator according to the fourth embodiment of the present invention.

FIG. 22 shows the correction value calculator of the LCD of the fourth embodiment.

This correction value calculator employs the expression 4 to directly calculate corrected data voltages without repetitive calculations. An a multiplier 231 multiplies a data voltage Vn provided by the controller 4 by α. A β multiplier 232 multiplies a corrected data voltage by β. An adder 233 adds the output of the α multiplier to the output of the β multiplier 232. An inverter 234 inverts a clock signal.

Figure 23:
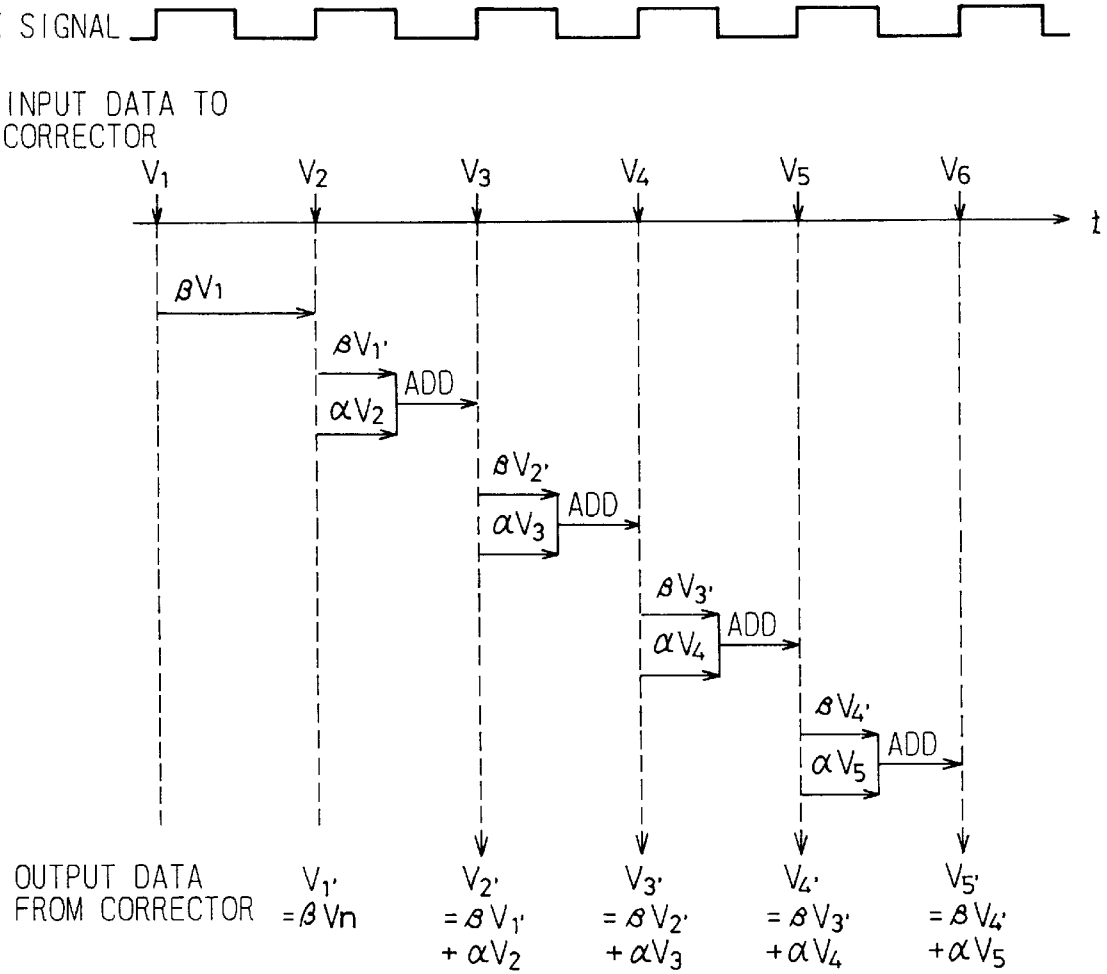
FIG. 23 shows the operation of the calculator of the fourth embodiment.

FIG. 23 shows the operation of the correction value calculator of the fourth embodiment. The clock signal is synchronous with a speed of transferring display data from the controller 4 to the data driver 2. Namely, the data voltage Vn is sent to the data driver 2 at a rise of the clock signal. The output of the adder 233 is reset to zero at first. When a data voltage V1 for the first column is provided, the a multiplier 231 provides an output of αV1, and the β multiplier 232 provides an output of zero. In response to a fall of the clock signal, the adder 233 adds input voltages thereto to each other and provides an output of αV1, which is a corrected data voltage V1' for the first column. This corrected data voltage is fed back to the β multiplier 232. Then, the α multiplier 231 provides αV2 and the β multiplier 232 provides βV1' in response to the next rise of the clock signal. In response to a fall of the clock signal, the adder 233 adds the data input thereto to together and provides αV2+βV1' as a corrected data voltage V2'. In this way, the correction value calculator of the fourth embodiment successively calculates and provides corrected data voltages with a delay of one clock period.

The fourth embodiment multiplies Vn and V(n−1)' by a and β within a half of a clock period and adds the resultants to each other in the remaining period. Since each operation must be completed in a half of a clock period, the fourth embodiment must employ high-speed devices. The fifth embodiment mentioned below decreases the operating speed to employ low-speed devices.

Figure 24:
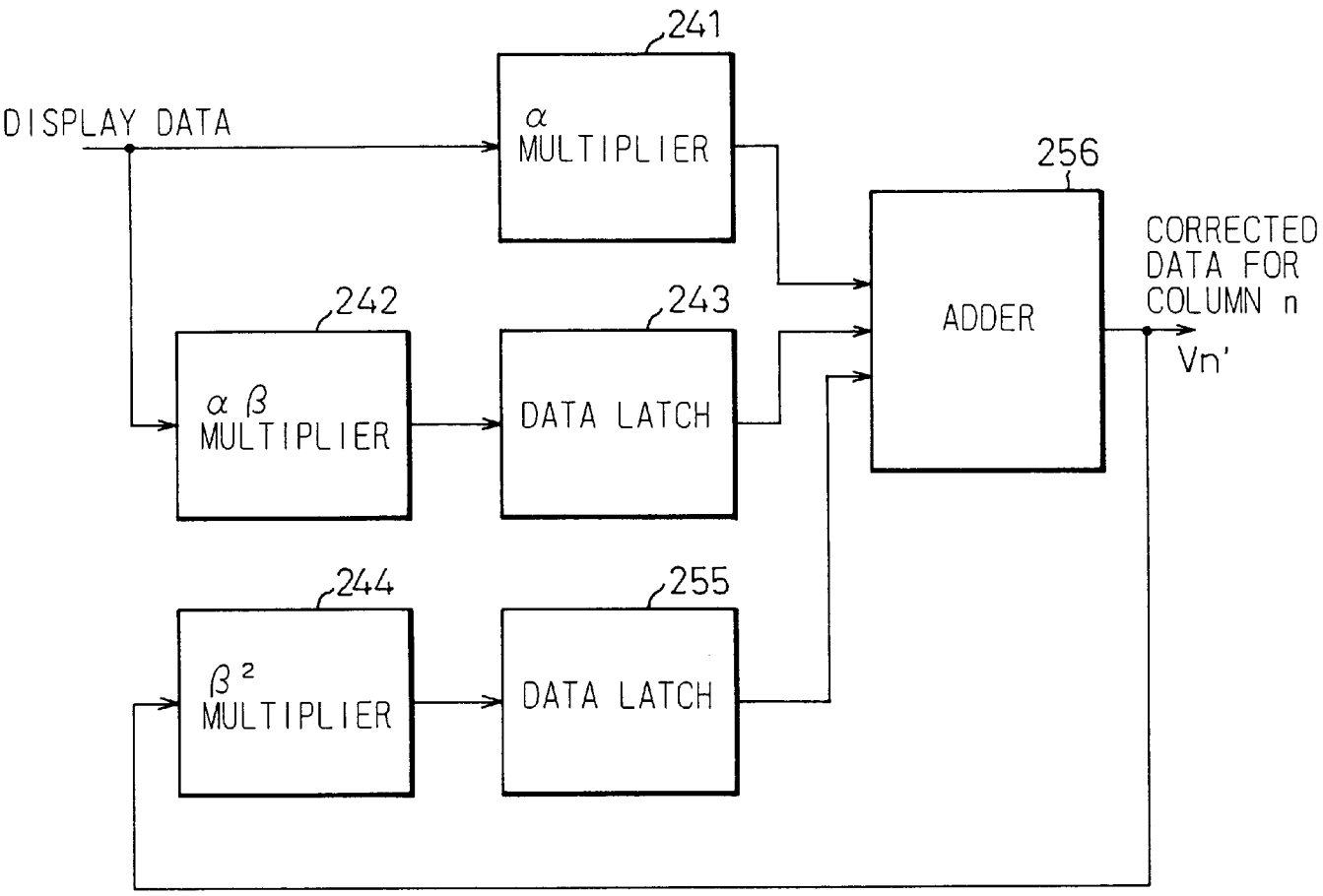
FIG. 24 shows a correction value calculator according to a fifth embodiment of the present invention.
Figure 25:
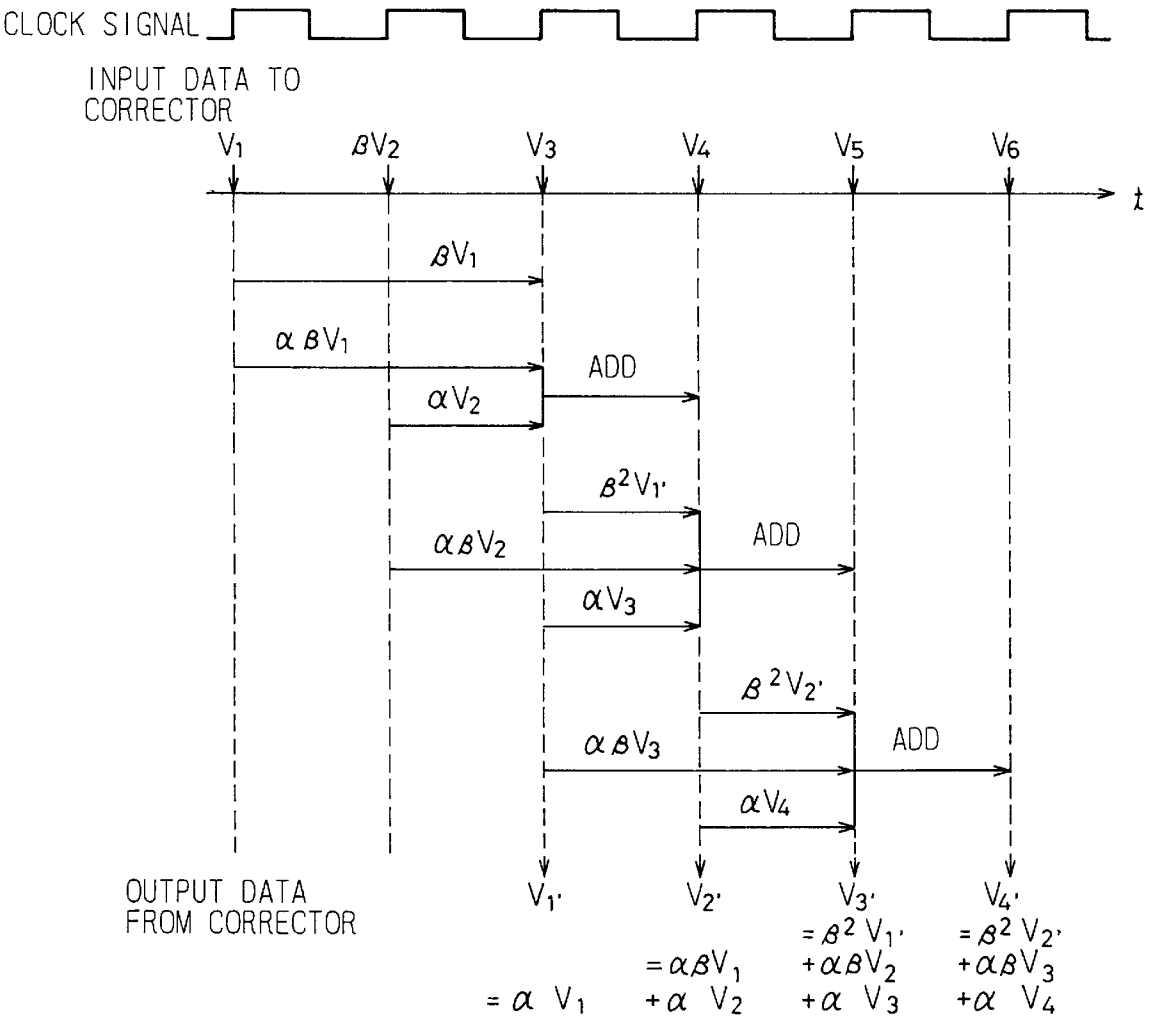
FIG. 25 shows the operation of the calculator of the fifth embodiment.

FIG. 24 shows a correction value calculator of an LCD according to the fifth embodiment of the present invention. The other parts of the fifth embodiment are the same as those of the fourth embodiment. FIG. 25 shows the operation of the fifth embodiment.

The expression 4 is developed as follows:

$$Vn'=\alpha Vn+\alpha\beta V(n-1)+\beta^2 V'(n-2) \quad (5)$$

Every device of the circuit of FIG. 24 operates in response to a rise of a clock signal. An $\alpha\beta$, multiplier 242 multiplies a display data voltage by $\alpha\beta$, and a data latch 243 delays the result by a clock period, to provide $\alpha\beta V(n-1)$. A $\beta^2$ multiplier 244 delays a corrected data voltage by a clock period and multiplies the result by $\beta^2$, and a data latch 245 delays the result by a clock period, to provide $\beta^2 V(n-2)$. FIG. 25 shows the outputs of the respective devices of the circuit of FIG. 24. The operation of each device is completed within a clock period, so that the fifth embodiment may employ devices whose operating speed is slower than that of the fourth embodiment. Since the devices operate in response to only a rise of a clock signal, they are easily integrated.

Each of the first, fourth, and fifth embodiments calculates a corrected data voltage through its operations. The expression 4 calculates a corrected voltage Vn' for a column n according to Vn and V(n−1)', and therefore, it is possible to employ a two-dimensional lookup table that stores Vn and V(n−1)' as variables, to find a corrected data voltage according to Vn and V(n−1)'. The sixth embodiment of the present invention employs such a lookup table to find a corrected data voltage.

Figure 26:
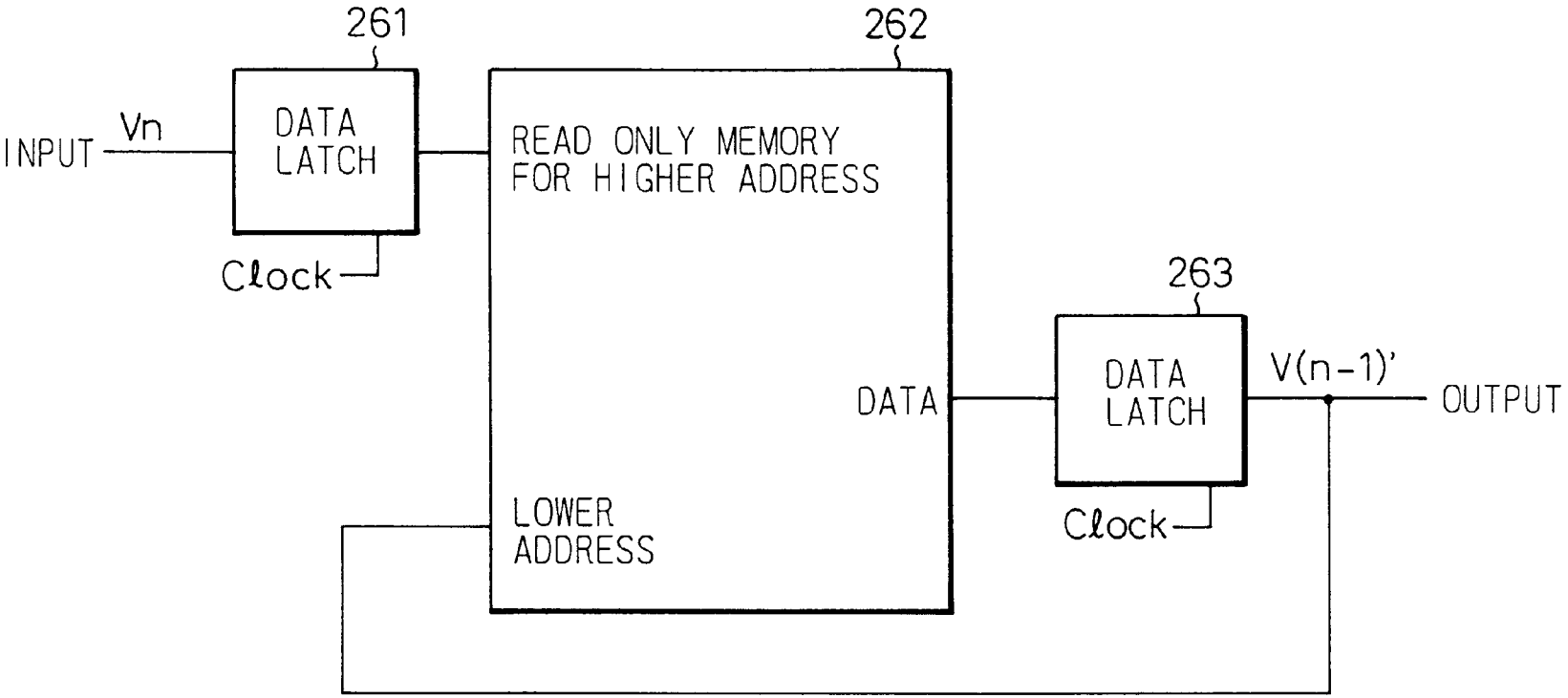
FIG. 26 shows a correction value calculator according to the sixth embodiment of the present invention.

FIG. 26 shows a correction value calculator of an LCD according to the sixth embodiment.

The correction value calculator has data latches 261 and 263 and a read-only memory (ROM) 262 that stores the lookup table. Each data calculated according to the expression 4 and stored in the ROM 262 is accessible with V(n−1)' as a lower address and Vn as a higher address. The data latch 263 holds a corrected data voltage, and the data latch 261 holds Vn provided by the controller. The outputs of the data latches 261 and 263 are used as addresses to access the ROM 262, which then provides a corrected data voltage Vn'.

The corrected data stored in the ROM 262 may include not only data calculated according to the expression 4 but also γ-characteristic correction data for correcting gray levels and brightness.

The conventional LCD of FIG. 2 has an insufficient aperture ratio. To solve this problem, the large-aperture LCD of FIGS. 7A and 7B has been proposed. In this LCD, data and scan lines form part of a light shield film. This structure increases parasitic capacitance between each cell and adjacent data lines, to increase cross-talk. Compared with the cell of FIG. 2, the cell of FIGS. 7A and 7B has a larger aperture ratio because the light shield film formed on an opposite substrate is smaller. A process margin on the TFT substrate on which TFTs and signal lines are formed is 3 μm or smaller. A process margin of the light shield film is about 7 μm. It is important, therefore, to reduce the light shield film, to increase the aperture ratio. The three-dimensional structure of the cell of FIGS. 7A and 7B has an insulation film between an ITO thin film and data lines, to form large parasitic capacitance between each cell electrode and adjacent data lines, to increase cross-talk.

As explained with reference to the first to sixth embodiments, the cross-talk can be canceled by inverting a data voltage within a horizontal scan period, to zero an effective voltage applied to each data line. The difference between a data voltage applied to a given cell through a corresponding data line and a voltage sustained by the cell occurs due to a voltage change in a scan line at the end of a scan pulse as well as different data voltages applied to the data line. The difference due to the voltage change in the scan line is constant because the scan pulse is constant, and therefore, can be solved by correcting each data voltage accordingly. The difference due to various data voltages applied to the data line can be solved by zeroing an effective voltage applied to the data line and by correcting a deviation that is caused by the difference between each data voltage to be written and the effective voltage of zero. Namely, each of the embodiments alternates a data voltage applied to a given data line in a horizontal scan period, to zero an effective voltage applied to the data line and correct the data voltage, to thereby prevent cross-talk and correctly display images even on the large-aperture LCD of FIGS. 7A and 7B. In this way, the first aspect of the present invention is effective, in particular, in the large-aperture LCD of FIGS. 7A and 7B.

Since the cells of the prior arts of FIGS. 2, 7A, and 7B employ a light shield film such as a BM, it is impossible for the cells to further improve the aperture ratio thereof. On the other hand, the present invention can prevent cross-talk even if the aperture ratio of each cell is large to increase parasitic capacitance between the cell and adjacent data lines. Accordingly, the present invention may further increase the aperture ratio of each cell without regard to parasitic capacitance. The cells of LCDs having a large aperture ratio according to the present invention will be explained.

To achieve a large aperture ratio, the present invention forms a light shield area from the same material as data lines, such as semiconductor and metal. An end of the area is connected to the drain of a TFT to which a cell electrode is connected, or to a data line. Although the light shield area that overlaps the cell electrode forms parasitic capacitance, it will cause no problem according to the present invention. As a result, the present invention improves the aperture ratio by about 10% from 30% to 40%.

Figure 27A:
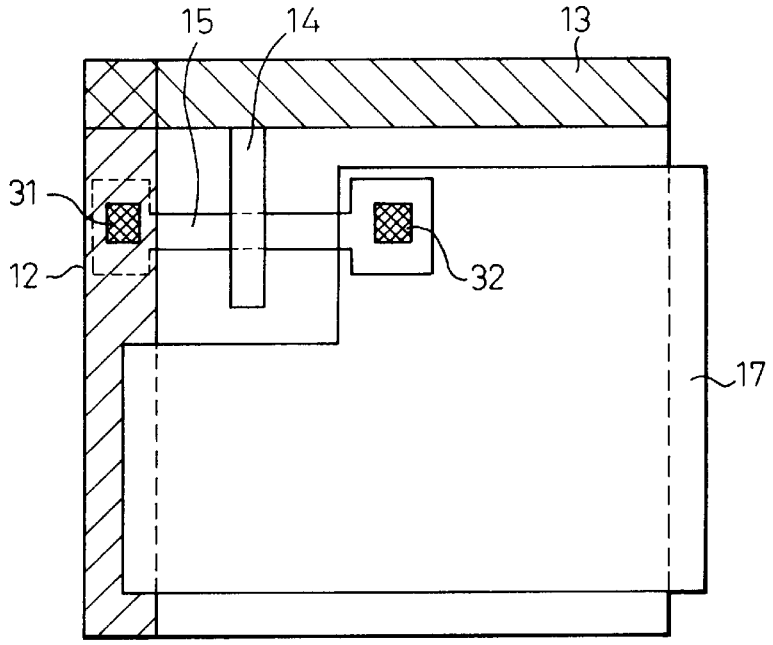
FIGS. 27A and 27B show a cell of a TFT-LCD employing a polysilicon active layer.
Figure 27B:
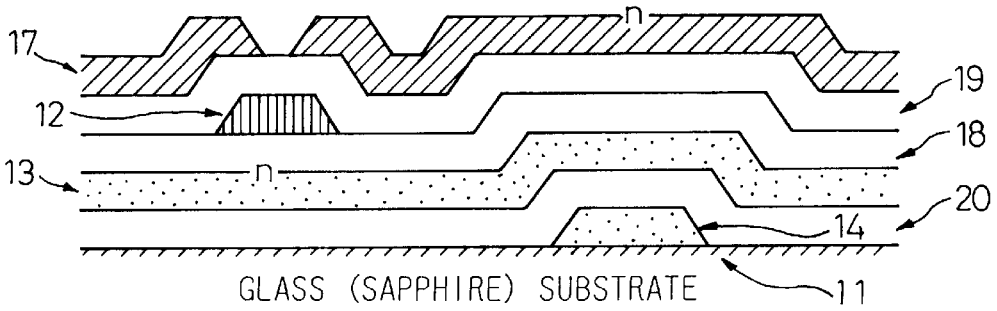

FIG. 27A is a plan view showing a cell of an LCD according to the present invention, and FIG. 27B is a sectional view showing the same. The cell incorporates a TFT having a polysilicon active layer.

The cell is composed of a glass (sapphire) substrate 11, polysilicon layers 14, 15, and 16, an oxide film 20, a scan line (an aluminum gate layer) 13, a first insulation film 18, an aluminum data line 12, a second insulation film 19, and a cell electrode 17. A first contact 31 connects the data line 12 to the polysilicon layer 15. A second contact 32 connects the cell electrode 17 to the polysilicon layer 16.

Figure 28:
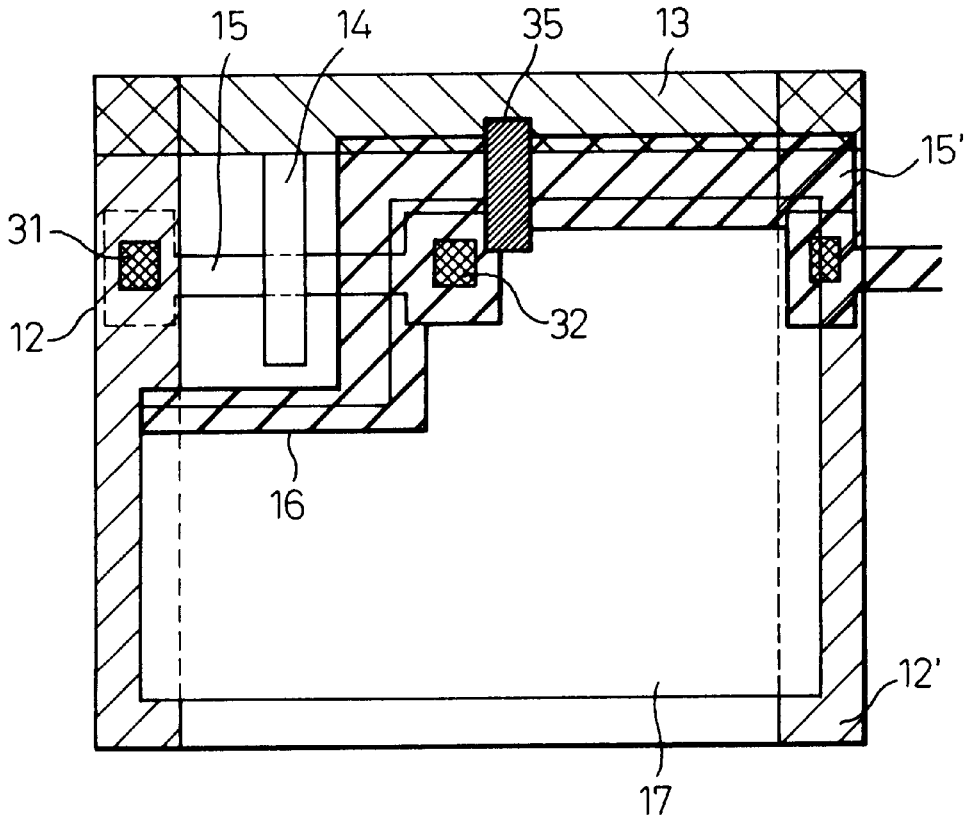
FIG. 28 shows the cell of an LCD according to a seventh embodiment of the present invention.

FIG. 28 shows a cell of an LCD according to the seventh embodiment of the present invention. This embodiment employs polysilicon layers as light shield films.

A polysilicon layer 16 serving as the source of a TFT is extended and connected to a cell electrode 17. A polysilicon layer 15' serving as the drain of a TFT of the next cell is extended and connected to the next data line 12'. These polysilicon layers 16 and 15' are spaced apart from each other by a gap of, for example, about 3 μm. To shield this part from light, a BM 35 is formed.

The sheet resistance of the polysilicon layers will be equalized to that of the cell electrode by doping, and therefore, the polysilicon electrodes never float. The polysilicon films are each translucent, which may become opaque by thickening or by deteriorating the crystal characteristics, to cause no problem. The polysilicon film 16 connected to the cell electrode 17 may be extended without it coming into contact with the data line 12', to equalize the potential thereof with a cell potential. In this case, the polysilicon film 16 may apply a certain voltage to the liquid crystals, and therefore, it may be opaque.

If the LCD is a normally white display that displays white when no voltage is applied thereto, the transparency of the polysilicon films is important. If the LCD is a normally black display that displays black when no voltage is applied thereto, it has no such problem.

A scan line 13 may be extended instead of forming the BM 35.

Figure 29:
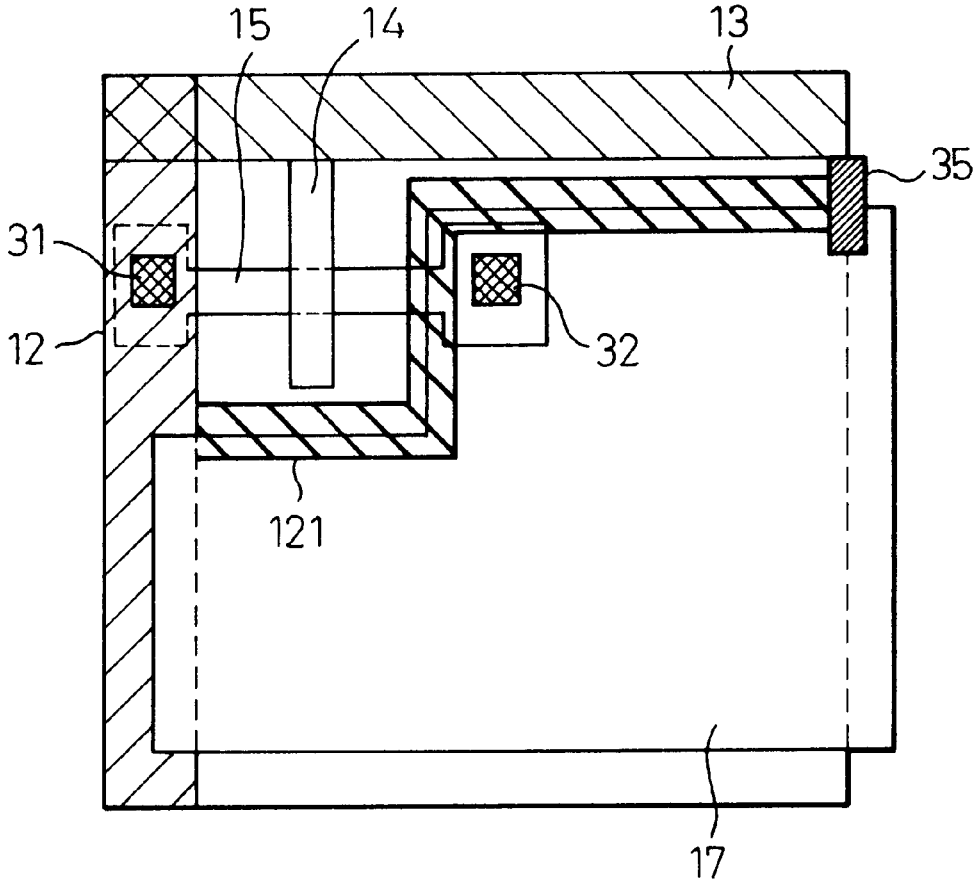
FIG. 29 shows a cell of the LCD according to an eighth embodiment of the present invention.
Figure 30:
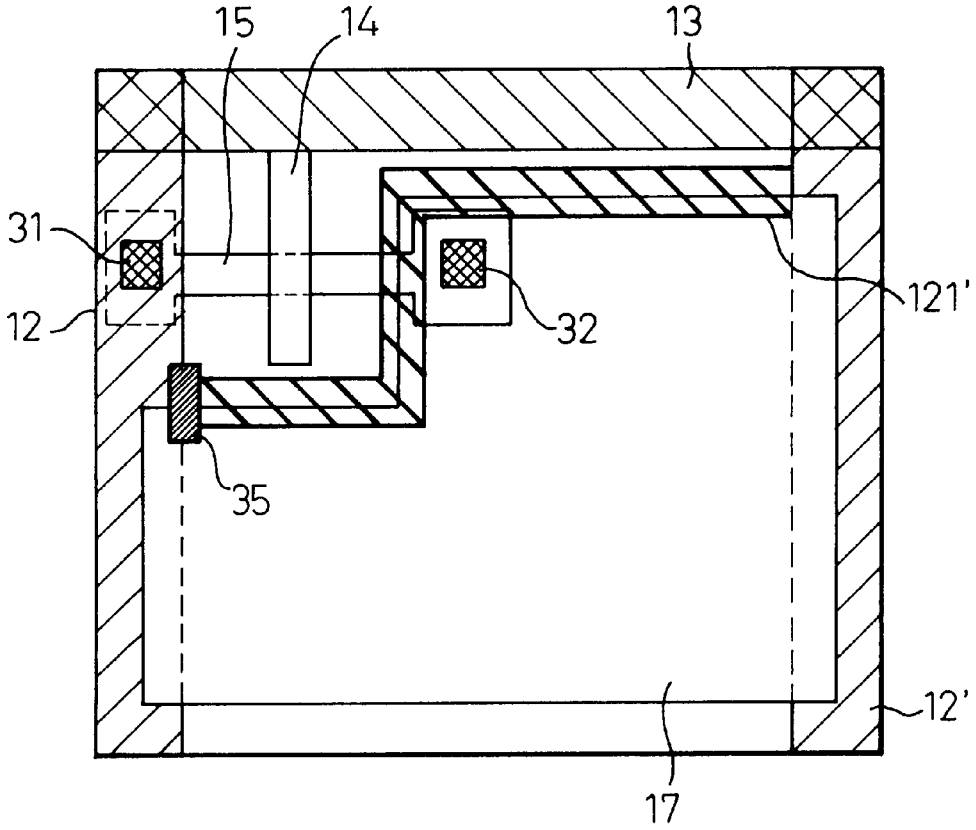
FIG. 30 shows a cell of an LCD according to a modification of the eighth embodiment of the present invention.

FIG. 29 shows a cell of an LCD according to the eighth embodiment, and FIG. 30 shows a cell of an LCD according to a modification of the eighth embodiment.

The eighth embodiment employs an aluminum data line 12 to shield light. In FIG. 29, the data line 12 for supplying a data voltage to the cell has an aluminum horizontal extension 121 along a cell electrode 17, to shield light. In FIG. 30, a data line 12' has a horizontal aluminum extension 121' along a cell electrode 17, to shield light. Since data lines must not be in contact with each other in any case, a BM 35 is formed. The aluminum data line is opaque, and therefore, causes no problem both for the normally white and normally black displays.

To shield light, it is possible to employ aluminum scan lines, or a combination of polysilicon layers and aluminum data and scan lines.

Figure 31:
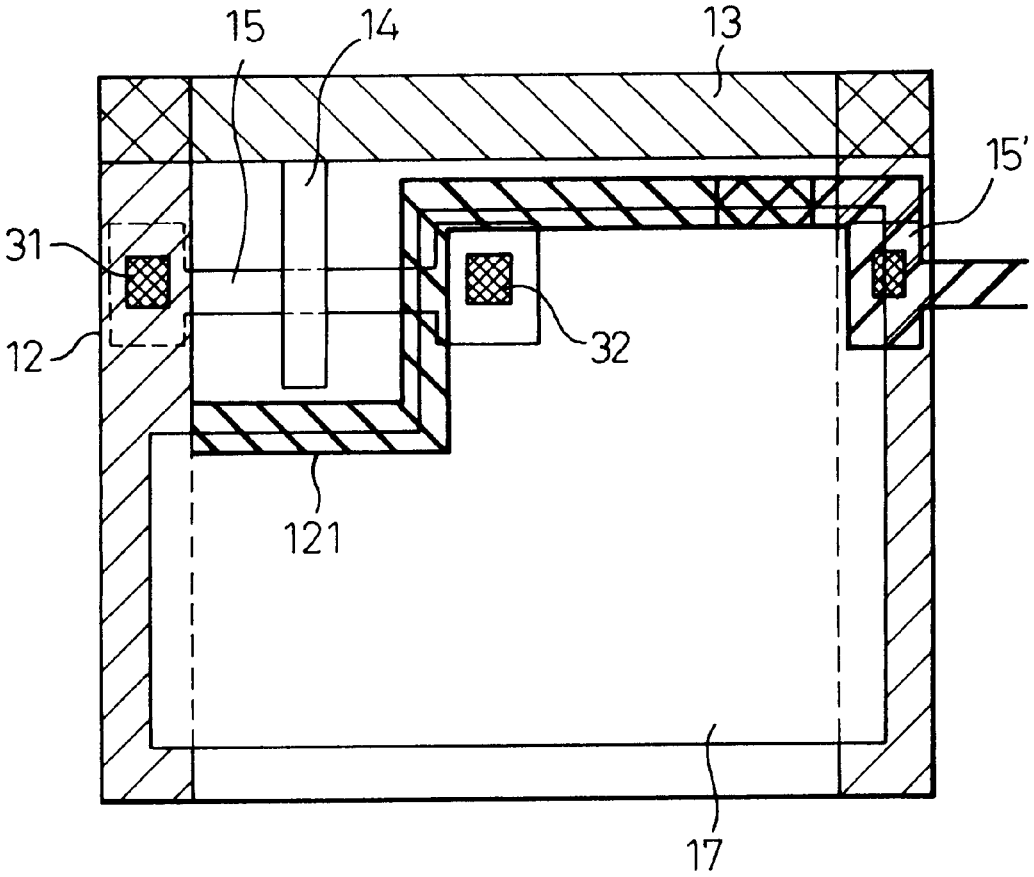
FIG. 31 shows the cell of an LCD according to a ninth embodiment of the present invention.

FIG. 31 shows a cell of an LCD according to the ninth embodiment of the present invention. An aluminum extension 121 from a data line 12 overlaps a polysilicon extension 15' of a TFT of an adjacent cell, to shield light. Due to the overlapping layers 15' and 121, there is no need to form a BM.

Each of the cells of the seventh to ninth embodiments is capable of increasing an aperture ratio. These cells involve a large capacitance between each cell and adjacent data and scan lines. This increases cross-talk in conventional LCDs. The present invention prevents such cross-talk by inverting a data voltage applied to a data line within a horizontal scan period, to zero an effective voltage applied to the data line and by correcting the data voltage. Accordingly, the present invention can use large-aperture cells.

An ordinary data driver simultaneously applies data voltages to all data lines of a liquid crystal panel.

There has been proposed a dot sequential data driver that sequentially selects (addresses) data lines one after another and applies a data voltage to the selected one.

Figure 32:
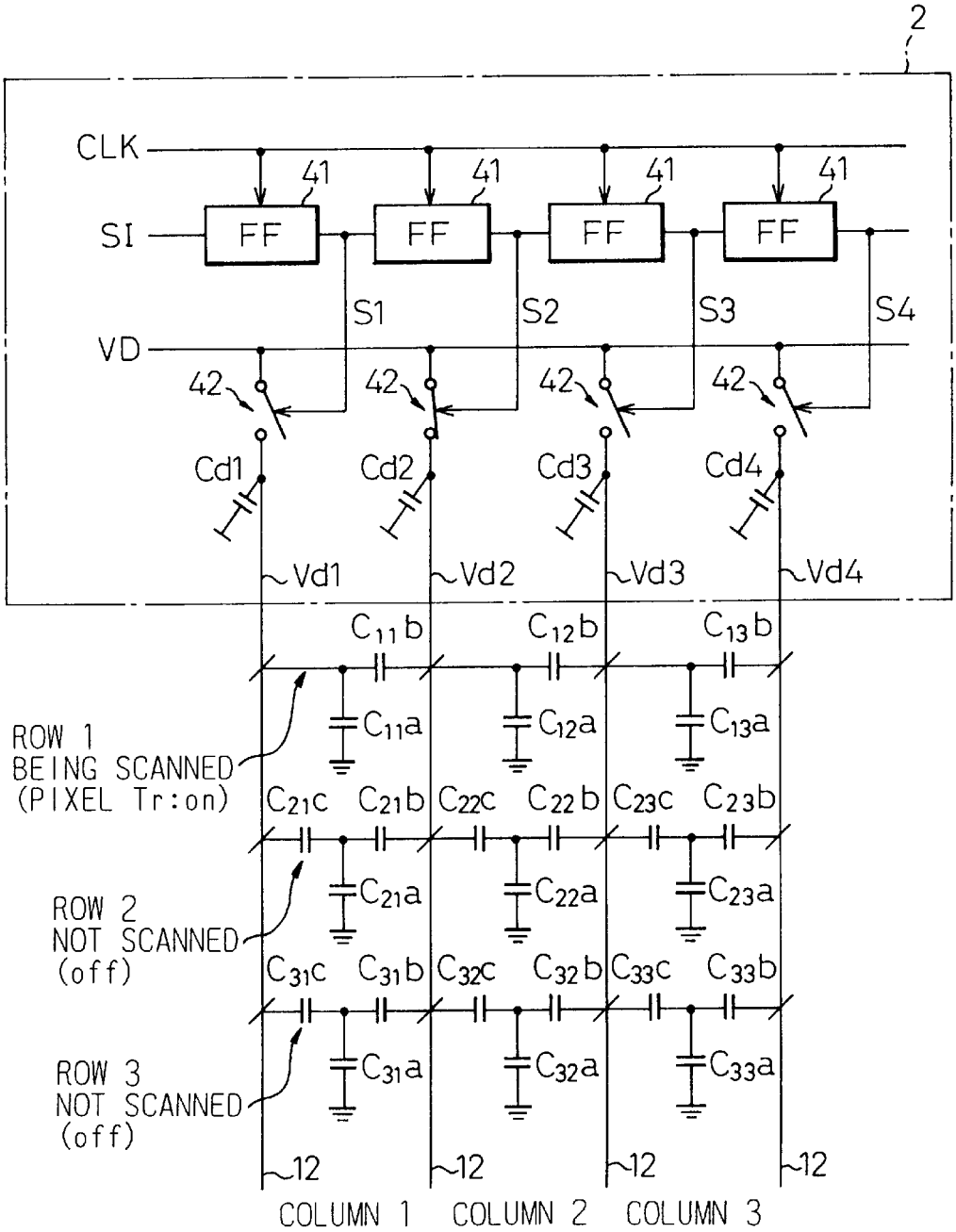
FIG. 32 shows a dot sequential data driver according to the prior art.

FIG. 32 shows a dot sequential data driver 2 connected to the liquid crystal panel of any one of the seventh to ninth embodiments having large capacitance between a cell and adjacent data lines. In FIG. 32, a scan driver is not shown. The first scan line is selected to turn on TFTs connected thereto, and the other scan lines are not selected. Although the data driver 2 employs shift registers, it may employ decoders.

The data driver 2 has cascaded flip-flops 41 each of which controls a switching device 42 formed between an input bus and a corresponding data line 12. When the switching device 42 is closed, a data voltage is applied to the capacitance (total of parasitic capacitance and intentionally arranged capacitance) of a corresponding data line 12. The data voltage is written to a corresponding cell whose TFT is on and is sustained thereby. In this example, data is applied to only one data line. It is possible to simultaneously apply data voltages to a plurality of data lines.

Figure 33:
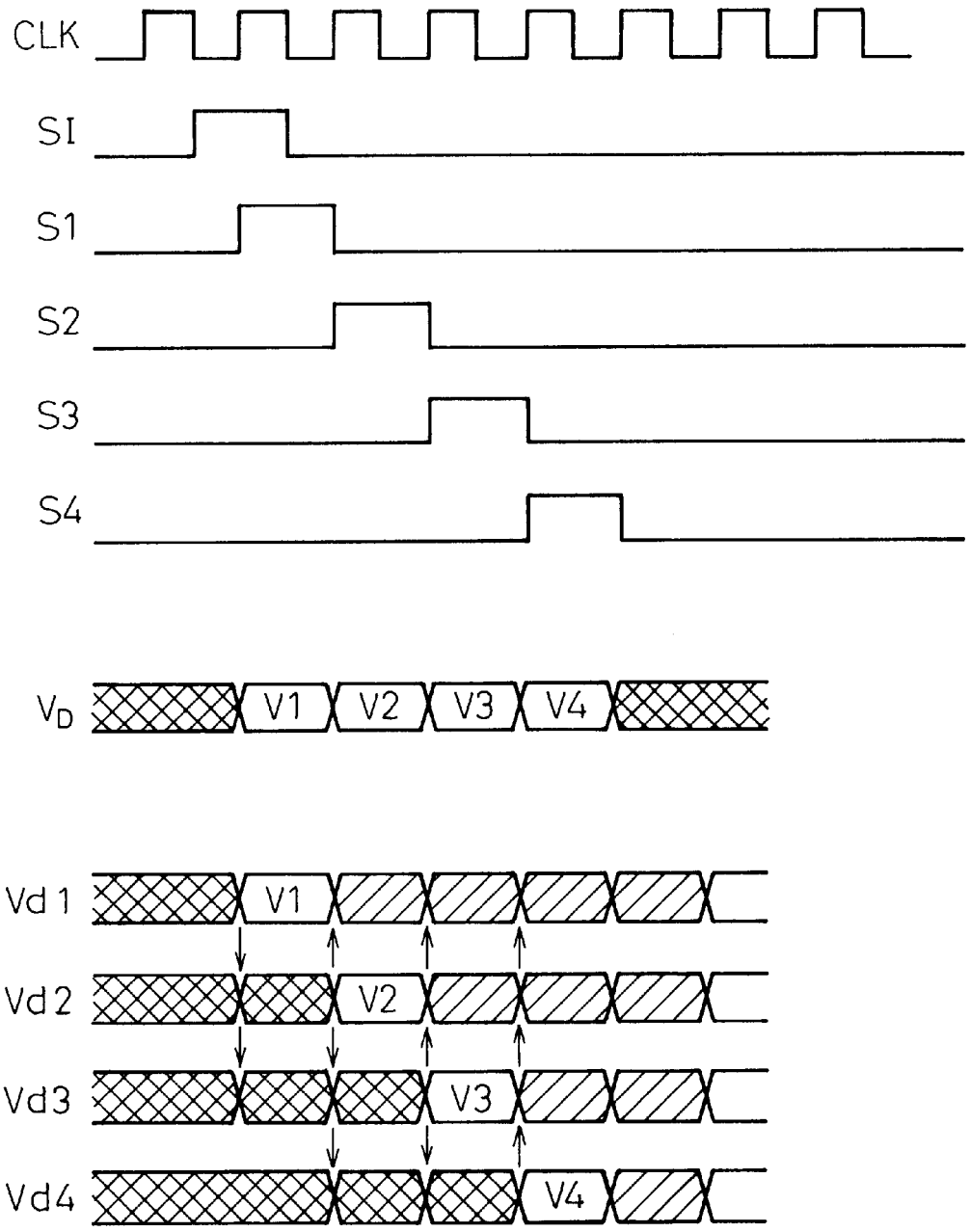
FIG. 33 shows the operation of the data driver of FIG. 32.

FIG. 33 explains the operation of the LCD of FIG. 32. In synchronization with a clock signal, pulses S1, S2, and the like successively turn on the switching devices 42. At the same time, a data voltage VD is supplied to a selected cell through a corresponding data line. Once the shift pulse ends, the switching device 42 turns off to put the data line in a floating state, and the cell sustains the written data voltage VD. When every data line in the selected row receives a data voltage, the scan pulse to the selected scan line ends. The voltages written to the cells are sustained until the next scan pulse is applied thereto.

The LCD of FIG. 32 has large capacitance between each cell and adjacent data lines, to cause cross-talk. At first, vertical cross-talk explained with reference to FIG. 6B appears due to successively changing data voltages applied to a given data line. Secondly, horizontal cross-talk appears due to the influence of various voltages applied to an adjacent data line as shown in FIGS. 5A and 5B. The dot sequential data driver 2 of FIG. 32 causes horizontal cross-talk due to a variety of data voltages applied to the many data lines around a given cell. When writing data to cells, the conventional data driver of FIG. 1 simultaneously applies data voltages to data lines, respectively. On the other hand, the dot sequential data driver 2 puts all data lines except a selected one in a floating state, so that the data lines that are not selected are capacitively connected to one another in series. Namely, a voltage change in one data line is successively propagated to the others. Therefore, it is very difficult for the prior art to use the dot sequential data driver for an LCD that involves large capacitance between each cell and adjacent data lines because of cross-talk.

Figure 34:
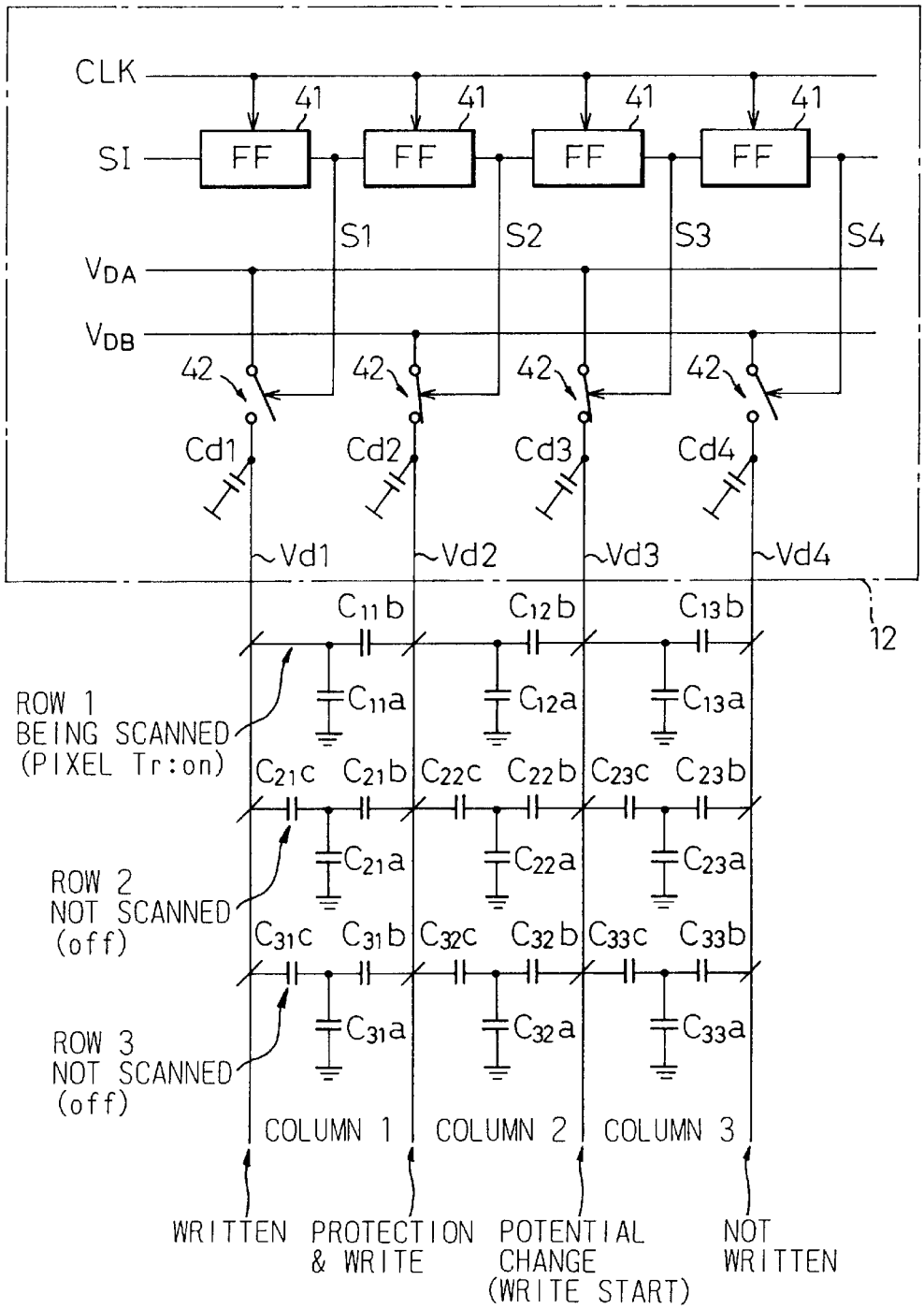
FIG. 34 shows part of a data driver and liquid crystal panel according to the tenth embodiment of the present invention.

FIG. 34 shows an LCD according to the tenth embodiment of the present invention that employs a dot sequential data driver without causing cross-talk. A scan driver is not shown in the figure. The first scan line is selected to turn on TFTs connected thereto, and the other scan lines are not selected.

This embodiment suppresses the propagation of a voltage change in a given data line to only an adjacent data line. Thereafter, the embodiment corrects a data voltage and applies the corrected data voltage as well as an inversion of the corrected data voltage to the given data line within a horizontal scan period, to zero an effective data voltage to the data line. Correcting, inverting, and zeroing a data voltage applied to a data line within a horizontal scan period are carried out as explained above. A write period for applying the corrected data voltage and a correction period for applying the inverted voltage within a horizontal scan period are set as shown in FIGS. 8, 15, and 20. During the write period, a scan pulse is applied to a selected scan line, to turn on TFTs connected thereto, and data voltages are successively applied to the data lines. During the correction period, the scan pulse to the scan line is stopped to turn off the TFTs, and inverted data voltages are successively applied to the data lines. Successively applying data voltages to the data lines will be explained.

To suppress the propagation of a voltage change in a data line only to an adjacent data line, the tenth embodiment applies a data voltage to the next data line. The data lines are selected one after another, and a data voltage is applied to the selected one. To achieve this, the tenth embodiment employs two input buses that are alternately connected to the data lines through switching devices 42.

Figure 35:
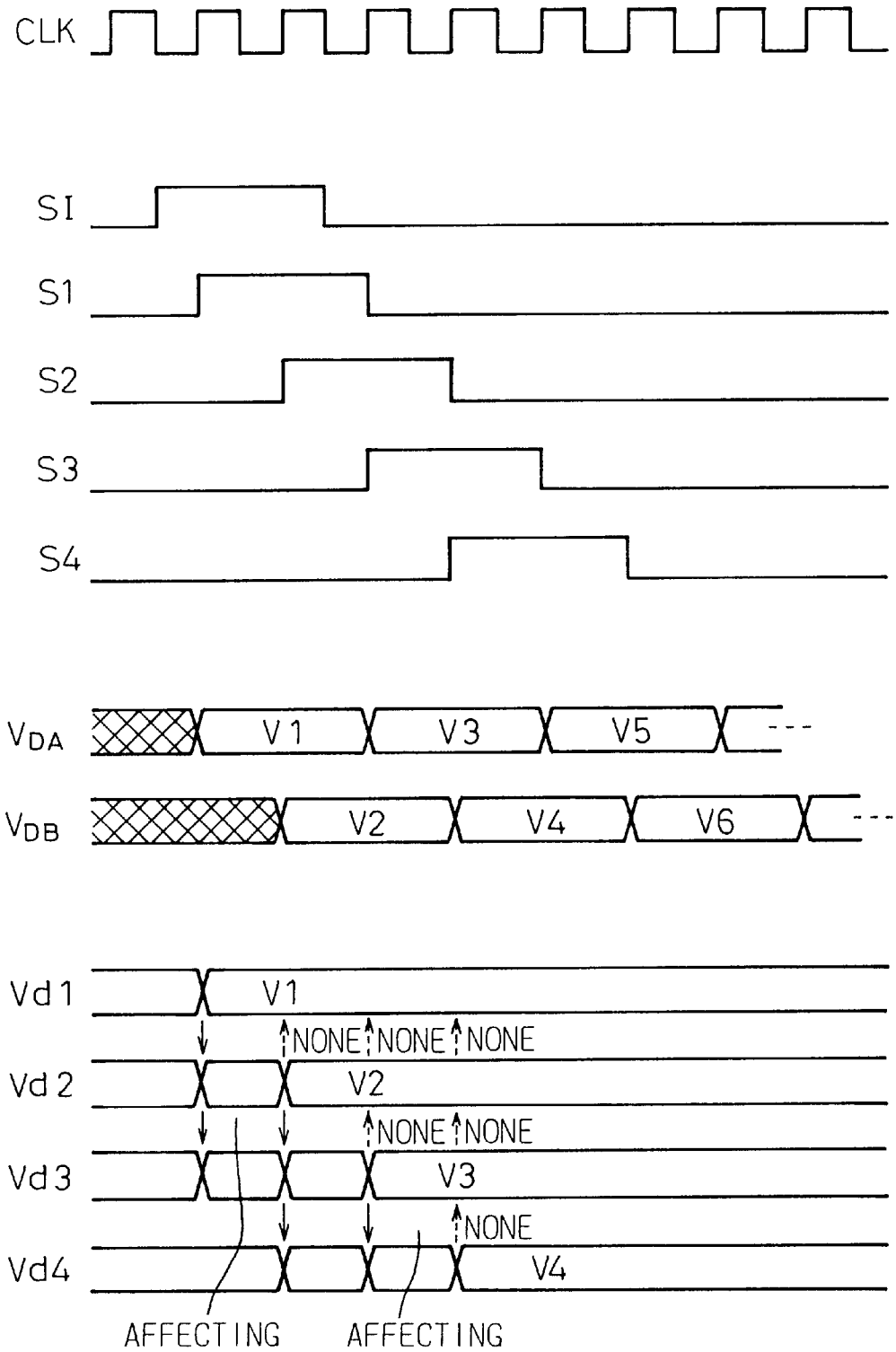
FIG. 35 shows the operation of the data driver of FIG. 34.

FIG. 35 explains the operation of the dot sequential data driver of the tenth embodiment.

Shift pulses have each a two-clock period and are shifted from one to another clock by clock. One clock period after the first switching device is closed, the second switching device is closed. After another one clock period, the first switching device is opened, and at the same time, the third switching device is closed. Odd data lines are connected to the first input bus through the switching devices, and even data lines are connected to the second input bus through the switching devices. Data voltages are supplied to the input buses, respectively, in synchronization with shift pulses supplied to the corresponding switching devices. When the first switching device is closed, a data voltage in the first input bus is supplied to the first data line, and the data voltage is applied to a cell in the first row. After one clock period, the second switching device is closed to supply a data voltage in the second input bus to the second data line. The data voltage to the second data line never affects the first data line because the first and second data lines are connected to the different input buses. After another clock period, the shift pulse S1 disappears to open the first switching device, and the corresponding cell sustains the voltage applied thereto through the first data line. At this time, the second switching device is still closed to supply the data voltage from the second input bus to the second data line. After another clock period, the second switching device is opened to sustain the data voltage. At this time, there is no change in the voltage of the second data line and the first data line is not influenced. When the third switching device is opened, there is no change in the voltage of the third data line and the second data line is not influenced. When the third switching device is opened, a voltage in the third data line changes. At this time, the second data line is connected to the second input bus, and therefore, the voltage of the second data line is unchanged. Accordingly, the voltage of the first data line is also unchanged. In this way, a voltage change in a given data line never affects the voltages of the data lines that are in front of the given data line. In this embodiment, a data voltage applied to any data line is a corrected voltage.

A voltage change due to a write operation in a given data line influences a voltage sustained by a data line that is behind the given data line. The period of the influence, however, is only a horizontal scan period at the maximum. A voltage change in a given data line never affects the preceding data lines to which data have been written. Accordingly, when a write operation to a row of cells is complete, every cell in the row sustains a required data voltage and, at this time, a scan pulse is stopped.

In this way, the tenth embodiment employs the dot sequential data driver for the LCD whose cell electrodes are capacitively connected to adjacent data lines, without causing cross-talk.

Although the tenth embodiment employs shift registers as addressing units in the data driver, it is possible to employ decoders as the addressing units.

Figure 36:
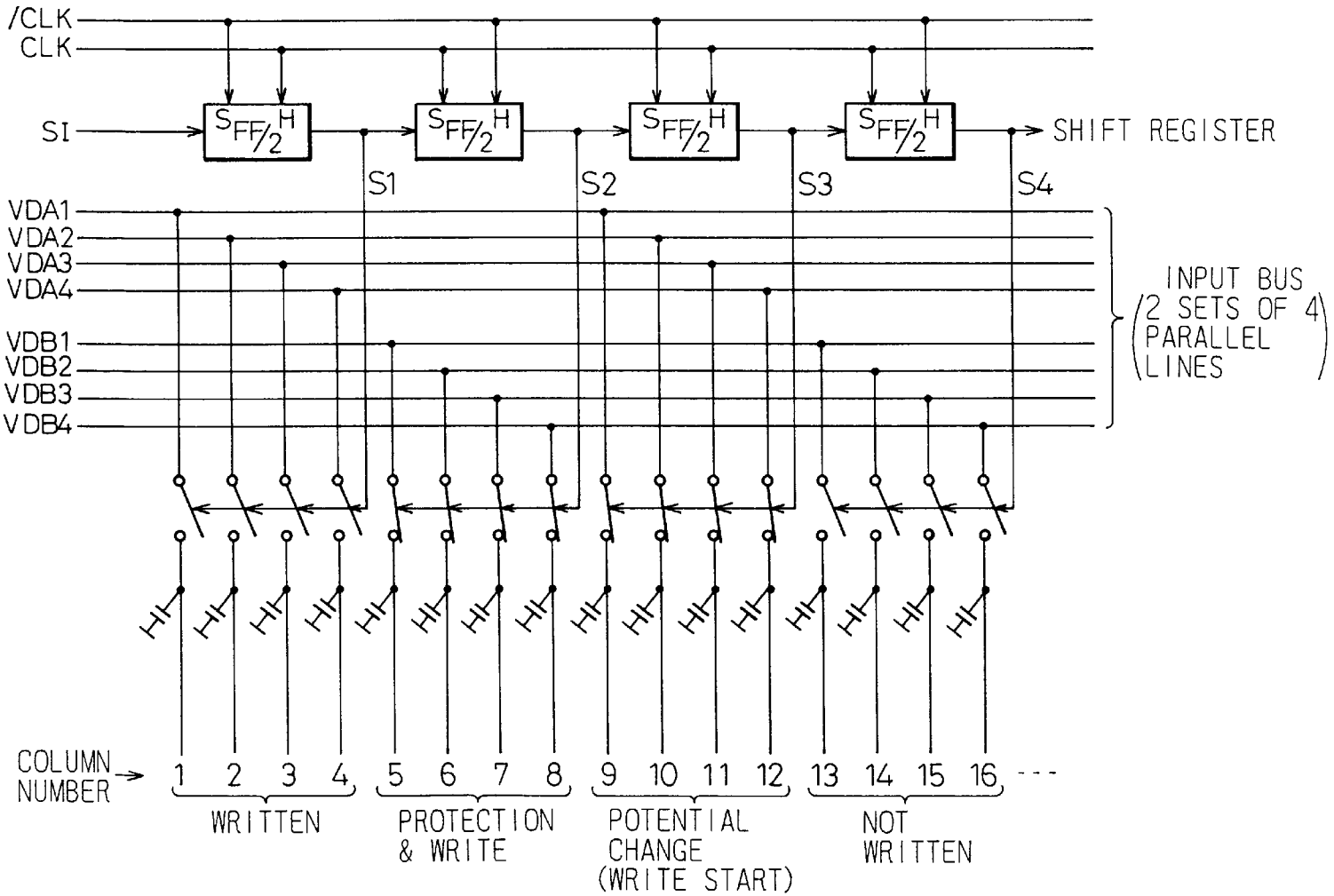
FIG. 36 shows a data driver according to the eleventh embodiment of the present invention.
Figure 37:
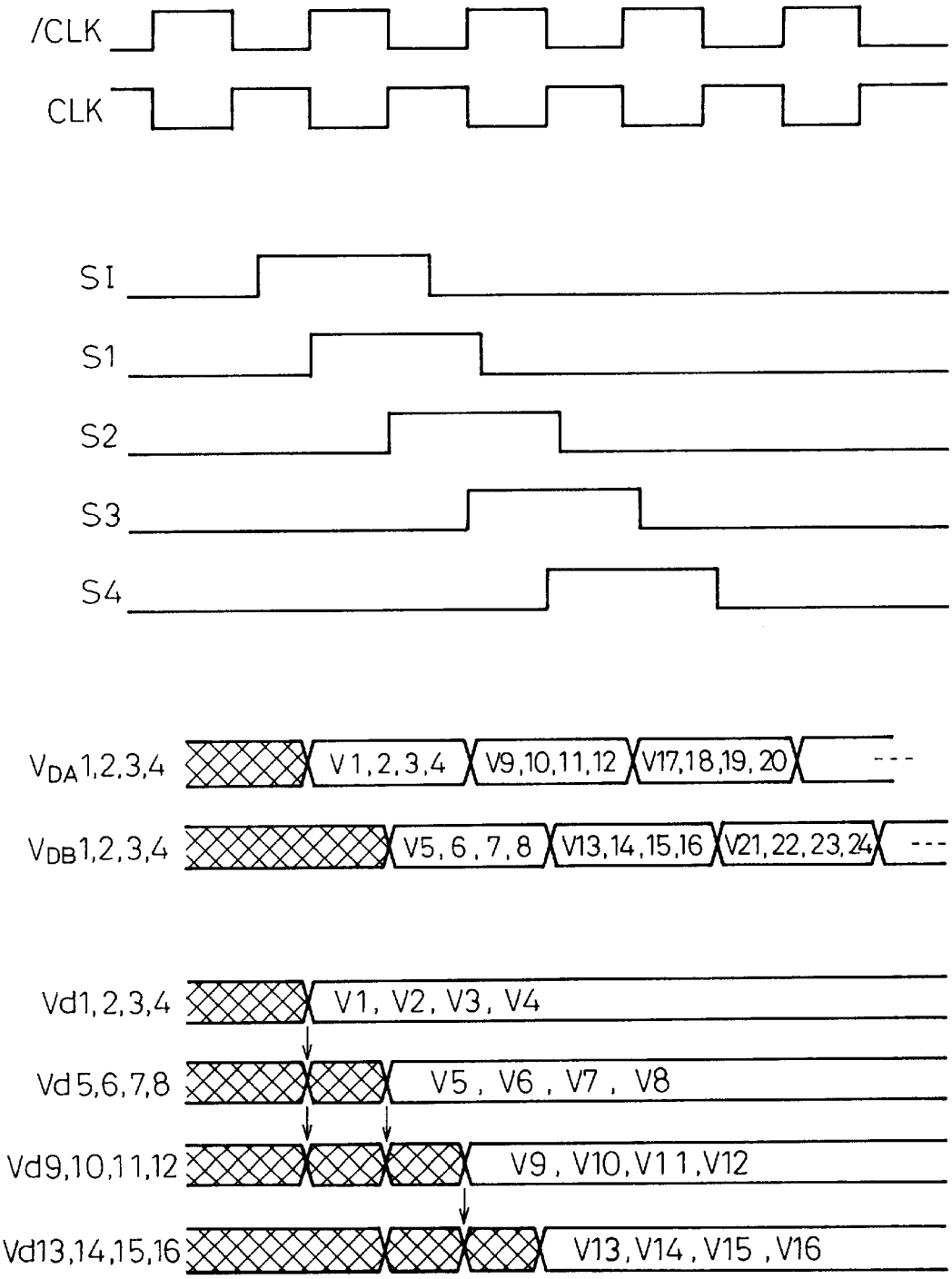
FIG. 37 shows the operation of the data driver of FIG. 36.

FIG. 36 shows a data driver of an LCD according to the eleventh embodiment of the present invention, and FIG. 37 explains the operation thereof. The eleventh embodiment employs a dot sequential data driver, which is different from that of the tenth embodiment.

The data driver of the eleventh embodiment employs two sets of four input buses. Shift registers are composed of half-clock D-type flip-flops as shown in FIGS. 38A and 38B for shifting an input signal by a half clock period.

Figure 38A:
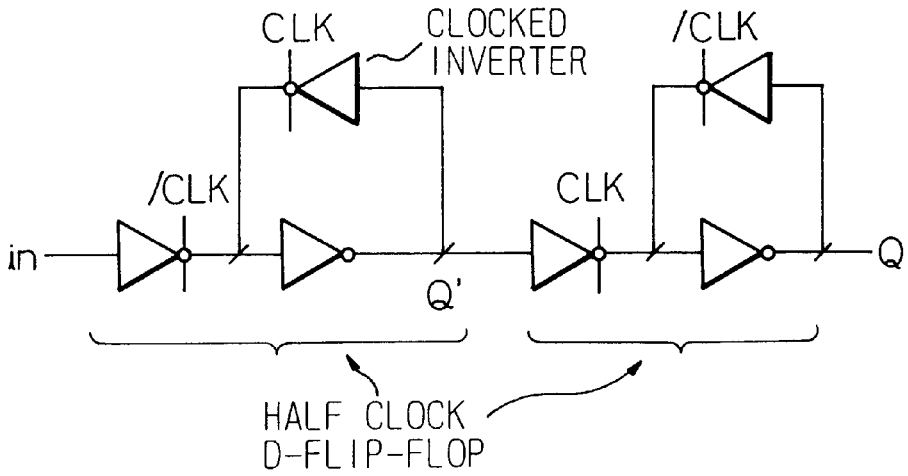
FIG. 38A shows a half-clock flip-flop circuit according to the 11th embodiment.
Figure 38B:
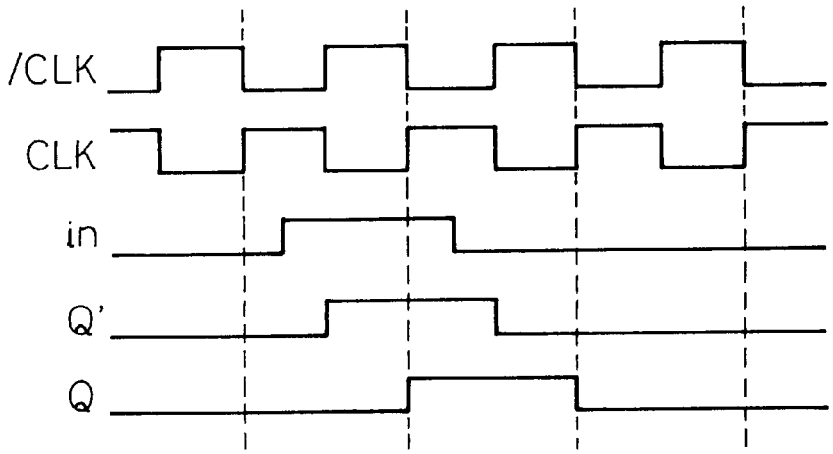
FIG. 38B shows the operation of the circuit of FIG. 38A.

In FIG. 38A and 38B, two half-clock D-type flip-flops form a full-clock D-type flip-flop. Each flip-flop delays input data by a half clock period, to thereby delays the input data by a clock period. The eleventh embodiment employs the half-clock flip-flops to shift an input shift pulse every half clock as shown in FIG. 37.

Returning to FIG. 36, data lines are divided into groups each consisting of four data lines. The data lines of every odd group are connected to the first input buses, respectively, and the data lines of every even group are connected to the second input buses, respectively, through switching devices. Shift pulses S1 to S4 close the four switching devices of corresponding groups. A group of data lines of the eleventh embodiment may correspond to one data line of the tenth embodiment, and then, the operation of the eleventh embodiment may be substantially the same as that of the tenth embodiment. Accordingly, a voltage change in a data line never affects the sustained voltages of the preceding data lines. Since the input buses are grouped four by four, a write period and a horizontal scan period are longer than those of the tenth embodiment. The half-clock D-type flip-flops of the eleventh embodiment help to simplify the data driver.

Similar to the tenth embodiment, the eleventh embodiment corrects a data voltage and applies the corrected data voltage and an inverted voltage to a given data line within a horizontal scan period, to zero an effective voltage applied to the data line, to thereby eliminate cross-talk.

Figure 39:
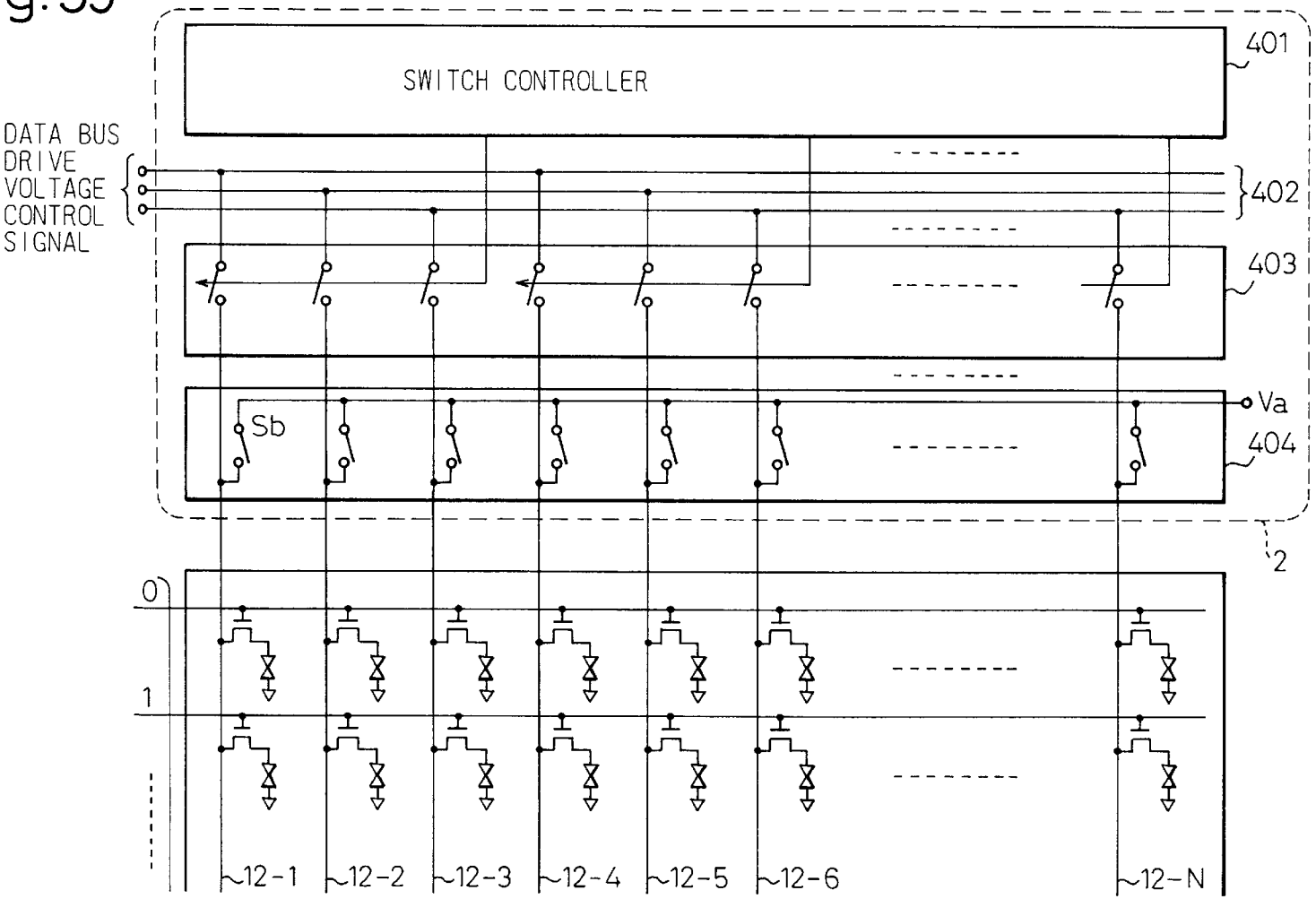
FIG. 39 shows part of a data driver and liquid crystal panel according to a twelfth embodiment of the present invention.

FIG. 39 shows a data driver of an LCD according to the twelfth embodiment of the present invention. The figure shows only part of the data driver and liquid crystal panel. This data driver applies the signals of FIG. 10 to data lines.

The data driver 2 has a data bus 402 having three parallel lines for supplying data voltages, a switch 403 arranged between the data bus 402 and data lines 12, a switch controller 401 for generating signals to control the switch 403, and an off-period-voltage switch 404. The switch 404 supplies a constant voltage to each data line 12 in response to an external input signal.

Figure 40A:
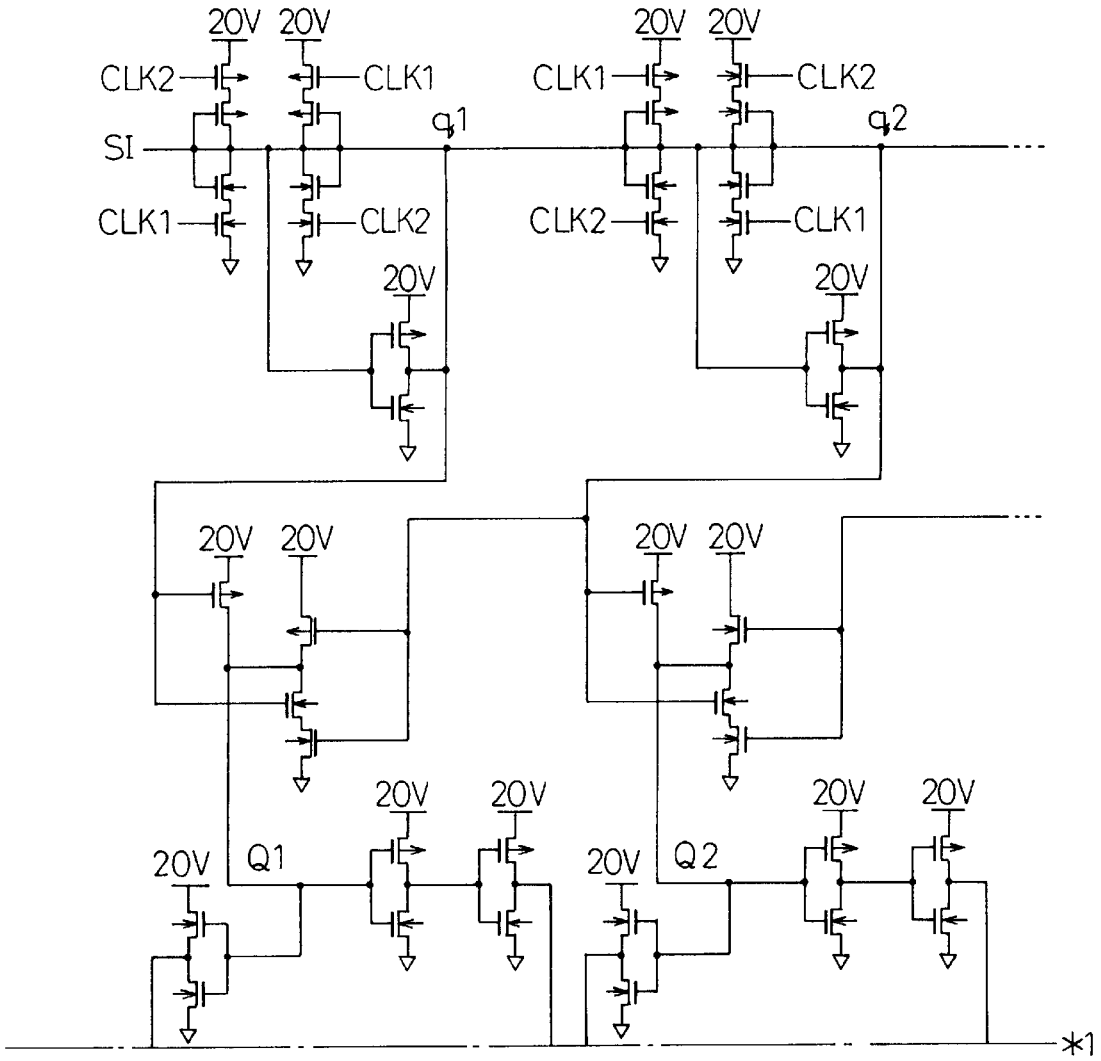
FIGS. 40A and 40B show the details of the data driver of FIG. 39.
Figure 40B:
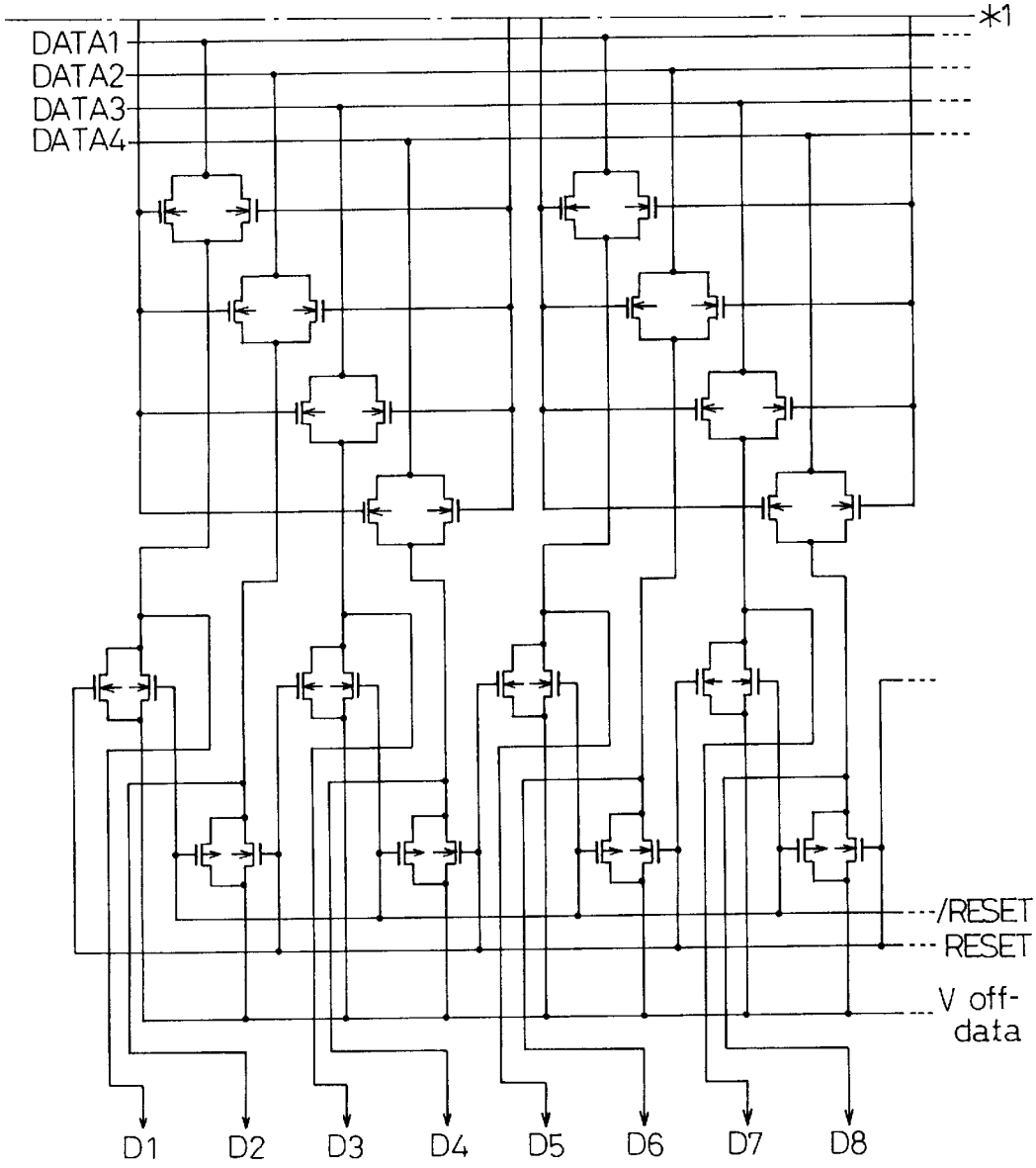
Figure 41:
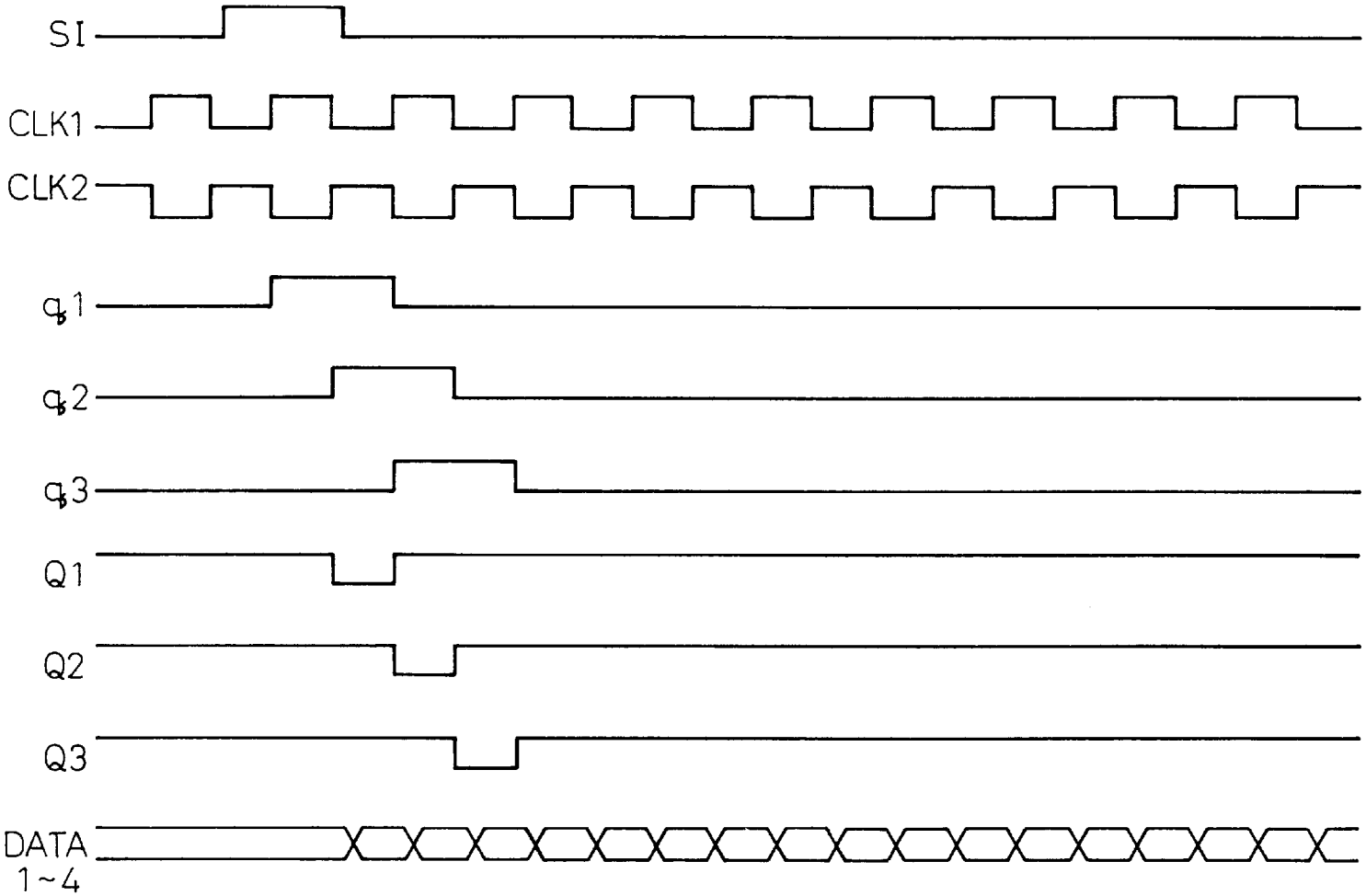
FIG. 41 shows the operation of the data driver of FIG. 39.

FIGS. 40A and 40B show the details of the data driver 2 of the twelfth embodiment. The data driver 2 drives a 640-by-480-dot VGA LCD. The data driver 2 is made of polysilicon TFTs formed on a substrate on which a liquid crystal panel is formed. The data driver 2 involves digital shift signals of shift registers, two-phase shift clock signals CLK1 and CLK2 shifted from each other by 180 degrees, analog signals DATA1 to DAT4 that are data bus driving voltages corresponding to image data, and digital signals RESET and /RESET that are control signals to control switches that connect a given data line to a data line driving voltage Voff-data during a period Toff-data. FIG. 41 is a timing chart showing driving waveforms representing the operations of the shift registers and signals DATA1 to DATA4 (Vdmax=15 V and Vdmin=5 V). The voltage of a counter electrode is about 9 V due to a decrease in a sustained voltage in a cell due to parasitic capacitance between the cell and a scan line. Liquid crystals held between a cell electrode and the counter electrode receive +5 V and −5 V at the maximum. Odd shift registers receive the signal SI or qm (m being a positive integer) when the signal CLK1 is at a high voltage (20 V), and even shift registers receive the same when the signal CLK2 is at the high voltage. Accordingly, signals q1, q2, and the like are shifted so that they overlap each other by a half of the period of the clock signals CLK1 and CLK2. A signal Qm is a NAND of the signals qm and qm+1 and has a shifted waveform. This signal is used to form two signals by passing the same through an inverter odd or even times, to control transmission-gate switches formed between the input terminals of the signals DATA1 to DATA4 and the data lines. When the signal Qm is at a low voltage, the data lines are connected to the signals DATA1 to DATA4, to write the voltages of the signals DATA1 to DATA4 to the data lines.

Figure 42:
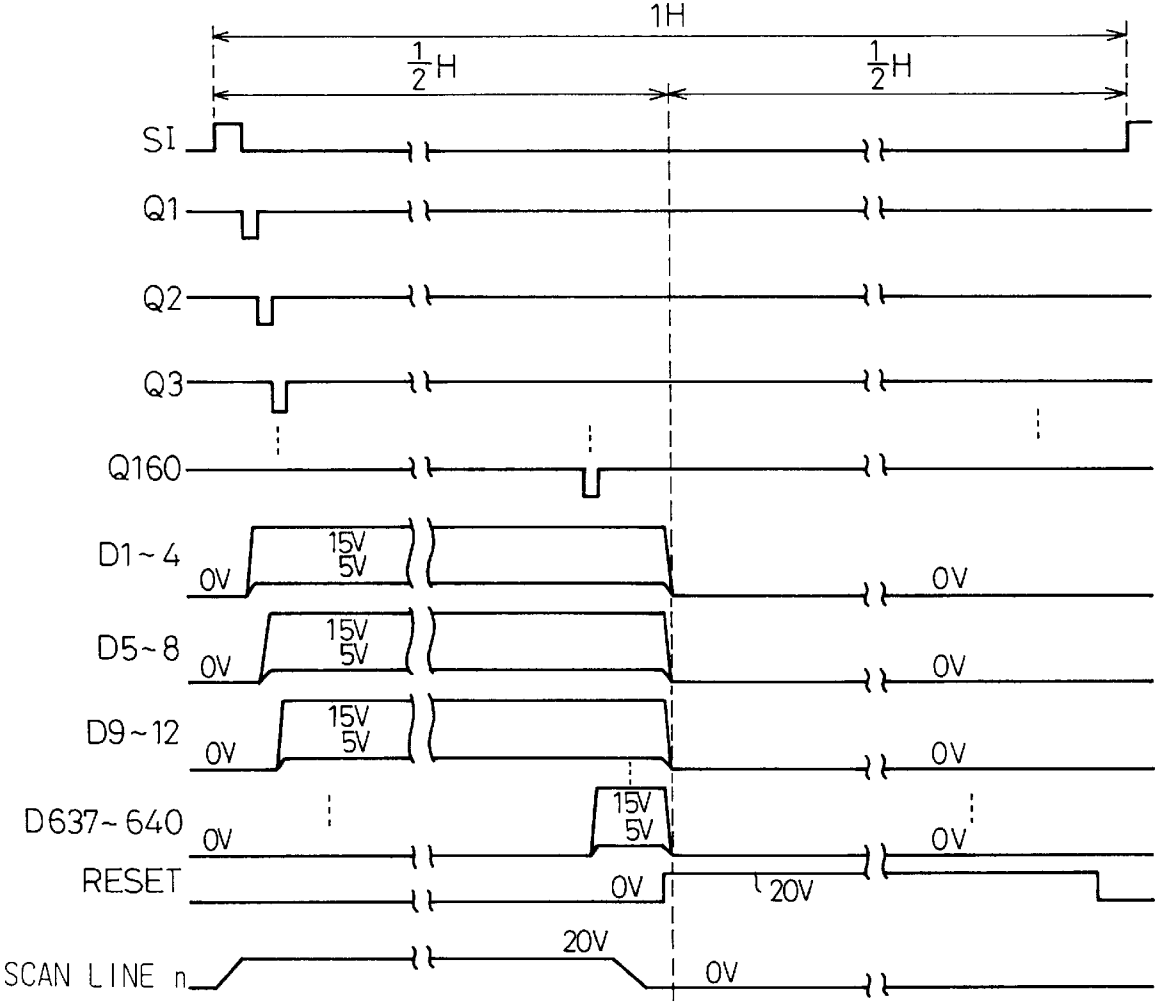
FIG. 42 shows drive waveforms of the twelfth embodiment.

FIG. 42 shows the waveforms of data line voltages and signal RESET. A write period for all data lines according to the shift registers and a sustain period for sustaining the written data until a voltage of 0 (Voff-data) is attained in response to the signal RESET are made to be within a half of a horizontal scan period. After data have been written to all data lines, a scan pulse falls while the data are sustained, to establish a non-conductive state. This results in reducing the dependency of the voltage of each data line on a temporal average voltage, i.e., an effective voltage on the data line. The voltage Voff-data is 0 V (=Vgoff) because the TFT of each cell is of an n-channel type. If they are each of a p-channel type, the polarity of a scan pulse is inverted, and the Voff-data is 20 V. The signal RESET, which is an external input signal in this embodiment, may be generated from Qm' signals (m'>160) by increasing the number of shift registers. The embodiment applies the voltage Voff-data to each data line during the period Toff-data. It is possible to supply four voltages Voff-data1 to Voff-data4 corresponding to DATA1 to DATA4 in parallel so that the voltage Voff-data1 is applied to data lines D1, D5, D9, and the like to which the signal DATA1 is connected, the voltage Voff-data2 to data lines D2, D6, D10, and the like to which the signal DATA2 is connected, the voltage Voff-data3 to data lines D3, D7, D11, and the like to which the signal DATA3 is connected, and the voltage Voff-data4 to data lines D4, D8, D12, and the like to which the signal DATA4 is connected during the period Toff-data.

Figure 43A:
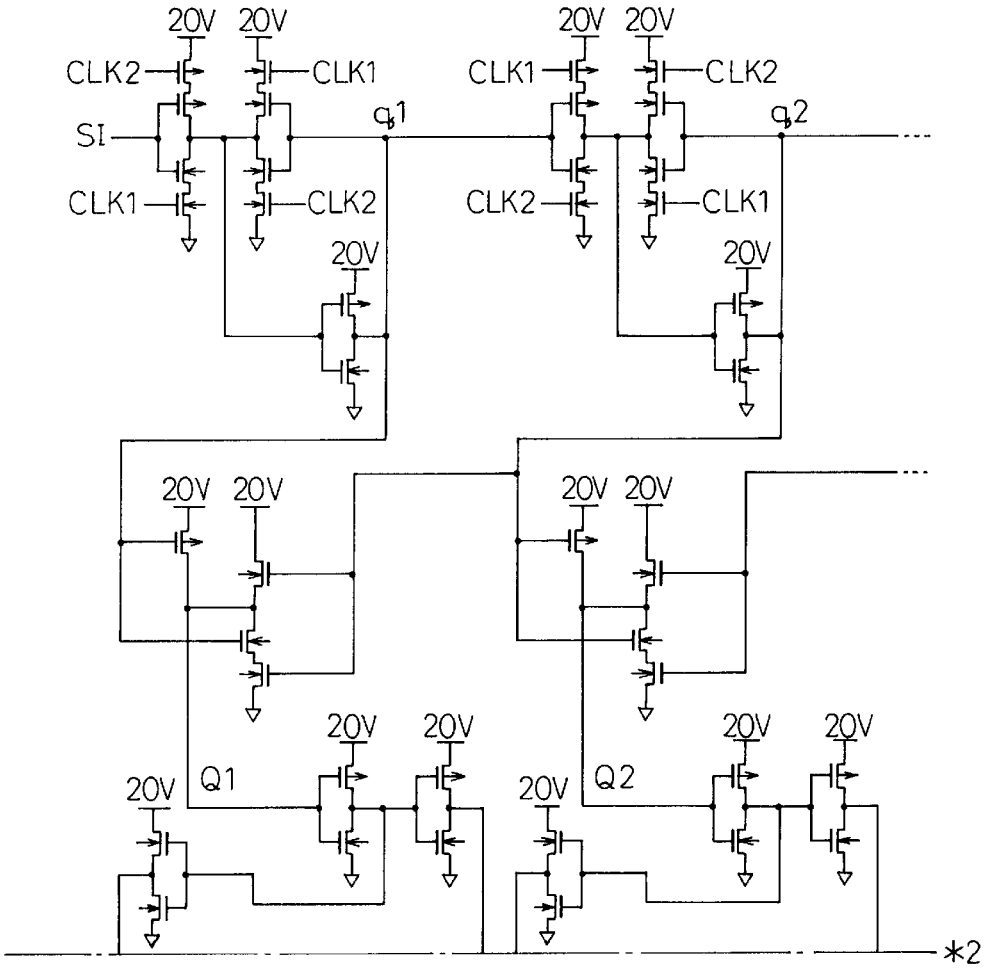
FIGS. 43A and 43B show the details of a data driver according to the thirteenth embodiment of the present invention.
Figure 43B:
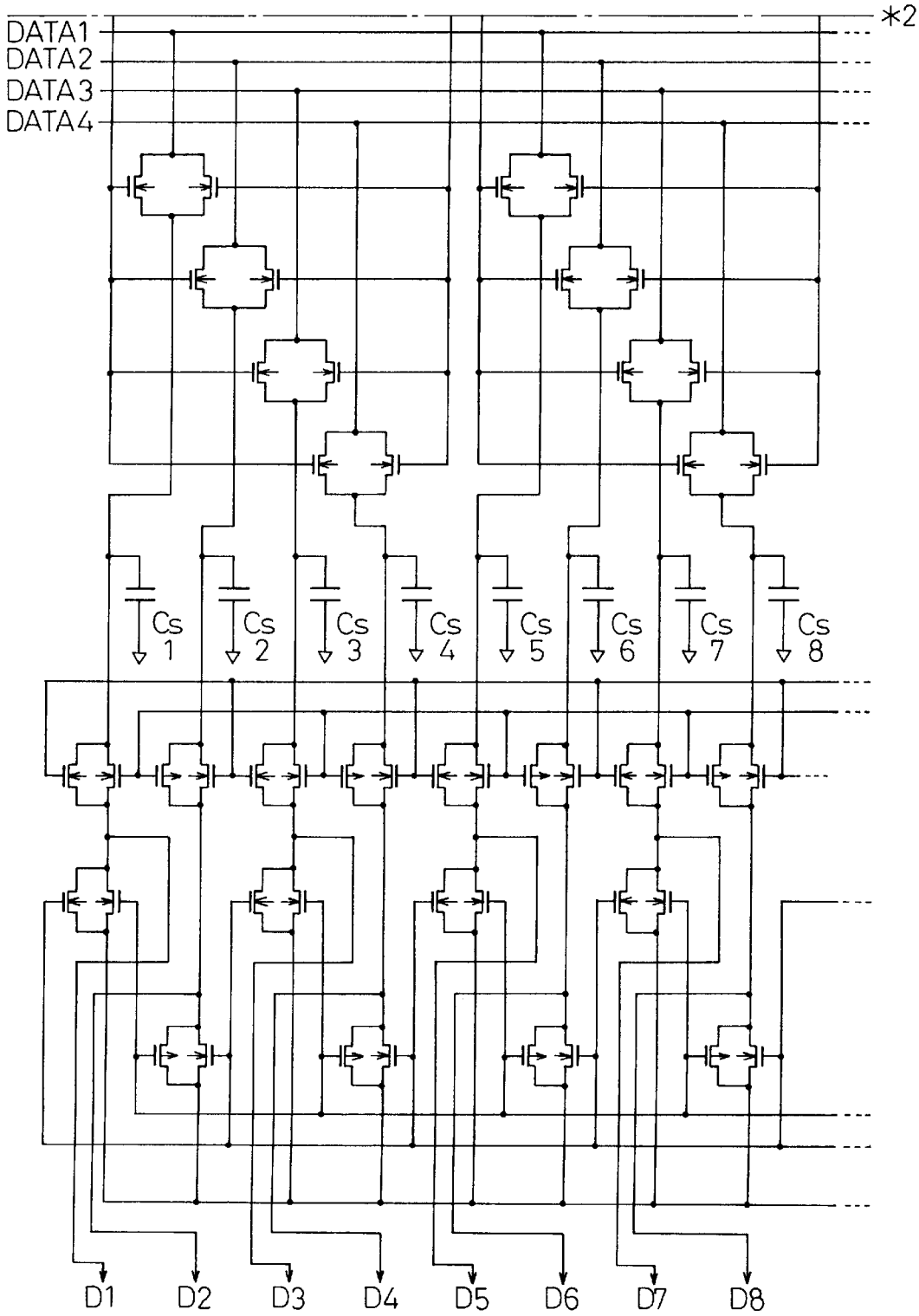
Figure 44:
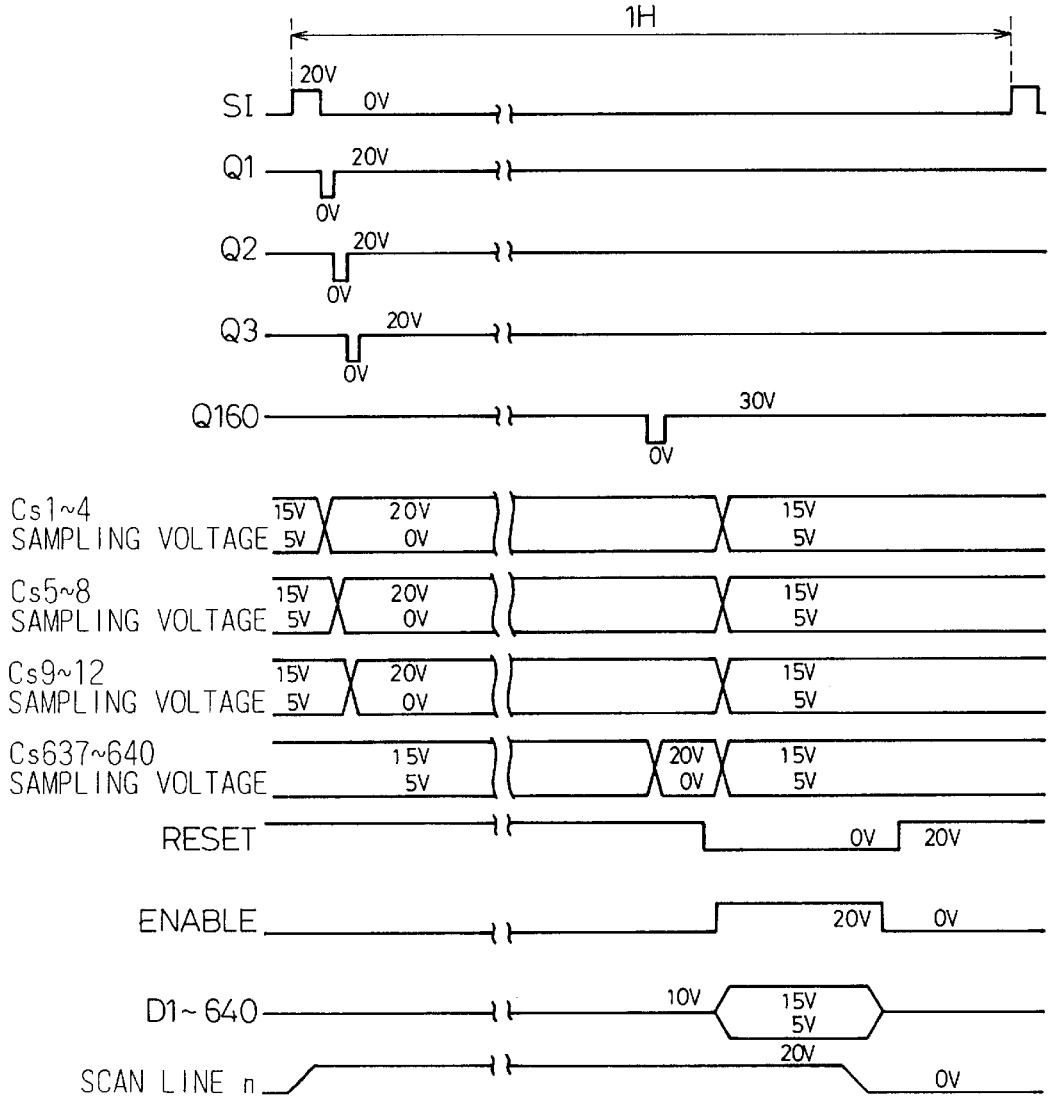
FIG. 44 shows drive waveforms of the thirteenth embodiment.

FIGS. 43A and 43B show the details of a data driver according to the thirteenth embodiment of the present invention. The thirteenth embodiment differs from the twelfth embodiment in that the signals DATA1 to DATA4 are written to capacitors Cs1 to CsN, and in that a write operation from the shift registers to the capacitors Cs1 to CsN is carried out at a different speed. FIG. 44 shows the waveforms of RESET, ENABLE, data line voltages D1, D2, and the like, and a scan pulse. Write and sustain operations on the capacitors Cs1 to CsN take a longer time than a half of a horizontal scan period. A period for writing voltages held by the capacitors Cs1 to CsN to the data lines D1 to DN is only the on-period of the signal ENABLE, which is about 3 $\mu$s. The capacitance of each the capacitors Cs1 to CsN is equal to the capacitance of each data line (about 10 pF). The voltages of DATA1 to DATA4 (Vdmax=20V and Vdmin=0 V) are capacitively divided by a voltage of 10 V (Voff-data) charged to the data line capacitors during the period Toff-data. Accordingly, voltages from 5 V to 15 V are written to the data lines. The TFT of each cell of this embodiment is of an n-channel type, and therefore, the scan pulse shown in the figures is used. If the TFT is of a p-channel type, the polarity of the scan pulse is inverted. The modification explained with reference to the twelfth embodiment is applicable the thirteenth embodiment.

Figure 45:
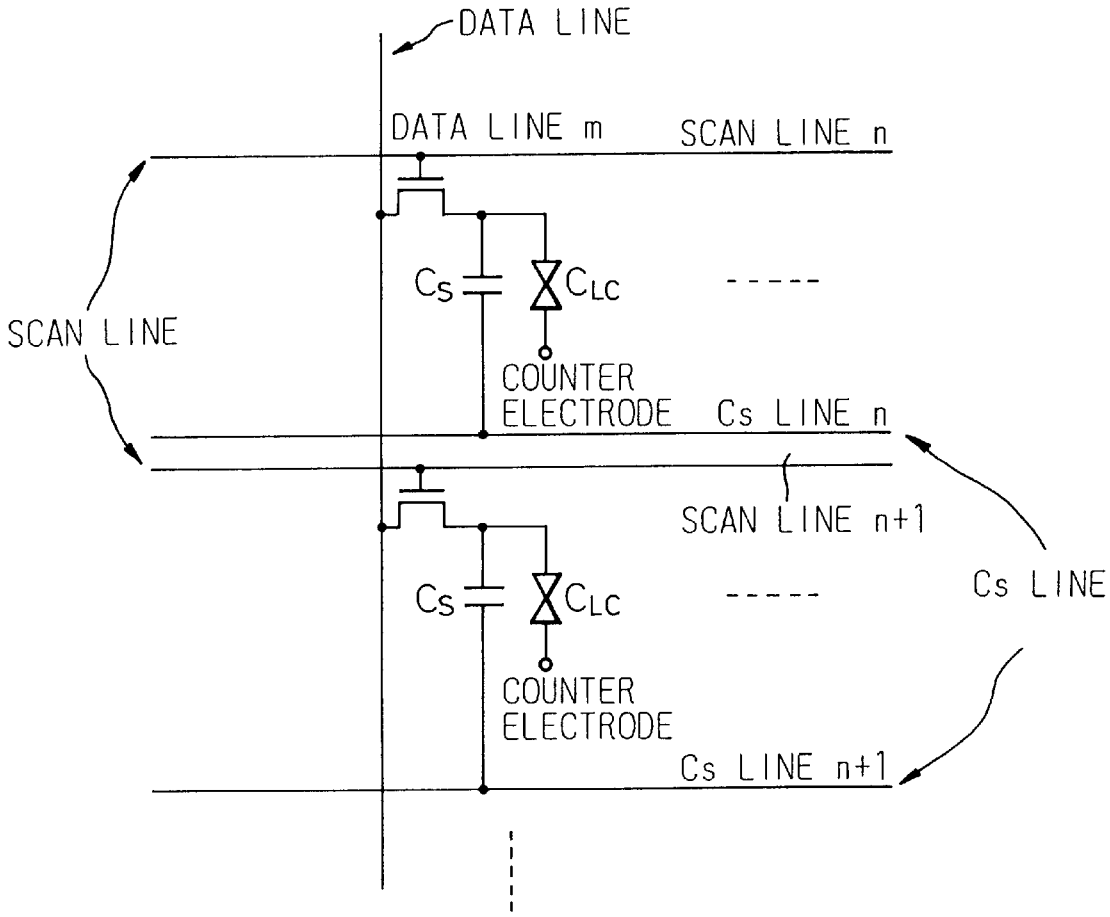
FIG. 45 shows cells of an LCD according to the fourteenth embodiment of the present invention.
Figure 46:
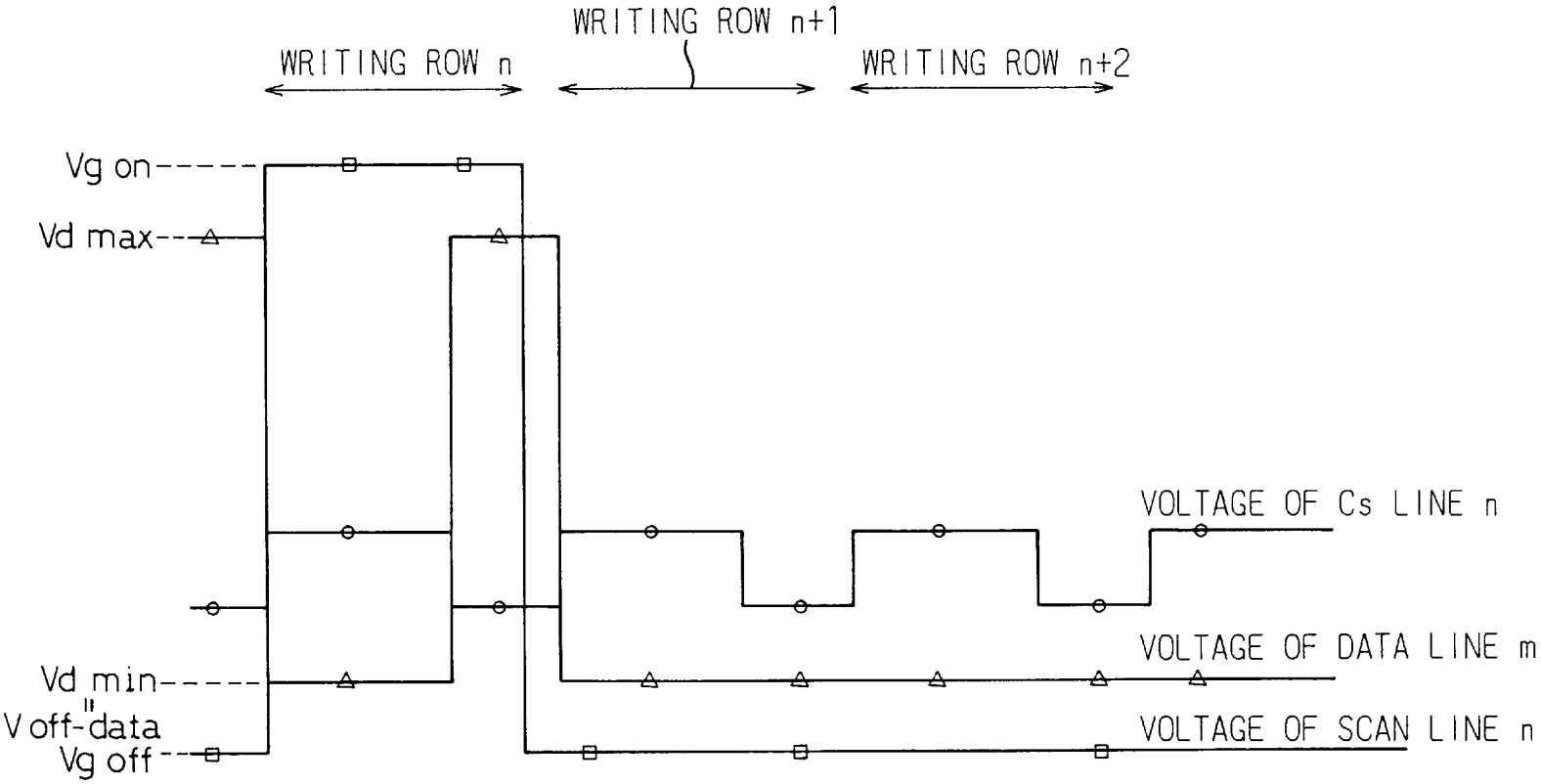
FIG. 46 explains the operation of the cells of FIG. 45.
Figure 47:
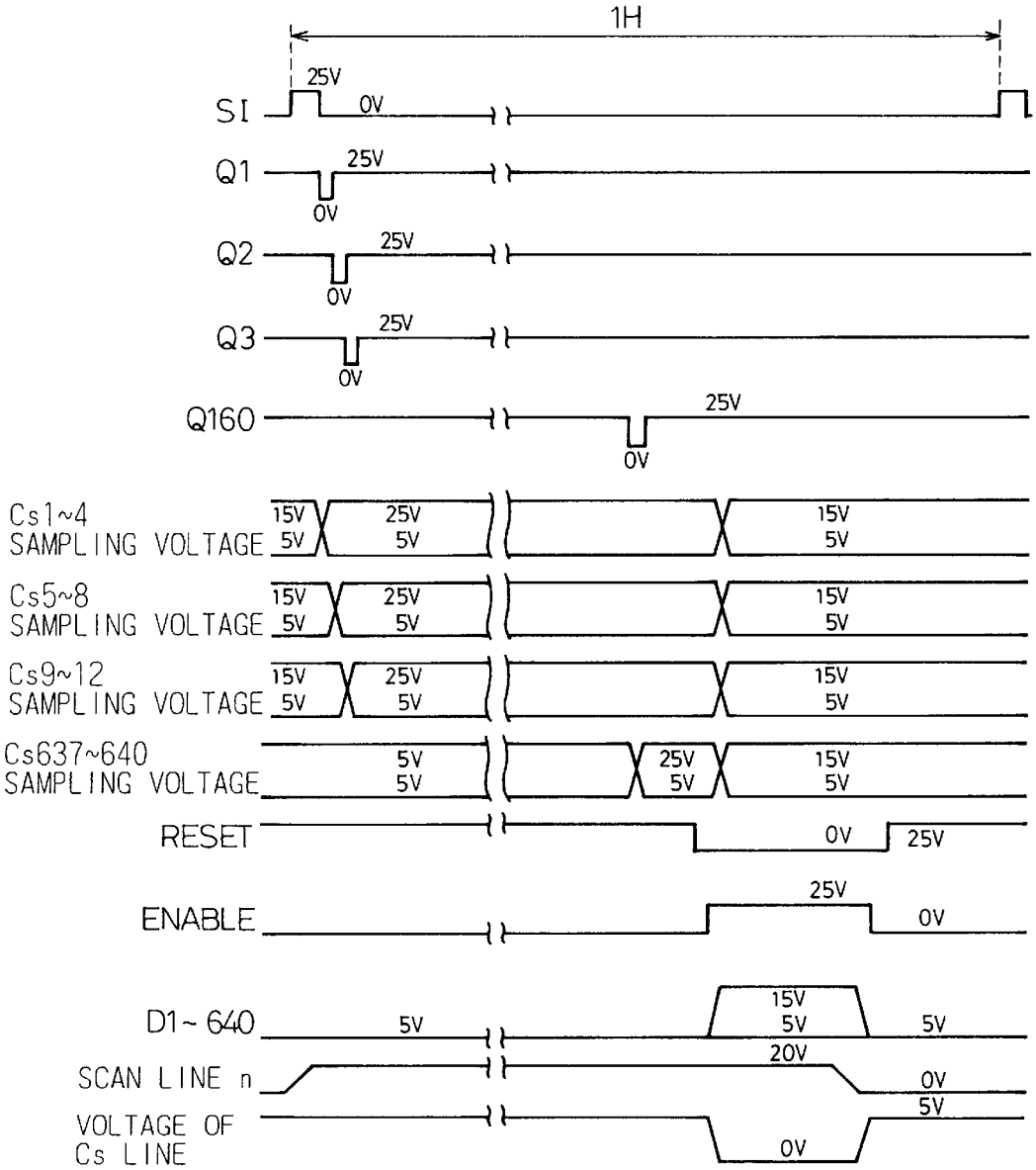
FIG. 47 shows drive waveforms of the fourteenth embodiment.

FIG. 45 shows cells of an LCD according to the fourteenth embodiment of the present invention, FIG. 46 explains the operation of the same, and FIG. 47 shows drive waveforms of the same.

The fourteenth embodiment forms a capacitor Cs in each cell and an auxiliary line connected to the capacitor Cs. The capacitor Cs serves as a sustain capacitor of a cell electrode. When a TFT of each cell is of an n-channel type, a direct-current component of a voltage on the auxiliary line during a period Toff-data is set to be higher than a voltage on the auxiliary line just before a voltage on a scan line changes from Vgon to Vgoff in a period Ton-data. By adjusting the voltage of the auxiliary line during the periods Ton-data and Toff-data and by using the capacitive dividing function of the capacitor Cs and other capacitors of each cell electrode, the voltage level of the cell electrode during the period Toff-data can be precisely controlled. If the TFT is of a p-channel type, the polarity of the scan pulse of FIG. 46 is inverted, and the direct-current component of the voltage of the auxiliary line during the period Toff-data is set to be lower than the voltage of the same just before the voltage of the scan line changes from Vgon to Vgoff during the period Ton-data.

The structure of the data driver of the fourteenth embodiment is the same as that of the thirteenth embodiment of FIGS. 43A and 43B. However, a power source voltage is 25 V in the fourteenth embodiment of FIG. 47. Terminals of lines DATA1 to DATA4 receive signals of 5 V to 25 V corresponding to image data. These signals are sampled by sampling hold circuits. Each data line holds a Voff-data of 5 V according to the preceding signal RESET. In response to the next rise of the signal ENABLE, a sampling capacitance of 10 pF of the sampling hold circuit and a capacitance of 10 pF of each data line divide the sampled data voltage of 5 V to 25 V into a voltage of 5 V to 15 V. After the image data voltages are written to the data lines in response to the signal ENABLE and before the signal RESET, the scan line voltage is changed from Vgon to Vgoff, and the data voltages on the data lines are held by corresponding cells. Then, the voltage of the auxiliary line is changed from 0 V to 5 V, and therefore, the voltage sustained by each cell increases above the Voff-data of 5 V. Due to this, the voltage of each data line becomes lower than the voltage of the cell electrode during the period Toff-data when the TFT of the cell is of an n-channel type. Accordingly, the voltage of the data line serves as a source voltage. Namely, the difference between the gate voltage and source voltage of the TFT of each cell is adjustable. Consequently, it is possible to finely adjust the voltage level of each cell electrode during the period Toff-data.

Figure 48:
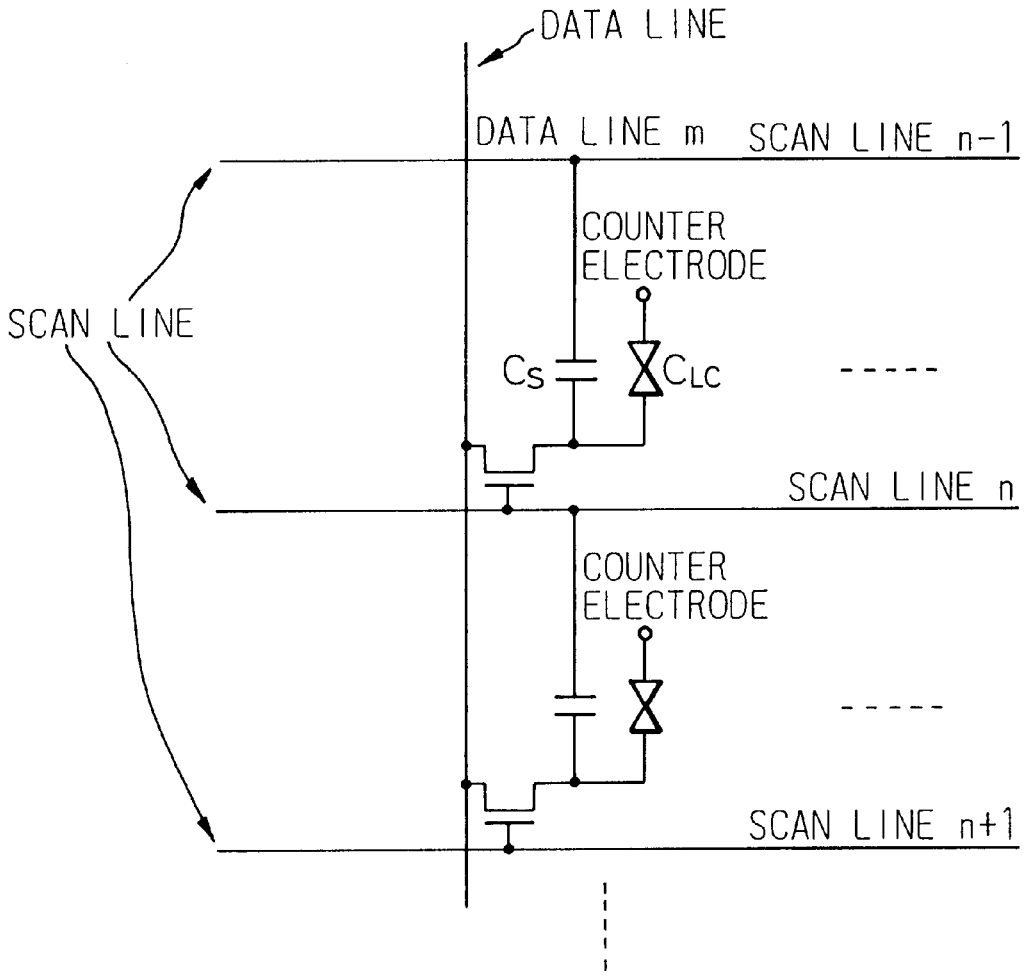
FIG. 48 shows cells of an LCD according to the fifteenth embodiment of the present invention.
Figure 49:
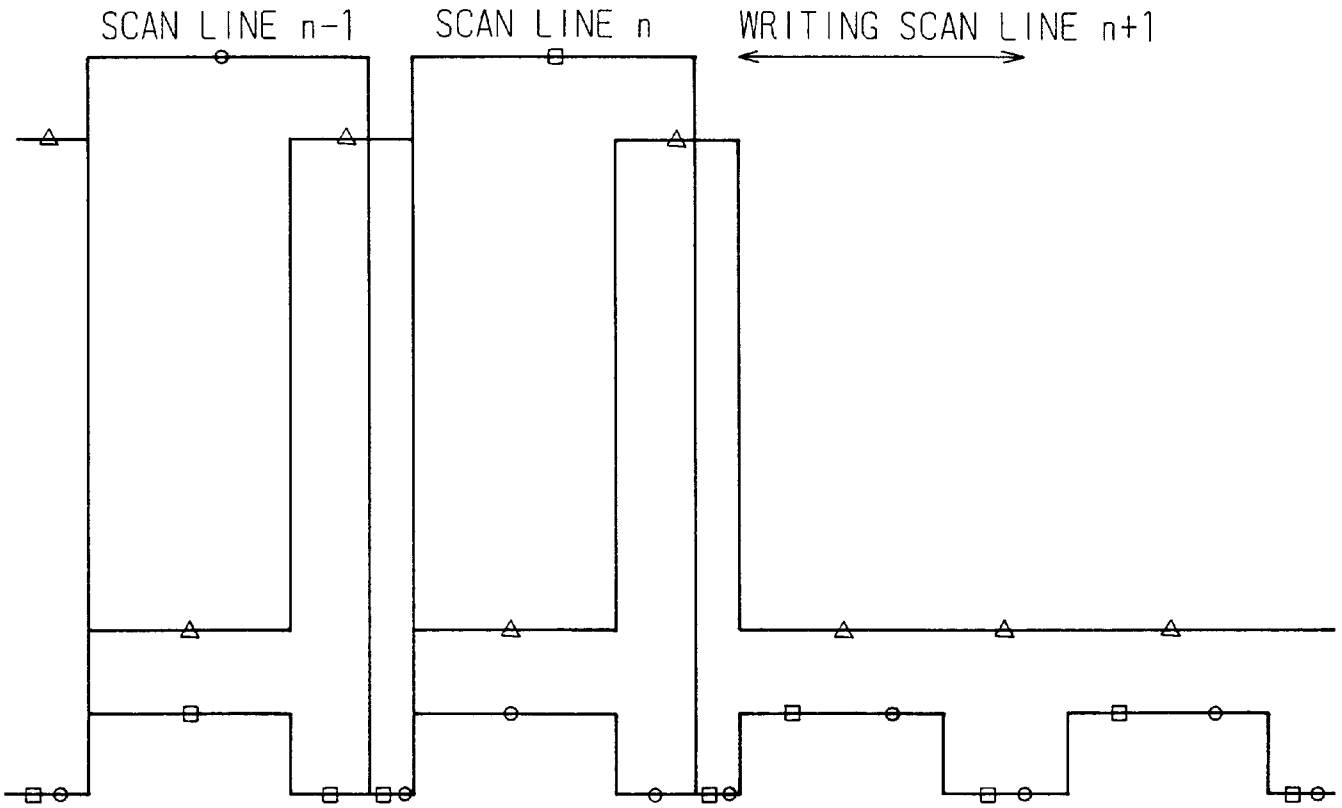
FIG. 49 explains the operation of the cells of FIG. 48.
Figure 50:
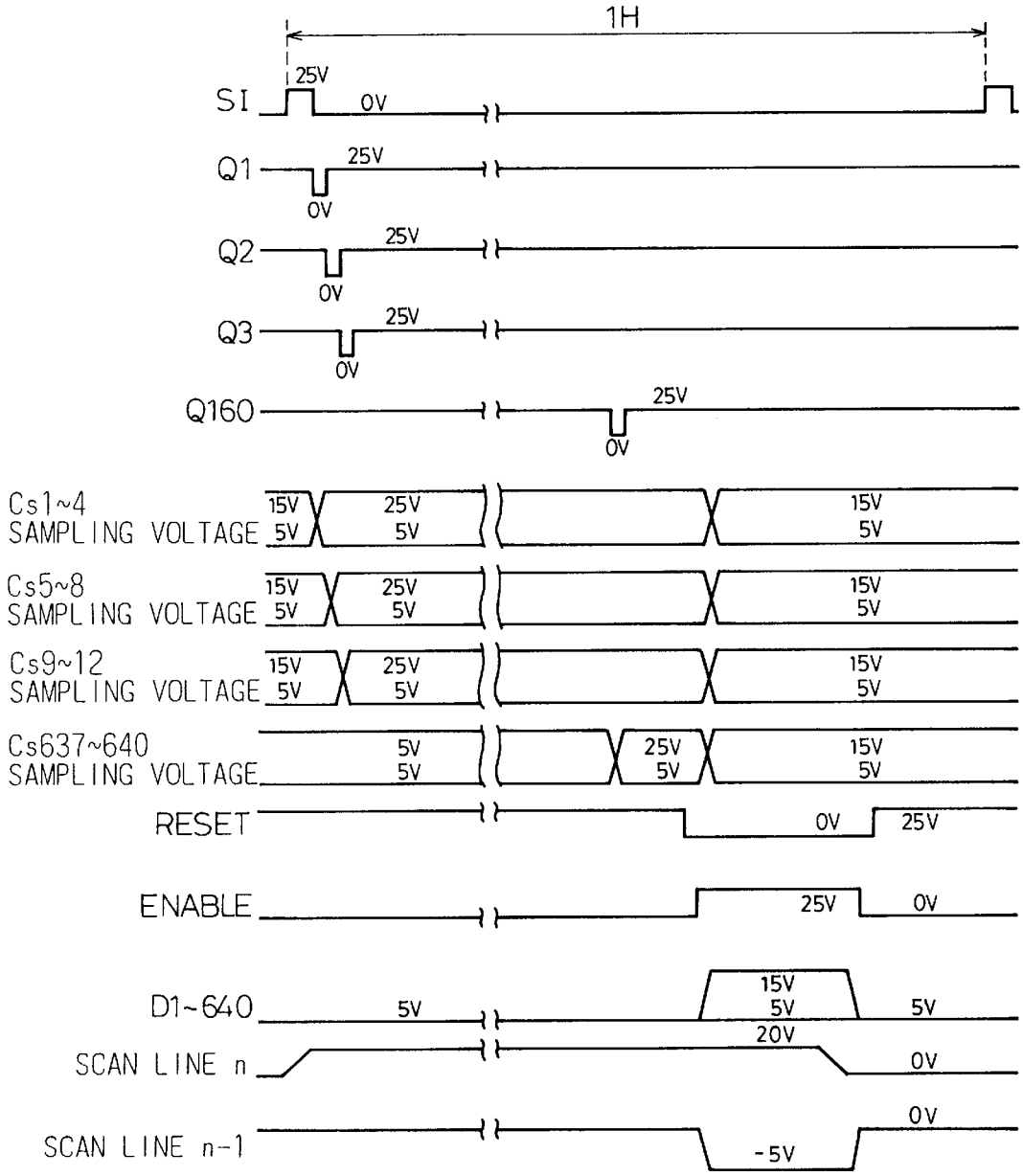
FIG. 50 shows drive waveforms of the fifteenth embodiment.

FIG. 48 shows cells of an LCD according to the fifteenth embodiment of the present invention, FIG. 49 explains the operation thereof, and FIG. 50 shows drive waveforms of the same.

The fifteenth embodiment employs an adjacent scan line as a counter electrode of an auxiliary capacitor of each cell electrode. When each cell has a TFT of an n-channel type, a direct-current component of the voltage of the adjacent scan line during a period Toff-data is set to be higher than a direct-current component of the voltage of the adjacent scan line just before the voltage of the scan line changes from Vgon to Vgoff during a period Ton-data. By adjusting voltages on the adjacent scan line during the periods Ton-data and Toff-data and by using the capacitive dividing function of the capacitor Cs and other capacitors of the cell electrode, the voltage level of the cell electrode during the period Toff-data can be precisely adjusted. When the TFT is of a p-channel type, the polarity of a scan pulse of FIG. 49 is inverted. In this case, the direct-current component of the voltage of the adjacent scan line during the period Toff-data is set to be lower than the voltage of the adjacent scan line just before the voltage of the scan line is changed from Vgon to Vgoff during the period Ton-data.

The structure of the data driver of the fifteenth embodiment is the same as that of the thirteenth embodiment of FIGS. 43A and 43B. The fifteenth embodiment employs, however, a power source voltage of 25 V as shown in FIG. 50. Terminals of lines DATA1 to DATA4 receive signals of 5 V to 25 V corresponding to image data. The signals are sampled by sampling hold circuits. Each data line holds a Voff-data of 5 V according to the preceding signal RESET.

In response to a signal ENABLE, a sampling capacitance of 10 pF of the sampling hold circuit and a capacitance of 10 pF of the data line divide the sampled data voltage of 5 V to 25 V into a voltages of 5 V to 15 V. After the image data voltages are written to the data lines in response to the signal ENABLE and before the signal RESET, the scan line voltage is changed from Vgon to Vgoff, and the data voltages on the data lines are held by corresponding cells. Then, the Vgoff of the scan line is changed from −5 V to 0 V, so that the voltage sustained by each cell increases above the Voff-data of 5 V. Since the TFT of the cell is of an n-channel type, the voltage of the data line is lower than that of the cell electrode during the period Toff-data. Accordingly, the voltage of the data line becomes a source voltage, and therefore, the difference between the gate voltage and the source voltage of the TFT of the cell is adjustable.

Figure 51:
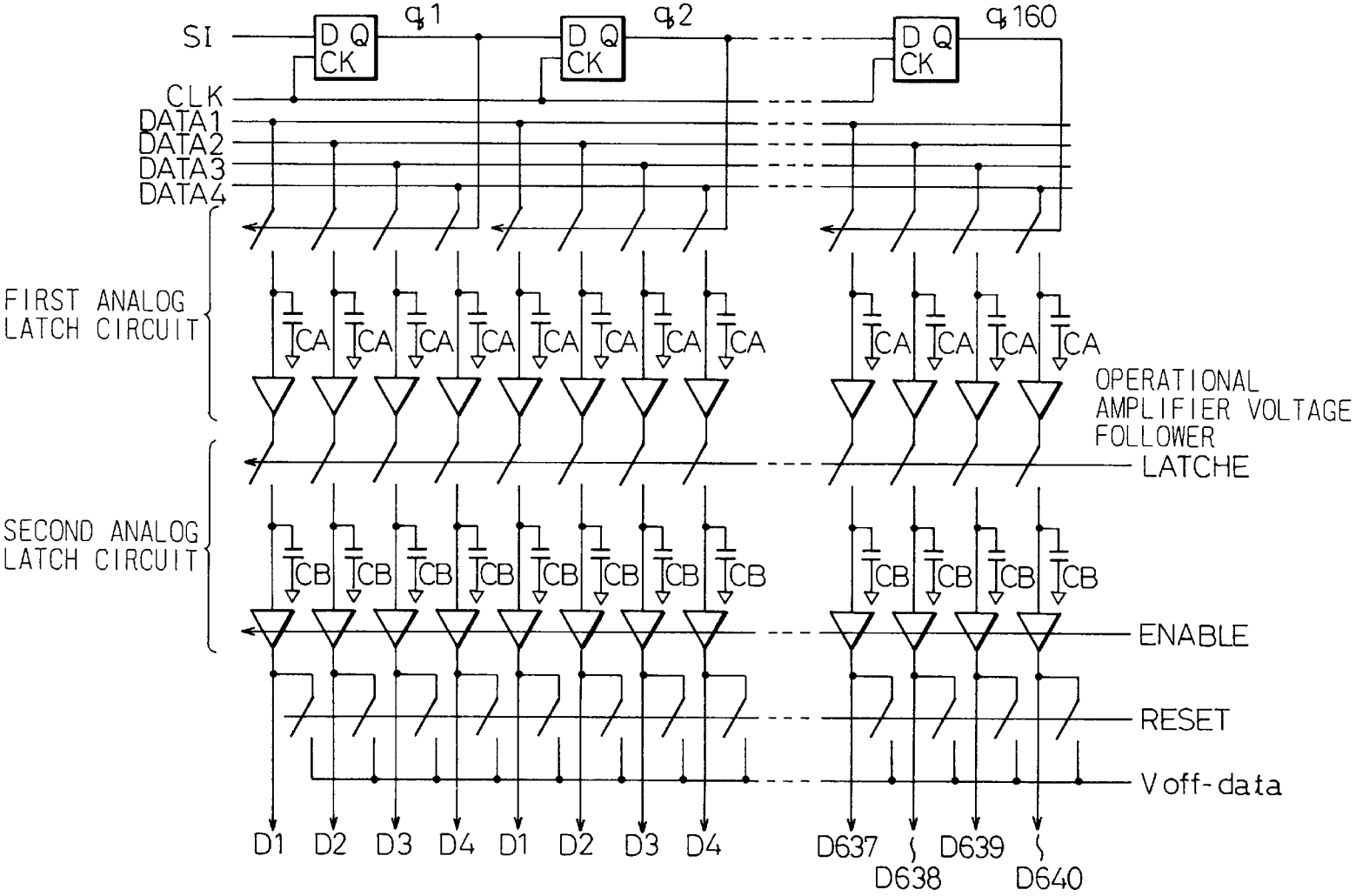
FIG. 51 shows the data driver according to a sixteenth embodiment of the present invention.

FIG. 51 shows a data driver of an LCD according to the sixteenth embodiment of the present invention. This data driver is made of ICs and the LCD is a VGA display. There are two analog latch circuits each having the same number of sampling hold circuits as the number of data lines. The first analog latch circuit successively samples and holds data line drive voltages corresponding to image data applied to DATA1 to DATA4 (Vdmax=15 V and Vdmin=5 V). In response to a signal LATCH, the first analog latch circuit transfers the data line drive voltages for one scan line to the second analog latch circuit. Each output buffer of the second latch circuit is high impedance while a signal ENABLE is being disabled. Accordingly, while the signal ENABLE is being disabled, the voltage of each data line is set to Voff-data (10 V) according to a signal RESET. A period in which the second buffers are enabled according to the signal ENABLE is about 10 $\mu$s that is shorter than a half of a horizontal scan period. A liquid crystal panel of the LCD employs amorphous silicon TFTs.

Any one of the thirteenth and sixteenth embodiments may adjust the voltage Voff-data to minimize an off current of the TFT of each cell, to suppress a temporal average of the off current of the TFT. When the n-channel TFT having the VG-ID characteristics of FIG. 12B is used as a cell TFT, the voltage of Voff-data may be set to Vgoff=0 V, to reduce a bias on the cell TFT during the period Toff-data and lower an off current. This results in reducing a temporal average of the off current. When the bias of the cell TFT at the low off current is not 0 V, the Voff-data or Vgoff may be adjusted to lower the off current.

As explained above, the first aspect of the present invention prevents cross-talk and correctly displays images with a required brightness even if each cell electrode is capacitively connected to adjacent data lines. An LCD according to the first aspect has high brightness and superior display quality. The LCD may employ a dot sequential data driver to reduce the cost thereof.

The second aspect of the present invention reduces the off current of each cell TFT and properly sustains a cell voltage, to improve display quality. The second aspect reduces the dependency of a temporal average voltage (an effective voltage) of each data line on the image data, to prevent cross-talk without a frame memory or a correction circuit that must be provided for a conventional LCD.

What is claimed is:

1. An active-matrix LCD comprising:

a liquid crystal panel having data lines arranged in parallel with one another, scan lines arranged orthogonally to the data lines, and liquid crystal cells arranged at the intersections of the data and scan lines, respectively, each of the cells having a cell electrode and switching means that is arranged between and connected to the cell electrode and a corresponding one of the data lines, the conduction of the switching means being controlled in response to a scan pulse applied to a corresponding one of the scan lines;

a data driver for applying data signals to the data lines, respectively, so that the data signals are written to the corresponding ones of the cells; and a scan driver for applying the scan pulse sequentially to the scan lines, the data driver applying positive and negative signals that are opposite to each other with respect to a reference level, to each of the data lines within the period of the scan pulse to reduce an influence of parasitic capacitance between the cell electrode and the data lines.

2. The LCD according to claim 1, wherein the data driver provides data signals to be written to corresponding ones of the cells in synchronization with the end of the application of the scan pulse.

3. The LCD according to claim 1, wherein the period and amplitude of each of the positive and negative data signals are determined to fix the effective voltage of the data signals within the period of the scan pulse.

4. The LCD according to claim 3, wherein the period and amplitude of the positive data signal are equal to those of the negative data signal within the period of the scan pulse.

5. The LCD according to claim 3, wherein, in the period of the scan pulse, a write period for providing a data signal to be written to a given cell is set to be longer than a correction period for providing a data signal of opposite polarity, so that an effective voltage in the write period has the same strength as and different polarity from an effective voltage in the correction period.

6. The LCD according to claim 1, wherein the data driver inverts data signals to be applied to a given data line at intervals of the period of the scan pulse.

7. The LCD according to claim 1, wherein the data driver corrects a data signal to be applied to a given cell for a fluctuation due to signals applied to data lines that are capacitively connected to the cell and provides the cell with the corrected data signal.

8. The LCD according to claim 7, wherein the data signal is corrected according to the data voltage to be applied to the adjacent data line, which is capacitively connected to the cell, simultaneously when the data signal is written to the cell, as well as the capacitance between the cell and the adjacent data line.

9. The LCD according to claim 7, wherein a data signal to be applied to an end cell having an adjacent data line on only one side thereof is first corrected, and a data signal to be applied to a given data line is corrected according to the corrected data signal of the preceding data line.

10. The LCD according to claim 9, wherein the data driver has:

a polarity controller for providing a row/column polarity control signal as well as a polarity control signal in response to a horizontal synchronous signal;

a polarity adder for providing polarity added display data according to display data and the row/column polarity control signal;

a column n data memory for latching and holding the polarity added display data in synchronization with a latch control signal, and providing uncorrected display data for a column n;

a column n−1 data memory for latching corrected display data for the column n in synchronization with the latch control signal and providing display data for a column n−1; and a calculator for calculating a correction value for display data for the column n according to the uncorrected display data for the column n and the display data for the column n−1, adding the correction value to the uncorrected display data for the column n, and providing corrected display data for the column n.

11. The LCD according to claim 10, wherein the calculator has:

a loop consisting of a correction value adder for adding a correction value to the uncorrected display data for the column n from the column n data memory and providing corrected data, and a first attenuator for calculating a fluctuation due to the addition of the corrected data and feeding the fluctuation back to the correction value adder;

a second attenuator for calculating a fluctuation in the column n caused by the display data for the column n−1 provided by the column n−1 data memory; and an adjacent data adder for adding the outputs of the correction value adder and second attenuator to each other after the operation of the loop is repeated a given number of times and providing the corrected display data for the column n.

12. The LCD according to claim 10, wherein the calculator has:

a first multiplier for calculating a fluctuation caused when the uncorrected display data from the column n memory is applied to the column n;

a second multiplier for calculating a fluctuation in the column n when the display data from the column n−1 memory is applied to the column n−1;

a first adder for adding the outputs of the first multiplier and second multiplier to each other and providing a first correction value;

a loop consisting of a second adder for adding the output of the first adder to a correction value, and a third multiplier for calculating a fluctuation caused by the output of the second adder; and a third adder for adding the output of the second adder to the output of the column n memory after the operation of the loop is repeated given times and providing the corrected display data for the column n.

13. The LCD according to claim 10, wherein the coupling capacitance between a given cell and a corresponding data line is $\alpha$ and the coupling capacitance between the cell and a preceding data line that is capacitively connected to the cell is $\beta$, and wherein the calculator has:

a first multiplier for multiplying the uncorrected display data for the column n from the column n memory by $\alpha$;

a second multiplier for multiplying the display data for the column n−1 from the column n=1 memory by $\beta$; and an adder for adding the outputs of the first multiplier and second multiplier together.

14. The LCD according to claim 9, wherein the calculation means has a lookup table that contains correction values for pairs of uncorrected display data for the column n and display data for the column n=1 so that the correction values are addressed according to the uncorrected display data for the column n and display data for the column n=1.

15. The LCD according to claim 14, wherein the correction is made according to the $\gamma$ characteristics of the LCD so that a data voltage correctly displays a required brightness level.

16. The LCD according to claim 9, wherein the end cell having an adjacent data line on only one side thereof is at the left end of the LCD.

17. The LCD according to claim 1, wherein each cell electrode overlaps at least one of the two adjacent data lines that are on the opposite sides thereof.

18. The LCD according to claim 1, wherein at least part of the cell electrode is covered with a thin film of relatively low resistance, and an end of the thin film is connected to at least one of the adjacent data lines.

19. The LCD according to claim 18, wherein the part of the cell electrode covered with the thin film extends along an adjacent one of the scan lines.

20. The LCD according to claim 1, wherein:

the data driver is a dot sequential data driver having addressing elements for instructing the timing of fetching display data, an input bus for simultaneously receiving display data, and switching elements for connecting the input bus to the data lines according to the timing instructed by the addressing elements, the data lines are sequentially and selectively connected to the input bus to write the display data to corresponding cells; and one of the data lines is connected to the input bus before the preceding one of the data lines is disconnected from the input bus.

21. The LCD according to claim 20, wherein the data driver has at least two input buses, the data lines are divided into groups each including at least adjacent data lines and each of the input buses has signal lines whose number is equal to the number of data lines included in each group thereof.

22. The LCD according to claim 20, wherein the addressing elements consist of shift registers whose shift pulse has a width of a plurality of shift cycles.

23. The LCD according to claim 22, wherein each of the shift registers is a half-clock synchronous flip-flop.

24. An active-matrix LCD comprising:

a liquid crystal panel having data lines arranged in parallel with one another, scan lines arranged orthogonally to the data lines, and liquid crystal cells arranged at the intersections of the data and scan lines, respectively, each of the cells having a cell electrode and switching means that is arranged between and connected to the cell electrode and a corresponding one of the data lines, the conduction of the switching means being controlled in response to a scan pulse applied to a corresponding one of the scan lines;

a data driver for applying data signals to the data lines, respectively, so that the data signals are written to corresponding ones of the cells;

a scan driver for applying the scan pulse sequentially to the scan lines; and a display controller for providing the data driver with display data, a horizontal synchronous signal, and a latch control signal, and the scan driver with a vertical synchronous signal, the data driver comprising:

a polarity controller for providing a row/column polarity control signal as well as a polarity control signal in response to the horizontal synchronous signal;

a polarity adder for providing polarity added display data according to the display data and row/column polarity control signal;

a column n memory for latching and holding the polarity added display data in synchronization with the latch control signal, and providing uncorrected display data for a column n;

a column n−1 memory for latching corrected display data for the column n in synchronization with the latch control signal and providing display data for a column n=1; and a calculator for calculating a correction value for display data for the column n according to the uncorrected display data for the column n and the display data for the column n=1, adding the correction value to the uncorrected display data for the column n, and providing corrected display data for the column n.

25. The LCD according to claim 24, wherein the calculator has:

a loop consisting of a correction value adder for adding a correction value to the uncorrected display data for the column n from the column n memory and providing corrected data, and a first attenuator for calculating a fluctuation due to the addition of the corrected data and feeding the fluctuation back to the correction value adder;

a second attenuator for calculating a fluctuation in the column n caused by the display data for the column n−1 provided by the column n=1 memory; and an adjacent data adder for adding the outputs of the correction value adder and second attenuator together after the operation of the loop is repeated a given number of times and providing the corrected display data for the column n.

26. The LCD according to claim 24, wherein the calculation means has:

a first multiplier for calculating a fluctuation caused when the uncorrected display data from the column n memory is applied to the column n;

a second multiplier for calculating a fluctuation in the column n when the display data from the column n−1 memory is applied to the column n−1;

a first adder for adding the outputs of the first multiplier and second multiplier together and providing a first correction value;

a loop consisting of a second adder for adding the output of the first adder to a correction value, and a third multiplier for calculating a fluctuation caused by the output of the second adder; and a third adder for adding the output of the second adder to the output of the column n memory after the operation of the loop is repeated a given number of times and providing the corrected display data for the column n.

27. The LCD according to claim 24, wherein coupling capacitance between a given cell and a corresponding data line is $\alpha$ and the coupling capacitance between the cell and a preceding data line that is capacitively connected to the cell is $\beta$, and wherein the calculator has:

a first multiplier for multiplying the uncorrected display data for the column n from the column n memory by $\alpha$;

a second multiplier for multiplying the display data for the column n−1 from the column n−1 memory by $\beta$; and an adder for adding the outputs of the first multiplier and second multiplier together.

28. An active-matrix LCD comprising:

a liquid crystal panel having data lines arranged in parallel with one another, scan lines arranged orthogonally to the data lines, and liquid crystal cells arranged at the intersections of the data and scan lines, respectively, each of the cells having a cell electrode and a switching element that is arranged between and connected to the cell electrode and a corresponding one of the data lines, the conduction of the switching element being controlled in response to a scan pulse applied to a corresponding one of the scan lines;

a data driver for applying data signals to the data lines, respectively, so that the data signals are written to corresponding ones of the cells;

a scan driver for applying the scan pulse sequentially to the scan lines; and a display controller for providing the data driver with display data and a control signal, and the scan driver with a control signal;

a period (Ton-data) for which the data driver applies data voltages to the data lines to write the data voltages to a row of the cells, respectively, being shorter than a horizontal synchronous period corresponding to the period of the scan pulse, a predetermined voltage (Voff-data) being applied to the data lines for the remaining period (Toff-data) of the horizontal synchronous period other than the data voltage applying period (Ton-data).

29. The LCD according to claim 28, wherein the predetermined voltage (Voff-data) has a direct-current component that is constant at regular intervals.

30. The LCD according to claim 28, wherein the data voltage applying period (Ton-data) is shorter than a half of the horizontal synchronous period.

31. The LCD according to claim 28, wherein the direct-current component of the predetermined voltage (Voff-data) during the remaining period (Toff-data) is substantially equal to an average ((Vdmax+Vdmin)/2) of the maximum (Vdmax) and minimum (Vdmin) of the data voltages.

32. The LCD according to claim 28, wherein the switching means is an n-channel TFT, and the predetermined voltage (Voff-data) in the remaining period (Toff-data) is lower than the minimum of the data voltages.

33. The LCD according to claim 28, wherein the switching means is a p-channel TFT, and the predetermined voltage (Voff-data) in the remaining period (Toff-data) is higher than the maximum of the data voltages.

34. The LCD according to claim 28, wherein:

each of the cells is provided with an auxiliary capacitor whose one electrode is connected to the cell electrode and whose other electrode is connected to an auxiliary line that overlaps the cell electrode with an insulation film being laid between them; and the switching element is an n-channel TFT, and a voltage applied to the auxiliary line during the remaining period (Toff-data) is higher than a voltage applied to the same during the data voltage applying period (Ton-data).

35. The LCD according to claim 28, wherein:

each of the cells is provided with an auxiliary capacitor whose one electrode is connected to the cell electrode and whose other electrode is connected to an auxiliary line that overlaps the cell electrode with an insulation film being laid between them; and the switching element is a p-channel TFT, and a voltage applied to the auxiliary line during the remaining period (Toff-data) is lower than a voltage applied to the same during the data voltage applying period (Ton-data).

36. The LCD according to claim 28, wherein:

the cell electrode is formed over an adjacent one of the scan lines with an insulation film being laid between them, to form an auxiliary capacitor whose one electrode is the cell electrode and whose other electrode is the adjacent scan line; and the switching element is an n-channel TFT, and a voltage applied to the scan lines, except the one to which the scan pulse is applied, during the remaining period (Toff-data) is higher than a voltage applied to the same during the data voltage applying period (Ton-data).

37. The LCD according to claim 28, wherein:

the cell electrode is formed over an adjacent one of the scan lines with an insulation film being laid between them, to form an auxiliary capacitor whose one electrode is the cell electrode and whose other electrode is the adjacent scan line; and the switching element is a p-channel TFT, and a voltage applied to the scan lines, except the one to which the scan pulse is applied, during the remaining period (Toff-data) is lower than a voltage applied to the same during the data voltage applying period (Ton-data).

38. The LCD according to claim 28, further comprising means for adjusting the predetermined voltage (Voff-data) applied to the data lines during the remaining period (Toff-data).

39. The LCD according to claim 28, wherein the data driver has, on the same substrate on which the cells are formed:

sampling hold circuits whose number is at least equal to the number of the data lines, to hold data signals for a row of the cells;

a controller for generating control signals to control switches of the sampling hold circuits; and a switch for connecting the data lines to the output terminals of the sampling hold circuits, or to the circuit for supplying the predetermined voltage (Voff-data) during the remaining period (Toff-data).

40. A method for driving an active-matrix LCD having a liquid crystal panel having data lines arranged in parallel with one another, scan lines arranged orthogonally to the data lines, and liquid crystal cells arranged at the intersections of the data and scan lines, respectively, each of the cells having a cell electrode and switching means that is arranged between and connected to the cell electrode and a corresponding one of the data lines, the conduction of the switching means being controlled in response to a scan pulse applied to a corresponding one of the scan lines; a data driver for applying data signals to the data lines, respectively, so that the data signals are written to corresponding ones of the cells; and a scan driver for applying the scan pulse sequentially to the scan lines, comprising the step of:

applying positive and negative signals that are opposite to each other with respect to a reference level, to each of the data lines within the period of the scan pulse to reduce an influence of parasitic capacitance between the cell electrode and the data lines.

41. The method according to claim 40, wherein the data signal applied to any one of the cells through a corresponding one of the data lines is corrected for at least one fluctuation caused by a signal applied to an adjacent one of the data lines that is capacitively connected to the cell and by the scan pulse.

42. The method according to claim 41, wherein the data signal is corrected according to a data voltage to be applied to the adjacent data line simultaneously when the data signal is written to the cell, as well as capacitance between the cell and the adjacent data line.

43. The method according to claim 41, wherein a data signal to be applied to an end cell having an adjacent data line on only one side thereof is first corrected, and a data signal to be applied to a given data line is corrected according to the corrected data signal of the preceding data line.

44. The method according to claim 40, wherein:

the data driver is a dot sequential data driver having addressing elements for instructing the timing of fetching display data, an input bus for simultaneously receiving display data, and switching elements for connecting the input bus to the data lines according to the timing instructed by the addressing elements, the data lines are sequentially and selectively connected to the input bus, to write the display data to corresponding cells; and one of the data lines is connected to the input bus before the preceding one of the data lines is disconnected from the input bus.

45. A method of driving an active-matrix LCD having a liquid crystal panel having data lines arranged in parallel with one another, scan lines arranged orthogonally to the data lines, and liquid crystal cells arranged at the intersections of the data and scan lines, respectively, each of the cells having a cell electrode and a switching element that is arranged between and connected to the cell electrode and a corresponding one of the data lines, the conduction of the switching element being controlled in response to a scan pulse applied to a corresponding one of the scan lines; a data driver for applying data signals to the data lines, respectively, so that the data signals are written to corresponding ones of the cells; a scan driver for applying the scan pulse sequentially to the scan lines; and display controller for providing the data driver with display data, a horizontal synchronous signal, and a latch control signal, and the scan driver with a vertical synchronous signal, comprising the step of:

applying data voltages to the data lines by the data driver for a period (Ton-data), to write the data voltages to a row of the cells, respectively, the period (Ton-data) being shorter than a horizontal synchronous period corresponding to the period of the scan pulse, and applying a predetermined voltage (Voff-data) to the data lines for the remaining period (Toff-data) of the horizontal synchronous period other than the data voltage applying period (Ton-data).

46. The method according to claim 45, wherein the switching element is an n-channel TFT, and the predetermined voltage (Voff-data) in the remaining period (Toff-data) is lower than the minimum of the data voltages.

47. The method according to claim 45, wherein the switching element is a p-channel TFT, and the predetermined voltage (Voff-data) in the remaining period (Toff-data) is higher than the maximum of the data voltages.

* * * * *

UNITED STATES PATENT AND TRADEMARK OFFICE

CERTIFICATE OF CORRECTION

PATENT NO. : 6,040,814
DATED : March 21, 2000
INVENTOR(S) : Murakami et al.

It is certified that error appears in the above-indentified patent and that said Letters Patent is hereby corrected as shown below:

In the Claims:

In claim 13, line 9, delete "n=1" and insert

-- n-1 -- therefor

In claim 14, line 4, delete "n=1" and insert

-- n-1 -- therefor

In claim 14, line 7, delete "n=1" and insert

-- n-1 -- therefor

In claim 24, line 35, delete "n=1" and insert

-- n-1 -- therefor

UNITED STATES PATENT AND TRADEMARK OFFICE

CERTIFICATE OF CORRECTION

PATENT NO. : 6,040,814
DATED : March 21, 2000
INVENTOR(S) : Murakami et al.

It is certified that error appears in the above-indentified patent and that said Letters Patent is hereby corrected as shown below:

In claim 24, line 39, delete "n=1" and insert

-- n-1 -- therefor

In claim 25, line 36, delete "n=1" and insert

-- n-1 -- therefor

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*